US012753039B2

(12) United States Patent
Suzuki et al.

(10) Patent No.: US 12,753,039 B2
(45) Date of Patent: Oct. 6, 2026

(54) MEDIUM PROCESSING APPARATUS AND IMAGE FORMING SYSTEM INCORPORATING SAME

(71) Applicants: Kazuyuki Suzuki, Kanagawa (JP); Keisuke Sugiyama, Kanagawa (JP); Kei Sasaki, Kanagawa (JP); Kazuki Seto, Kanagawa (JP)

(72) Inventors: Kazuyuki Suzuki, Kanagawa (JP); Keisuke Sugiyama, Kanagawa (JP); Kei Sasaki, Kanagawa (JP); Kazuki Seto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 250 days.

(21) Appl. No.: 18/613,845

(22) Filed: Mar. 22, 2024

(65) Prior Publication Data

US 2024/0317537 A1 Sep. 26, 2024

(30) Foreign Application Priority Data

Mar. 23, 2023 (JP) ..... 2023-047025
Feb. 13, 2024 (JP) ..... 2024-019667

(51) Int. Cl.
*B65H 37/04* (2006.01)

(52) U.S. Cl.
CPC ..... *B65H 37/04* (2013.01); *B65H 2301/1635* (2013.01); *B65H 2301/5126* (2013.01); *B65H 2301/5161* (2013.01); *B65H 2301/5162* (2013.01); *B65H 2801/24* (2013.01)

(58) Field of Classification Search
CPC .... B31F 1/07; B31F 1/36; B31F 5/001; B31F 5/02; B31F 2201/0754; B31F 2201/0779;
(Continued)

(56) References Cited

U.S. PATENT DOCUMENTS 9,744,740 B2 * 8/2017 Abe ..... B65H 37/04
10,654,240 B2 * 5/2020 Takahashi ..... B65H 37/04
(Continued)

FOREIGN PATENT DOCUMENTS

JP 2014-201432 A 10/2014
JP 6057167 B2 1/2017
JP 2019-010811 A 1/2019

OTHER PUBLICATIONS

Extended European Search Report dated Aug. 14, 2024 issued in corresponding European Appln. No. 24165168.6.

*Primary Examiner* — Leslie A Nicholson, III
(74) *Attorney, Agent, or Firm* — Harness, Dickey & Pierce, P.L.C.

(57) ABSTRACT

A medium processing apparatus includes a liquid applier, a post-processing device, and a controller that is circuitry. The liquid applier applies liquid on at least one medium. The post-processing device performs a combination of various types of post-processes including a liquid application crimp binding and a crimp binding and a various types of bindings including a dual binding, a parallel binding, and an oblique binding, on a bundle of media including the at least one medium for a number of times. The circuitry is to change the number of times of the post-process according to the combination of the various types of the post processes and the various types of bindings, to be performed.

8 Claims, 40 Drawing Sheets

(58) Field of Classification Search
CPC ..... B65H 37/04; B65H 2801/24; B65H 2801/27; B65H 2301/1635; B65H 2301/5142; B65H 2301/5161; B65H 2301/51611; B65H 2301/51616; B65H 2301/5162; B65H 2301/43828; G03G 15/6544; G03G 2215/00827; G03G 2215/00848; G03G 2215/00852; G03G 2215/00864
USPC ..... 270/58.08, 58.09
See application file for complete search history.

(56) References Cited

U.S. PATENT DOCUMENTS

| | | | | |
|---|---|---|---|---|
| 10,926,970 | B2 * | 2/2021 | Tanoue | B31F 5/02 |
| 10,954,093 | B2 * | 3/2021 | Susaki | B65H 37/04 |
| 11,021,342 | B2 * | 6/2021 | Fukuhara | B42C 1/12 |
| 11,981,529 | B2 * | 5/2024 | Tsuruoka | G03G 15/6538 |
| 12,043,508 | B2 * | 7/2024 | Oikawa | B31F 1/36 |
| 12,337,570 | B2 * | 6/2025 | Saito | H04N 1/00639 |
| 2014/0219747 | A1 | 8/2014 | Takahashi et al. | |
| 2016/0096700 | A1 | 4/2016 | Suzuki | |
| 2018/0079247 | A1 | 3/2018 | Aoyagi et al. | |
| 2018/0339484 | A1 | 11/2018 | Takahashi et al. | |
| 2022/0394145 | A1 | 12/2022 | Seto et al. | |
| 2023/0234322 | A1 | 7/2023 | Fukuchi et al. | |
| 2023/0234804 | A1 | 7/2023 | Suzuki et al. | |
| 2023/0241859 | A1 | 8/2023 | Saito et al. | |
| 2023/0271804 | A1 | 8/2023 | Abe et al. | |
| 2023/0294950 | A1 | 9/2023 | Ibuka et al. | |
| 2023/0399191 | A1 | 12/2023 | Akamatsu et al. | |
| 2023/0416040 | A1 | 12/2023 | Sasaki et al. | |

* cited by examiner

| FIG. 12A |
| --- |
| FIG. 12B |

| | DUAL BINDING | FLAT BINDING | OBLIQUE BINDING |
|---|---|---|---|
| CRIMP BINDING | 3 TIMES | 3 TIMES | 2 TIMES |
| CRIMP BINDING WITH LIQUID APPLICATION | 2 TIMES | 2 TIMES | 1 TIMES |

MEDIUM PROCESSING APPARATUS AND IMAGE FORMING SYSTEM INCORPORATING SAME

CROSS-REFERENCE TO RELATED APPLICATIONS

This patent application is based on and claims priority pursuant to 35 U.S.C. § 119(a) to Japanese Patent Application No. 2023-047025, filed on Mar. 23, 2023, and No. 2024-019667, filed on Feb. 13, 2024, in the Japan Patent Office, the entire disclosure of each of which is hereby incorporated by reference herein.

BACKGROUND

Technical Field

Embodiments of the present disclosure relate to a medium processing apparatus and an image forming system incorporating the medium processing apparatus.

Background Art

A medium processing apparatus is known in the art that performs processing to form a bundle of sheet-shaped media (sheet bundle). Stapling with metal staples is known in the art as a binding process to form the sheet bundle in the medium processing apparatus.

Currently, some medium processing apparatuses are known in the art that perform stapleless binding that binds the sheet-shaped media without metal binding needles (i.e., staples) from a viewpoint of resource saving and reduction in environmental load.

A typical medium processing apparatus that performs the stapleless binding performs so-called "crimp binding" that sandwiches a sheet bundle with serrate crimping teeth to press and deform the sheet bundle. Sheets of paper are widely known as an example of sheet-shaped media. For this reason, in the following description, a bundle of sheets of paper as a plurality of media is an example of a sheet bundle.

In the present specification, the "staple binding" may be referred to as "stapling" and the "stapleless binding" may be referred to as "crimp binding" or "crimping."

In performing the crimp binding known in the art, a driving source to supply liquid to crimping teeth switches a driving direction to switch between crimp binding processes, one crimp binding process in which liquid is supplied to sheets to increase binding strength and the other crimp binding process in which the liquid is not supplied to the sheets.

SUMMARY

Advantageously, the medium processing apparatus includes a liquid applier, a post-processing device, and circuitry. The liquid applier applies liquid on at least one medium. The post-processing device performs a combination of various types of post-processes including a liquid application crimp binding and a crimp binding and a various types of bindings including a dual binding, a parallel binding, and an oblique binding, on a bundle of media including the at least one medium for a number of times. The circuitry is to change the number of times of the post-process according to the combination of the various types of the post processes and the various types of bindings, to be performed.

Further, embodiments of the present disclosure described herein provide an image forming system including the above-described medium processing apparatus.

BRIEF DESCRIPTION OF THE SEVERAL VIEWS OF THE DRAWINGS

A more complete appreciation of embodiments of the present disclosure and many of the attendant advantages and features thereof can be readily obtained and understood from the following detailed description with reference to the accompanying drawings, wherein.

Figure 1:
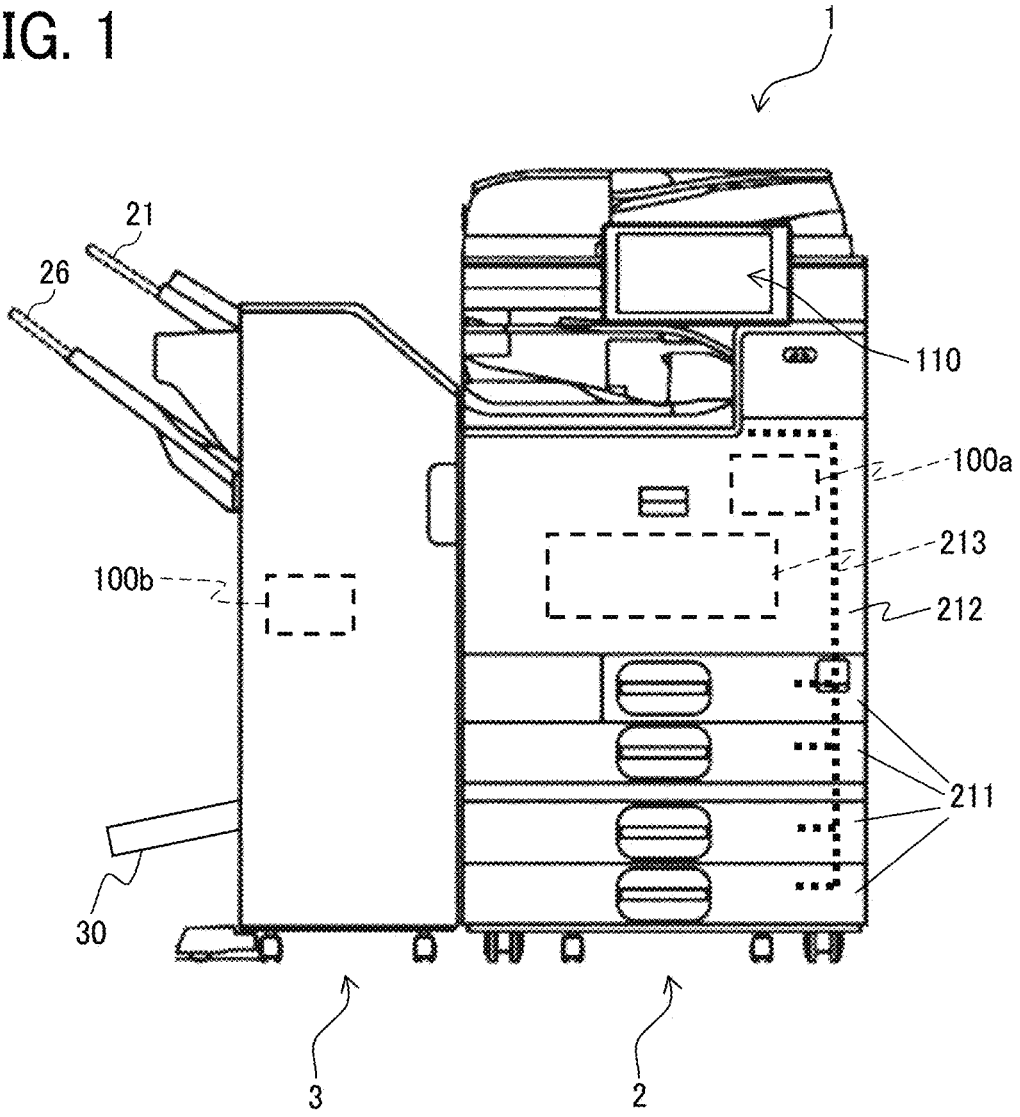
FIG. 1 is a diagram illustrating an overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given of an image forming system 1 according to an embodiment of the present disclosure, with reference to the drawings.

FIG. 1 is a diagram illustrating an overall configuration of the image forming system 1.

The image forming system 1 has the function of forming an image on a sheet P as a sheet medium and a function of performing a post-processing operation on the sheet P as a process after the image is formed on the sheet P. As illustrated in FIG. 1, the image forming system 1 includes an image forming apparatus 2 including the image forming function and a post-processing apparatus 3 serving as a medium processing apparatus including the post-processing function, according to an embodiment of the present disclosure. In the image forming system 1, the image forming apparatus 2 and the post-processing apparatus 3 operate in conjunction with each other.

In the present embodiment, the sheet-like medium to be processed in the image forming system 1 is described on the assumption that the medium is a sheet of "paper." The object to be processed according to the present embodiment is not limited to a paper. For example, any material or specification may be used as long as an image can be formed on a medium in a known image forming process and the medium is a target of the image forming process. The medium includes a medium which can be an object of the folding process or the binding process, and the material or the specification is not limited.

The image forming apparatus 2 forms an image on the sheet P and ejects the sheet P having the image to the post-processing apparatus 3. The image forming apparatus 2 includes an accommodation tray 211 that accommodates the sheet P, a conveyor 212 that conveys the sheet P accommodated in the accommodation tray 211, and an image former 213 that forms an image on the sheet P conveyed by the conveyor 212. The image former 213 may be an inkjet system that forms an image using ink or an electrophotographic system that forms an image using toner. The image forming apparatus 2 also includes a controller 100*a* that controls various operations of the conveyor 212 and the image former 213. Since the image forming apparatus 2 of FIG. 1 has a known configuration, a detailed description of the configuration and functions of the image forming apparatus 2 is omitted.

Sheets of paper are widely known as an example of sheet-shaped media. Further, in the following description, a sheet-shaped medium as a medium to be processed is referred to as a "sheet P." Further, in the following description, a bundle of sheets of paper as a plurality of media is an example of a "sheet bundle Pb."

A description is given of the post-processing apparatus 3 according to a first embodiment of the present disclosure.

Figure 2:
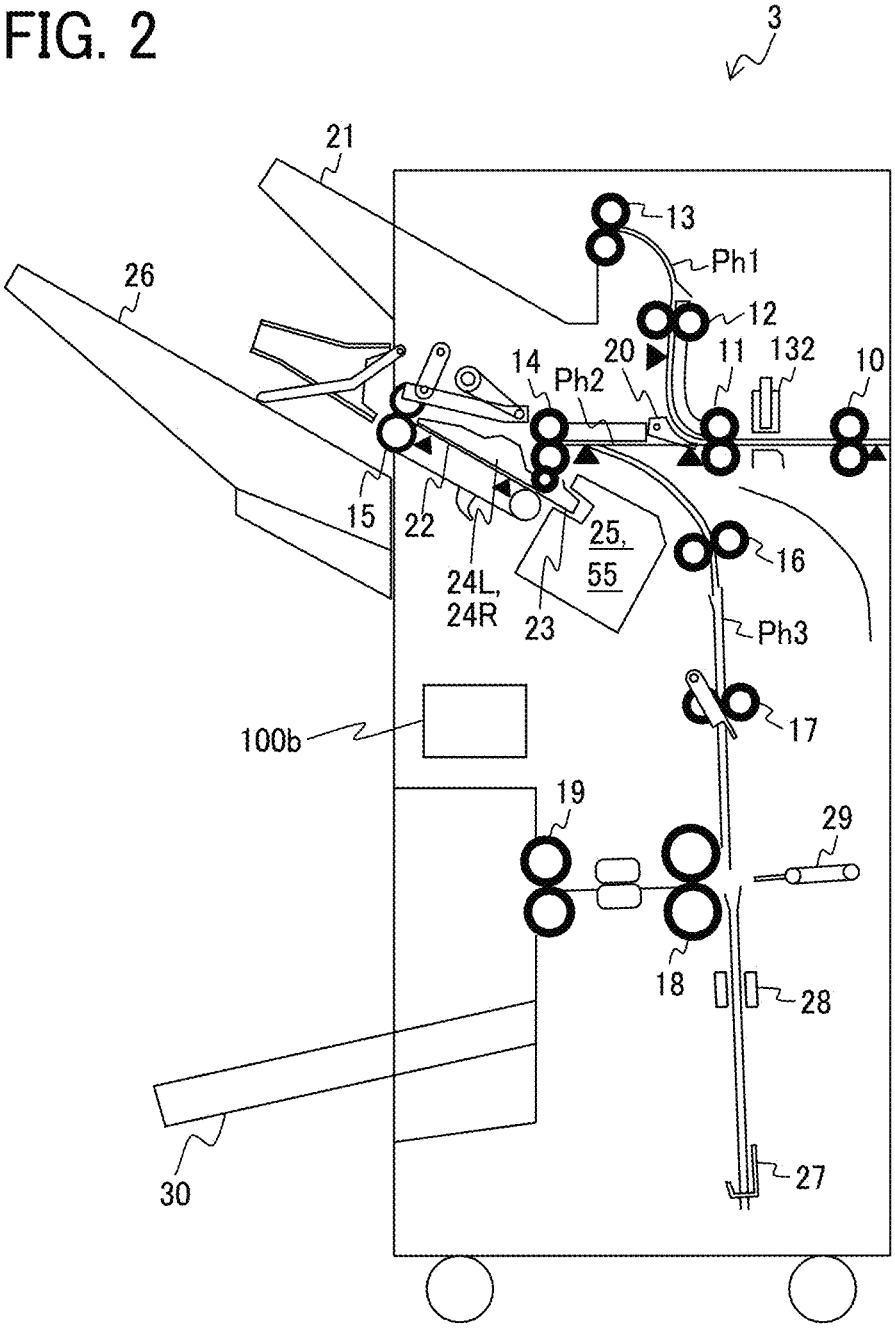
FIG. 2 is a diagram illustrating an internal configuration of a post-processing apparatus according to a first embodiment of the present disclosure.

FIG. 2 is a diagram illustrating an internal configuration of the post-processing apparatus 3 according to the first embodiment of the present disclosure.

The post-processing apparatus 3 has a function that performs given post-processing on the sheet P on which an image is formed by the image forming apparatus 2.

An example of the post-processing according to the present embodiment is a binding process as a "crimp binding process" that binds, without staples, a plurality of sheets P on each of which an image is formed as a bundle of sheets P, which may be referred to as a sheet bundle. Another example of the post-processing according to the present embodiment is a binding process as a "stapling process" that binds, with staples, a plurality of the sheets P on each of which an image is formed as a bundle of sheets P (i.e., sheet bundle). In the following description, the bundle of sheets P may be referred to as a "sheet bundle Pb" as a bundle of media.

In the present embodiment, a description is typically given of liquid application in a crimp binding process. However, the liquid application related to a stapling process is similar to the liquid application in the crimp binding process. In the following description, the term "binding process" indicates both the "crimp binding process" and the "stapling process", and is not limited to a binding method (whether a binding needle is used or pressure deformation is performed).

More specifically, the "crimp binding process" according to the present embodiment is a process called "crimp binding" to apply pressure to a part of the sheet bundle Pb at the binding position to deform (perform pressure deformation on) at the part at the binding position and bind the sheet bundle Pb. The binding that can be executed by the post-processing apparatus 3 includes edge binding and saddle binding. The edge binding is a process to bind an end (including an edge) of the sheet bundle Pb. The saddle binding is a process to bind the center of the sheet bundle Pb.

The post-processing apparatus 3 includes the conveyance roller pairs 10 to 19, each functioning as a conveyor, the switching member 20, and a controller 100*b* serving as a controller. The controller 100*b* controls the operations of, for example, the conveyance roller pairs 10 to 19 (conveyors), and the switching member 20. Details of the controller 100*b* will be described below. The conveyance roller pairs 10 to 19 convey, inside the post-processing apparatus 3, the sheet P supplied from the image forming apparatus 2. More specifically, the conveyance roller pairs 10 to 13 convey the sheet P along a first conveyance passage Ph1. The conveyance roller pairs 14 and 15 convey the sheet P along a second conveyance passage Ph2. The conveyance roller pairs 16 to 19 convey the sheet P along a third conveyance passage Ph3. A hole punch 132 is disposed between the conveyance roller pairs 10 and 11. The hole punch 132 performs punching on a sheet P conveyed by the conveyance roller pairs 10 and 11.

The first conveyance passage Ph1 is a passage extending to a first ejection tray 21 from a supply port through which the sheet P is supplied from the image forming apparatus 2. The second conveyance passage Ph2 is a passage branching from the first conveyance passage Ph1 between the conveyance roller pairs 11 and 14 in a conveyance direction and extending to a second ejection tray 26 via an internal tray 22. The third conveyance passage Ph3 is a passage that branches off from the first conveyance passage Ph1 between the conveyance roller pairs 11 and 14 in the conveyance direction and reaches a third ejection tray 30.

The switching member 20 serving as a switcher is disposed at a branching position of the first conveyance passage Ph1 and the second conveyance passage Ph2.

The switching member 20 can change the position between a first position and a second position. The switching member 20 at the first position guides the sheet P to be ejected to the first ejection tray 21 through the first conveyance passage Ph1. The switching member 20 at the second position guides the sheet P conveyed through the first conveyance passage Ph1 to the second conveyance passage Ph2. When a trailing end of the sheet P entering the second conveyance passage Ph2 passes through the conveyance roller pair 11, the conveyance roller pair 14 is rotated in reverse to guide the sheet P to the third conveyance passage Ph3. The post-processing apparatus 3 further includes multiple sensors that detect the positions of the sheet P in the first conveyance passage Ph1, the second conveyance passage Ph2, and the third conveyance passage Ph3. The sensors are indicated by black triangles in FIG. 2.

The post-processing apparatus 3 further includes the first ejection tray 21. The sheet P that is ejected through the first conveyance passage Ph1 rests on the first ejection tray 21. Among the sheets P supplied from the image forming apparatus 2, a sheet P not subjected to the binding process is ejected to the first ejection tray 21.

The post-processing apparatus 3 further includes the internal tray 22 serving as a placement tray, an edge-binding end fence 23, side fences 24L and 24R, an edge binder 25, a staple binder 55, and the second ejection tray 26. The internal tray 22, the edge-binding end fence 23, the side fences 24L and 24R, the edge binder 25, and the staple binder 55 perform edge binding on the sheet bundle Pb including the multiple sheets P conveyed from the second conveyance path Ph2 to the internal tray 22. Among the sheets P supplied from the image forming apparatus 2, the sheet bundle Pb subjected to the edge binding is ejected to the second ejection tray 26.

The "edge binding process" includes "parallel binding process," "oblique binding process," and "vertical binding process." The parallel binding process is a process of binding the sheet bundle Pb along one side of the sheet bundle Pb parallel to the main scanning direction. The oblique binding process is a process of binding a corner of the sheet bundle Pb. The vertical binding process is a process of binding the sheet bundle Pb at multiple positions spaced apart from each other in the width direction along one side of the sheet bundle Pb parallel to the conveyance direction.

In the following description, a direction in which the sheet P is conveyed from the conveyance roller pair 15 toward the edge-binding end fence 23 is defined as a "conveyance direction." In other words, the "conveyance direction" herein corresponds to a direction in which the sheet P that has been output from the image forming apparatus 2 is moved toward the second ejection tray 26 by, for example, the conveyance roller pair 10, and is changed to move toward the edge-binding end fence 23 by the conveyance roller pair 15 in a direction different from the above-described direction. The direction that is orthogonal to the conveyance direction and the thickness direction of the sheet P is defined as the "main scanning direction" or the "width direction of the sheet P."

The sheets P that are sequentially conveyed through the second conveyance passage Ph2 are temporarily placed on the internal tray 22 serving as the placement tray. The edge-binding end fence 23 aligns the position, in the conveyance direction, of the sheet P or the sheet bundle Pb placed on the internal tray 22. The side fences 24L and 24R align the position, in the main scanning direction, of the sheet P or the sheet bundle Pb placed on the internal tray 22. The edge binder 25 and the staple binder 55 bind an end of the sheet bundle Pb aligned by the edge-binding end fence 23 and the side fences 24L and 24R. Then, the conveyance roller pair 15 ejects the sheet bundle Pb subjected to the edge binding to the second ejection tray 26.

The post-processing apparatus 3 further includes a center-fold binding end fence 27, a saddle binder 28, a sheet folding blade 29, and the third ejection tray 30. The center-fold binding end fence 27, the saddle binder 28, and the sheet folding blade 29 perform saddle binding on a sheet bundle Pb constructed of the sheets P that are conveyed through the third conveyance passage Ph3. Among the sheets P supplied from the image forming apparatus 2, the sheet bundle Pb subjected to the saddle binding is ejected to the third ejection tray 30.

The center-fold binding end fence 27 aligns the positions of the sheets P that are sequentially conveyed through the third conveyance passage Ph3, in a conveyance direction in which the sheets P are conveyed. The center-fold binding end fence 27 can move between a binding position where the center-fold binding end fence 27 causes the center of the sheet bundle Pb to face the saddle binder 28 and a folding position where the center-fold binding end fence 27 causes the center of the sheet bundle Pb to face the sheet folding blade 29. The saddle binder 28 binds the center of the sheet bundle Pb aligned by the center-fold binding end fence 27 at the binding position. The sheet folding blade 29 folds, in half, the sheet bundle Pb placed on the center-fold binding end fence 27 at the folding position and causes the conveyance roller pair 18 to nip the sheet bundle Pb. The conveyance roller pairs 18 and 19 eject the sheet bundle Pb subjected to the saddle binding to the third ejection tray 30.

A detailed description is given of the edge binder 25 according to an embodiment of the present disclosure.

Figure 3:
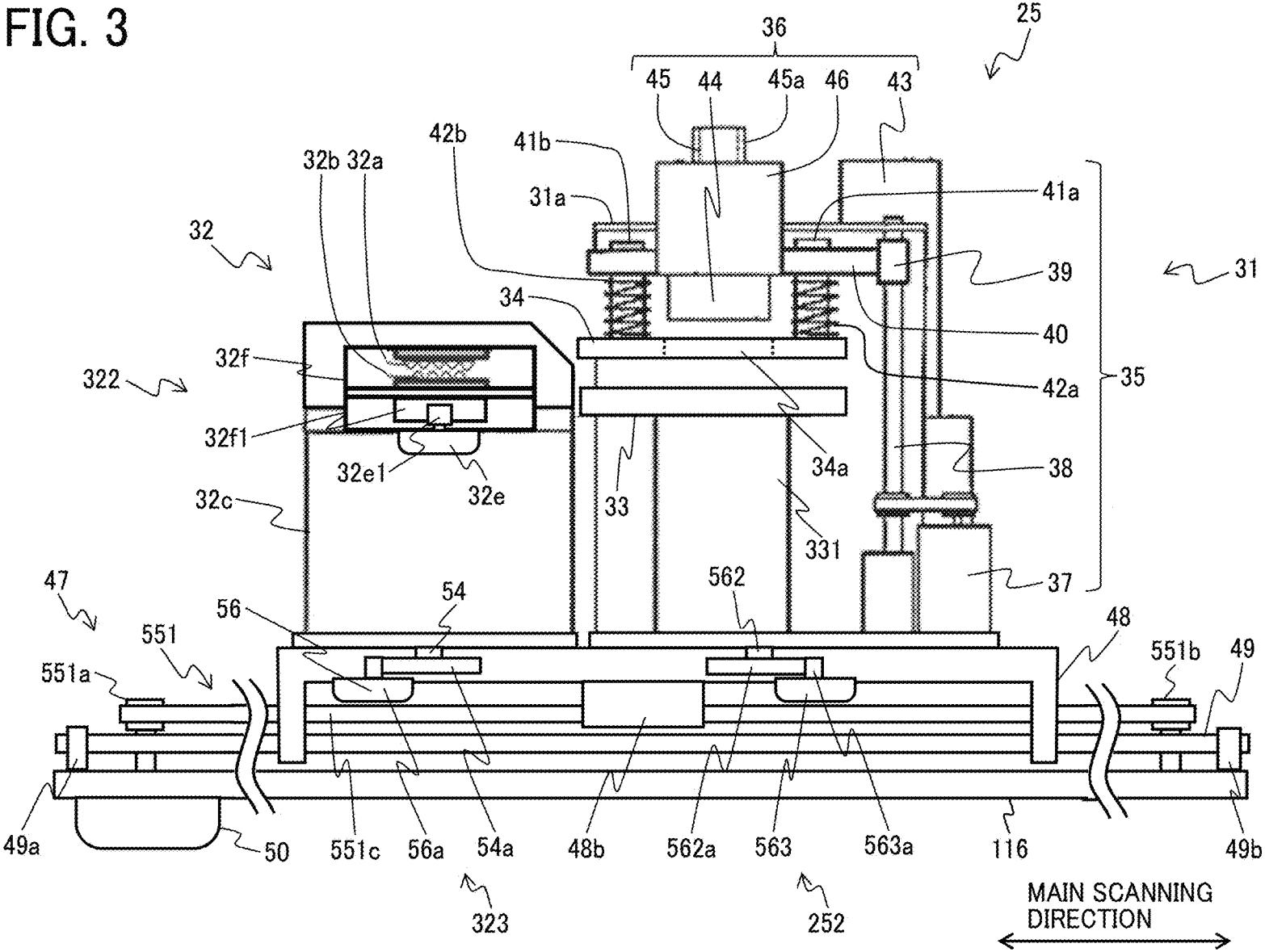
FIG. 3 is a schematic diagram illustrating the upstream side of an edge binder of the post-processing apparatus of FIG. 2 viewed in a conveyance direction.

FIG. 3 is a schematic diagram illustrating the upstream side of the edge binder 25 viewed in the conveyance direction.

The edge binder 25 performs liquid application and crimp binding illustrated in FIG. 2.

Figure 4:
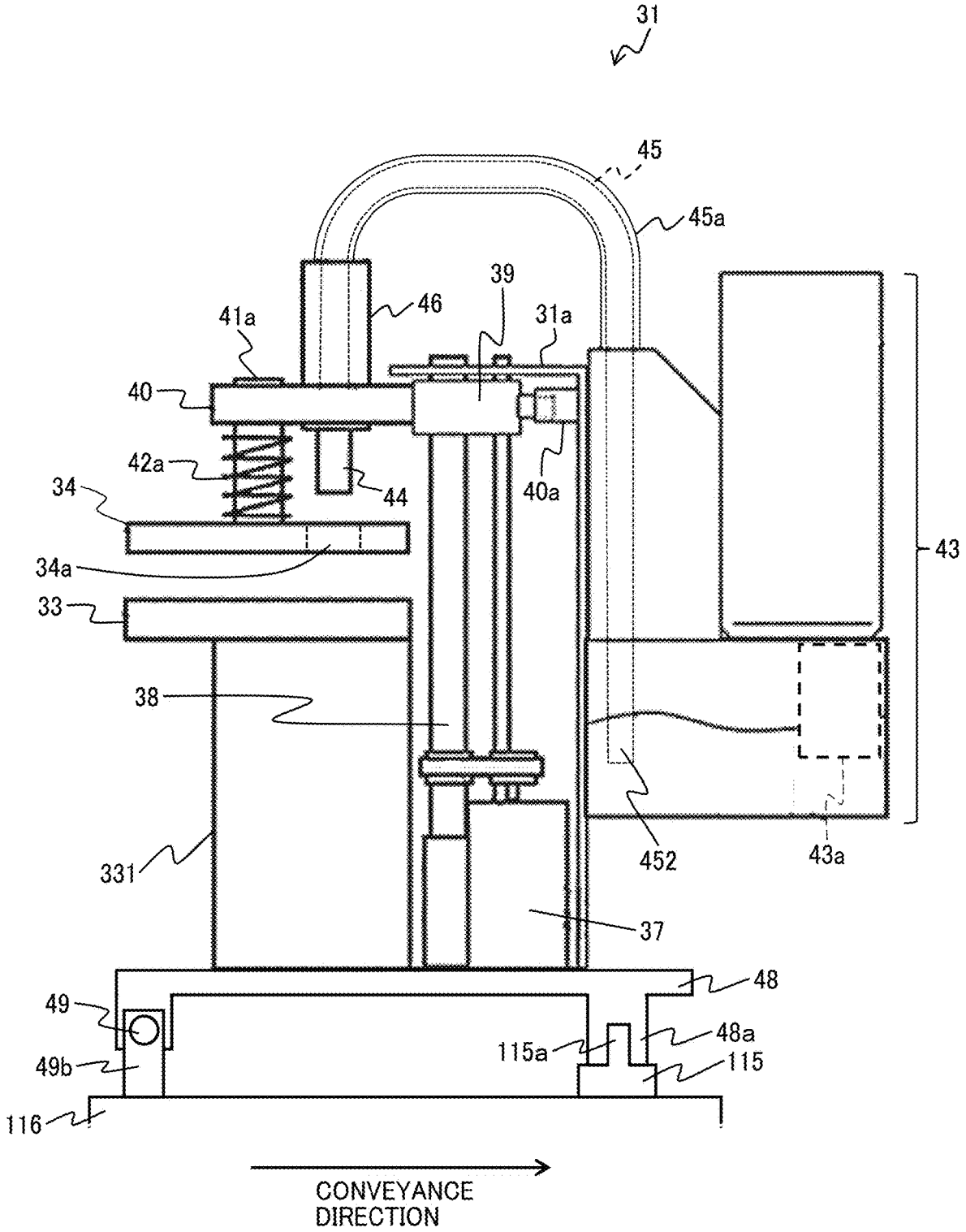
FIG. 4 is a schematic diagram illustrating a liquid applier of the edge binder of FIG. 3 viewed in a main scanning direction.

FIG. 4 is a schematic diagram illustrating a liquid applier 31 of the edge binder 25 when viewed from the main scanning direction.

As illustrated in FIGS. 3 and 4, the edge binder 25 includes a liquid applier 31 that applies liquid to the sheets P, and a crimper 32 that is an example of a post-processing device and performs crimp binding on the sheet bundle Pb. The liquid applier 31 and the crimper 32 are disposed downstream from the internal tray 22 in the conveyance direction and adjacent to each other in the main scanning direction.

As illustrated in FIG. 4, the liquid applier 31 as a liquid applier applies the liquid stored in the first liquid storage tank 43 as a liquid storage to the sheet P or the sheet bundle Pb placed on the internal tray 22. Applying liquid to a sheet P or a sheet bundle Pb by the liquid applier 31 and the operation of the liquid applier 31 when applying liquid are referred to as "liquid application". The liquid application operation of the liquid applier 31 accompanied by the control process is referred to as a "liquid application process."

More specifically, the liquid that is stored in the first liquid storage tank 43 as liquid for the "liquid application" includes, as a main component, the liquid state of a compound of hydrogen and oxygen compound represented by the chemical formula $H_2O$. The liquid hydrogen-oxygen compound is at any temperature. For example, the liquid hydrogen-oxygen compound may be so-called warm water or hot water. The liquid hydrogen-oxygen compound is not limited to pure water. The liquid hydrogen-oxygen compound may be purified water or may contain ionized salts. The metal ion content ranges from so-called soft water to ultrahard water. In other words, the liquid hydrogen-oxygen compound is at any hardness.

The liquid that is stored in the first liquid storage tank 43 may include an additive in addition to the main component. The liquid that is stored in the first liquid storage tank 43 may include residual chlorine used as tap water. Preferably, for example, the liquid that is stored in the first liquid storage tank 43 may include, as an additive, a colorant, a penetrant, a pH adjuster, a preservative such as phenoxyethanol, a drying inhibitor such as glycerin, or a combination thereof. Furthermore, because water is used as a component of ink used for inkjet printers or ink used for water-based pens, such water or ink may be used for the "liquid application."

The water is not limited to the specific examples described above. The water may be water in a broad sense such as hypochlorous acid water or an ethanol aqueous solution diluted for disinfection. However, tap water may be used simply to enhance the binding strength after the binding process because tap water is easy to obtain and store. A liquid including water as a main component as exemplified above enhances the binding strength of the sheet bundle Pb, in comparison with a liquid of which the main component is not water.

As illustrated in FIGS. 3 and 4, the liquid applier 31 can be moved in the main scanning direction together with the crimper 32 by the driving force transmitted from the edge binder movement motor 50.

The liquid applier 31 includes a lower pressure plate 33 serving as a receptacle for the sheet P or the sheet bundle Pb, an upper pressure plate 34, a liquid applier movement assembly 35, and a liquid application assembly 36. The components of the liquid applier 31 (the lower pressure plate 33, the upper pressure plate 34, the liquid applier movement assembly 35, the liquid application assembly 36, and the liquid applier movement motor 37) are held by the liquid application frame 31*a* and the base 48.

As illustrated in FIG. 3, the liquid applier 31 includes a liquid applier pivot assembly 252. The liquid applier pivot assembly 252 includes a liquid applier pivot motor 563, an output gear 563*a*, and a drive transmission gear 562*a*. A liquid applier shaft 562 including a drive transmission gear 562*a* is fixed to the bottom face of the liquid application frame 31*a* that holds the components of the liquid applier 31. The liquid applier shaft 562 and the drive transmission gear 562*a* are held by the base 48 on which the liquid application frame 31*a* is disposed, so as to be rotatable in the forward and reverse directions.

The drive transmission gear 562*a* meshes with the output gear 563*a* of the liquid applier pivot motor 563. The liquid applier 31 can be rotated in the forward and reverse directions about the liquid applier shaft 562 on the base 48 by a driving force transmitted from the liquid applier pivot motor 563 to the liquid applier shaft 562 via the output gear 563*a* and the drive transmission gear 562*a*.

The lower pressure plate 33 and the upper pressure plate 34 are disposed downstream from the internal tray 22 in the conveyance direction. The sheets P or the sheet bundle Pb that is placed on the internal tray 22 is also placed on the lower pressure plate 33. The lower pressure plate 33 is provided on a lower pressure plate holder 331. The upper pressure plate 34 is movable in the thickness direction of the sheet P or the sheet bundle Pb at a position where the upper pressure plate 34 faces the sheet P or the sheet bundle Pb placed on the internal tray 22.

In other words, the lower pressure plate 33 and the upper pressure plate 34 are disposed to face each other in the thickness direction of the sheet P or the sheet bundle Pb with the sheet P or the sheet bundle Pb placed on the internal tray 22 and interposed between the lower pressure plate 33 and the upper pressure plate 34. In the following description, the thickness direction of the sheet P or the sheet bundle Pb may be referred to simply as "thickness direction." The upper pressure plate 34 has a through hole 34*a* penetrating in the thickness direction at a position where the through hole 34*a* faces a liquid application member 44 held via a joint 46 attached to a base plate 40. The liquid application member 44 is one end portion of a liquid supply member 45 (liquid absorber) described below and corresponds to a tip portion of the liquid supply member 45.

The liquid applier movement assembly 35 moves the upper pressure plate 34, the base plate 40, a joint 46, and the liquid application member 44 in the thickness direction of the sheet P or the sheet bundle Pb. The liquid applier movement assembly 35 according to the present embodiment moves the upper pressure plate 34, the base plate 40, the joint 46, and the liquid application member 44 in conjunction with each other with a single liquid applier movement motor 37. The liquid applier movement assembly 35 includes, for example, the liquid applier movement motor 37, a trapezoidal screw 38, a nut 39, the base plate 40, columns 41*a* and 41*b*, and coil springs 42*a* and 42*b*.

The liquid applier movement motor 37 generates driving force to move the upper pressure plate 34, the base plate 40, the joint 46, and the liquid application member 44. The trapezoidal screw 38 extends in the thickness direction of the sheet P or the sheet bundle Pb and is provided with the liquid application frame 31*a* such that the trapezoidal screw 38 is rotatable in the forward and reverse directions. The trapezoidal screw 38 is coupled to an output shaft of the liquid applier movement motor 37 via, for example, a pulley and a belt. The nut 39 is screwed to the trapezoidal screw 38. The trapezoidal screw 38 is rotated in the forward and reverse directions by the driving force transmitted from the liquid applier movement motor 37. The rotation of the trapezoidal screw 38 causes the nut 39 to reciprocate on the trapezoidal screw 38.

The base plate 40 is positioned apart from the upper pressure plate 34. The base plate 40 holds the liquid application member 44 with the tip portion of the liquid application member 44 protruding from the base plate 40 toward the upper pressure plate 34. The base plate 40 is coupled to the trapezoidal screw 38 via the nut 39 such that base plate 40 can reciprocate along the trapezoidal screw 38 as the trapezoidal screw 38 rotates in the forward and reverse directions. The position of the base plate 40 in the vertical direction is detected by a movement sensor 40*a* (see FIG. 11).

The columns 41*a* and 41*b* project from the base plate 40 toward the upper pressure plate 34 around the tip portion of the liquid application member 44. The columns 41*a* and 41*b* can relatively move with respect to the base plate 40 in the thickness direction. The columns 41*a* and 41*b* hold the upper pressure plate 34 with the respective tip ends closer to the lower pressure plate 33 than the other ends of the columns 41*a* and 41*b*. The other ends of the columns 41*a* and 41*b* opposite the ends closer to the lower pressure plate 33 are provided with stoppers that prevent the columns 41*a* and 41*b* from being removed from the base plate 40.

The coil springs 42*a* and 42*b* are fitted around the columns 41*a* and 41*b*, respectively, between the base plate 40 and the upper pressure plate 34. The coil springs 42*a* and 42*b* bias the upper pressure plate 34 and the columns 41*a* and 41*b* toward the lower pressure plate 33 with respect to the base plate 40.

The liquid application assembly 36 applies liquid to the sheet P or the sheet bundle Pb placed on the internal tray 22. Specifically, the liquid application assembly 36 brings the liquid application member 44 into contact with the sheet P or the sheet bundle Pb to apply the liquid to at least one sheet P of the sheet bundle Pb.

The liquid application assembly 36 includes the liquid application member 44, the liquid supply member 45, the first liquid storage tank 43, and the joint 46.

The first liquid storage tank 43 stores the liquid to be supplied to the sheet P or the sheet bundle Pb. The liquid stored in the first liquid storage tank 43 is detected by a liquid level sensor 43*a* serving as a first liquid detector.

The liquid application member 44 applies the liquid stored in the first liquid storage tank 43 to the sheet P or the sheet bundle Pb. The liquid application member 44 is held by the base plate 40 with the tip portion of the liquid application member 44 facing the upper pressure plate 34.

Further, the liquid application member 44 includes a material having a relatively high liquid absorption. For example, the liquid application member 44 includes an open-cell foam that can contain liquid. The liquid application member 44 is not limited to a particular kind as long as the liquid application member 44 is made of a material having the property of absorbing and holding the liquid and has the property of being crushable in accordance with a pressing force applied when the liquid application member 44 is in contact with the sheet P. The pressing force corresponds to the amount of movement of the liquid application member 44 to the sheet P (or the sheet bundle Pb). For example, the liquid application member 44 may be a foam material such as a sponge or a fiber material that can absorb liquid by capillary action.

The liquid supply member 45 (liquid absorber) is an elongated member having an immersion portion 452 at a base end (proximal end) immersed in the liquid stored in the first liquid storage tank 43 and a tip end (distal end) coupled to the liquid application member 44. Like the liquid application member 44, for example, the liquid supply member 45 is made of a material having a relatively high liquid absorption. As a result, the liquid absorbed from the immersion portion 452 of the liquid supply member 45 is supplied to the liquid application member 44 by the capillary action. In other words, the liquid stored in the first liquid storage tank 43 is sucked up from the immersion portion 452 of the liquid supply member 45, and the sucked liquid is supplied to the liquid application member 44 that is coupled to the tip portion via the liquid supply member 45.

As described above, the liquid sucked up from the immersion portion 452 of the liquid supply member 45 is supplied to the liquid application member 44 through the liquid supply member 45, and the liquid application member 44 contacts the upper face of an uppermost sheet of the sheets P or the sheet bundle Pb to apply the liquid.

Although the liquid supply member 45 and the liquid application member 44 are separate bodies in the above description, the liquid supply member 45 and the liquid application member 44 may be integrally formed of a material having the same properties (for example, a material having a high liquid absorption rate). In other words, the liquid application member 44 may be part of the liquid supply member 45. In such a case, liquid can be supplied from the liquid supply member 45 to the liquid application member 44 more smoothly by the capillary action, and a reduction in cost can be achieved.

A protector 45*a* is an elongated cylindrical body (e.g., a tube) that is fitted around the liquid supply member 45. Such a configuration prevents the liquid absorbed by the liquid supply member 45 from leaking or evaporating. Each of the liquid supply member 45 and the protector 45*a* is made of a flexible material. The joint 46 holds the liquid application member 44 and is disposed on the base plate 40. Accordingly, even when the liquid application member 44 is moved by the liquid applier movement assembly 35 in a direction orthogonal to the conveyance direction and the main scanning direction, the liquid application member 44 keeps projecting from the base plate 40 toward the upper pressure plate 34 with the tip portion of the liquid application member 44 facing the upper pressure plate 34.

In the liquid application process, the controller 100*b* controls the amount of movement (pressing amount) of the liquid application member 44 to the sheet P or the sheet bundle Pb by controlling the amount of driving force of the liquid applier movement motor 37. Controlling the amount of movement of the liquid application member 44 relative to the sheet P or the sheet bundle Pb adjusts the size of the area (contact area) where the liquid application member 44 contacts the sheet P or the sheet bundle Pb or the contact time (contact time). The above-described adjustment enables adjusting the amount of liquid applied to the sheet P or the sheet bundle Pb in the liquid application process and the spread of the liquid.

A description is given of the configuration of the crimper 32.

The crimper 32 serving as a post-processing device presses and deforms a portion of the sheet bundle Pb by serrated upper crimping teeth 32*a* and lower crimping teeth 32*b* to crimp the sheets P at the portion of the sheet bundle Pb to bind the sheet bundle Pb. In other words, the crimper 32 can bind the sheet bundle Pb without staples. The components of the crimper 32 such as the upper crimping teeth 32*a* and the lower crimping teeth 32*b* are disposed on a crimping frame 32*c*. In the following description, such a way of pressing and deforming a given position on the sheet bundle Pb to bind the sheet bundle Pb may be referred to as "crimp binding." In other words, the crimper 32 crimps and binds the sheet bundle Pb or performs the crimp binding on the sheet bundle Pb. The crimp binding operation of the crimper 32 that involves control processing is referred to as a "crimp binding process."

Figure 5A:
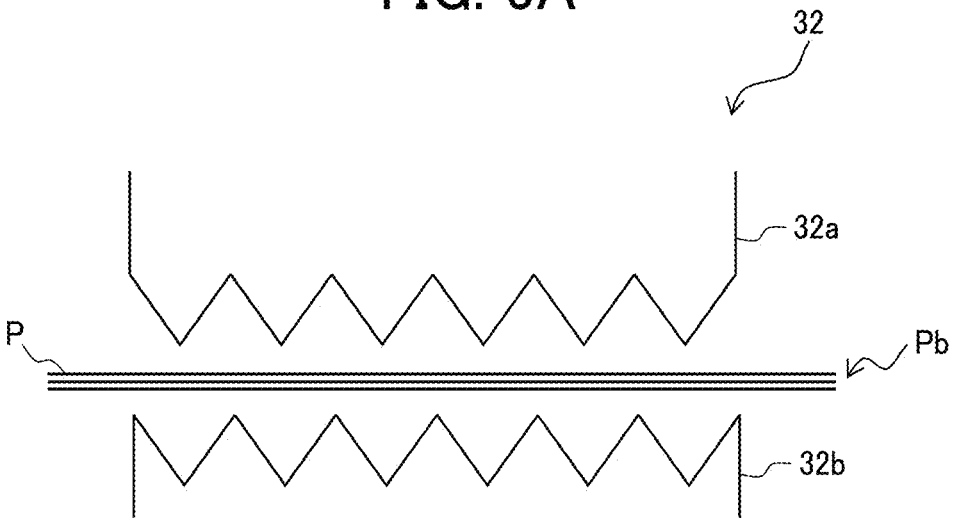
FIGS. 5A and 5B are schematic diagrams each illustrating a configuration of a crimper of the edge binder of FIG. 3.
Figure 5B:
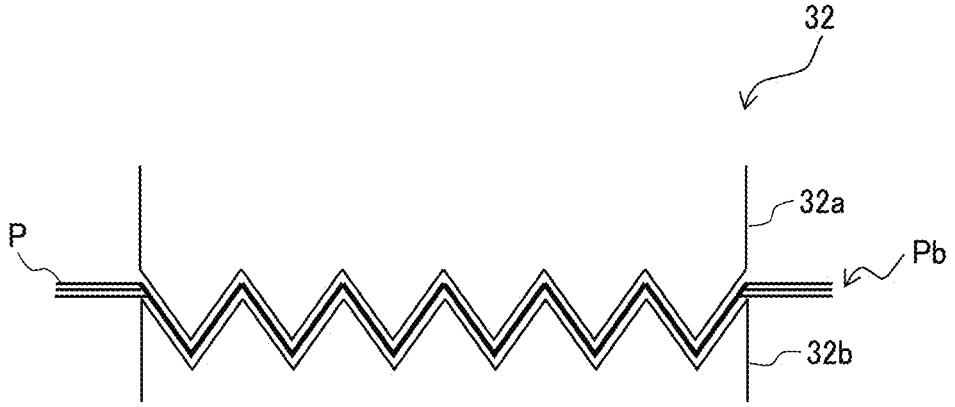

FIGS. 5A and 5B are schematic diagrams illustrating the configuration of the crimper 32.

As illustrated in FIGS. 5A and 5B, the crimper 32 includes the upper crimping teeth 32*a* and the lower crimping teeth 32*b*. The upper crimping teeth 32*a* and the lower crimping teeth 32*b* are disposed to face each other in the thickness direction of the sheet bundle Pb to sandwich the sheet bundle Pb placed on the internal tray 22. The upper crimping teeth 32*a* and the lower crimping teeth 32*b* have respective serrate faces facing each other. The serrate face of each of the upper crimping teeth 32*a* and the lower crimping teeth 32*b* includes concave portions and convex portions alternately formed. The concave portions and the convex portions of the upper crimping teeth 32*a* are shifted from those of the lower crimping teeth 32*b* such that the upper crimping teeth 32*a* are engaged with the lower crimping teeth 32*b*. The upper crimping teeth 32*a* and the lower crimping teeth 32*b* are brought into contact with and separated from each other by a driving force of a contact-separation motor 32*d* illustrated in FIG. 11.

In the process of supplying the sheets P of the sheet bundle Pb to the internal tray 22, the upper crimping teeth 32*a* and the lower crimping teeth 32*b* are separated from each other as illustrated in FIG. 5A. When all the sheets P of the sheet bundle Pb are placed on the internal tray 22, the upper crimping teeth 32*a* and the lower crimping teeth 32*b* are engaged with each other as illustrated in FIG. 5B by the driving force of the contact-separation motor 32*d* to press and deform the sheet bundle Pb in the thickness direction. As a result, the sheet bundle Pb that has been placed on the internal tray 22 is crimped and bound. The sheet bundle Pb thus crimped and bound is ejected to the second ejection tray 26 by the conveyance roller pair 15.

The configuration of the crimper 32 as a crimping assembly is not limited to the configuration of a moving assembly exemplified in the present embodiment and may be any other suitable structure in which the upper crimping teeth 32*a* and the lower crimping teeth 32*b* of the crimping assembly engage with each other. For example, the crimping assembly may bring the upper crimping teeth 32*a* and the lower crimping teeth 32*b* into contact with each other and separate the upper crimping teeth 32*a* and the lower crimping teeth 32*b* from each other with a link mechanism and a driving source that simply rotates forward or that rotates forward and backward (e.g., the crimping assembly disclosed in Japanese Patent No. 6057167). Alternatively, the crimping assembly may employ a linear motion system to linearly bring the upper crimping teeth 32*a* and the lower crimping teeth 32*b* into contact with each other and separate the upper crimping teeth 32*a* and the lower crimping teeth 32*b* from each other with a screw assembly that converts the forward and backward rotational motions of a driving source into linear reciprocating motion.

As illustrated in FIG. 3, the crimper 32 includes a crimping teeth slider 322. The crimping teeth slider 322 includes a crimping teeth slider motor 32*e*, a pinion gear 32*e*1, a rack 32*f*1, and a crimping teeth frame 32*f*, which are described below. The upper crimping teeth 32*a* and the lower crimping teeth 32*b* are disposed on the crimping teeth frame 32*f*. The crimping teeth frame 32*f* and the rack 32*f*1 are integrally formed, and the rack 32*f*1 meshes with the pinion gear 32*e*1 described below. The crimping teeth frame 32*f* is attached to the crimping frame 32*c* so as to be movable in the main scanning direction. The crimping teeth slider motor 32*e* generates a driving force to move the crimping teeth frame 32*f* in the main scanning direction. The pinion gear 32*e*1 is disposed on the output-shaft of the crimping teeth slider motor 32*e*. Rotating the crimping teeth slider motor 32*e* in the forward and reverse directions rotates the pinion gear 32*e*1 in the forward and reverse directions. Rotating the pinion gear 32*e*1 rotates in the forward and reverse directions and reciprocates the rack 32*f*1 meshing with the pinion gear 32*e*1 in the main scanning direction with respect to the crimping frame 32*c*. As a result, the crimping teeth frame 32*f* provided integrally with the rack 32*f*1 also reciprocates in the main scanning direction with respect to the crimping frame 32*c*. In other words, rotating the crimping teeth slider motor 32*e* in the forward and reverse directions moves the upper crimping teeth 32*a* and the lower crimping teeth 32*b* provided on the crimping teeth frame 32*f* in the main scanning direction. The above-described configuration enables the upper crimping teeth 32*a* and the lower crimping teeth 32*b* to perform multiple binding operations while shifting the positions in the main scanning direction with respect to the sheet bundle Pb.

In the main scanning direction, the movement amount of the upper crimping teeth 32*a* and the lower crimping teeth 32*b* that configure the crimp assembly is set to be equal to the length of crimping trace formed by the crimp binding operation of the upper crimping teeth 32*a* and the lower crimping teeth 32*b*, and the upper crimping teeth 32*a* and the lower crimping teeth 32*b* perform crimp binding operations before and after the movement in the main scanning direction. For example, when the crimping trace formed by the crimping binding operation performed by the upper crimping teeth 32*a* and the lower crimping teeth 32*b* is 10 mm, setting the movement amount in the main scanning direction to be 10 mm and performing the first crimping binding operation before the movement in the main scanning direction and the second crimping binding operation after the movement in the main scanning direction can form the crimping trace having the length of 20 mm and increase the binding force of the crimper 32 by about two times.

As illustrated in FIG. 3, the crimper 32 includes a crimper pivot assembly 323 (in other words, a post-processing device pivot assembly). The crimper pivot assembly 323 includes a crimper pivot motor 56, an output gear 56*a*, and a drive transmission gear 54*a*, which are described below. A crimper shaft 54 including the drive transmission gear 54*a* is fixed to the bottom of the crimping frame 32*c* holding the components of the crimper 32.

The crimper shaft 54 and the drive transmission gear 54*a* are held by the base 48 on which the crimping frame 32*c* is disposed, so as to be rotatable in the forward and reverse directions. The drive transmission gear 54*a* meshes with the output gear 56*a* of the crimper pivot motor 56. The crimper 32 can be rotated in the forward and reverse directions about the crimper shaft 54 on the base 48 by a driving force transmitted from the crimper pivot motor 56 to the crimper shaft 54 via the output gear 56*a* and the drive transmission gear 54*a*.

As illustrated in FIG. 3, the edge binder 25 includes an edge binder movement assembly 47.

The edge binder movement assembly 47 moves the edge binder 25, specifically, the liquid applier 31 and the crimper 32, in the main scanning direction along a downstream end, in the conveyance direction, of the sheet P placed on the internal tray 22. The edge binder movement assembly 47 includes, for example, the base 48, a guide shaft 49, the edge binder movement motor 50, and a driving force transmission assembly 551 that transmits the driving force of the edge binder movement motor 50 to the base 48, and a standby position sensor 540 (see FIG. 11).

The liquid applier 31 and the crimper 32 are attached to the base 48 so as to be adjacent to each other in the main scanning direction. As illustrated in FIG. 4, the guide shaft 49 is held by multiple guide shaft brackets 49*a* disposed in the main scanning direction at a position on the upstream side of a binding assembly base 116 in the conveyance direction of the sheet P. As illustrated in FIG. 3, the guide shaft 49 extends in the main scanning direction on the binding assembly base 116. A guide rail 115 extends in the main scanning direction and disposed on the downstream side of the binding assembly base 116 in the conveyance direction of the sheet P. As illustrated in FIG. 4, the guide rail 115 includes a fitting target portion 115*a* that fits a fitting portion 48*a* of the base 48 in the main scanning direction. In other words, the base 48 is movably held by the guide shaft 49 and the guide rail 115 in the main scanning direction on the binding assembly base 116.

The edge binder movement motor 50 generates a driving force to move the edge binder 25. The driving force transmission assembly 551 transmits the driving force of the edge binder movement motor 50 to the base 48 via pulleys 551*a* and 551*b*, a timing belt 551*c*, and a fastening portion 48*b* that fastens the base 48 and the timing belt 551*c*. As a result, the liquid applier 31 and the crimper 32 integrated by the base 48 move in the main scanning direction along the guide shaft 49.

The edge binder movement motor 50 according to the present embodiment is, for example, a servo motor that can stop the edge binder 25 at a target position without returning the edge binder 25 to an origin position (for example, a standby position HP described below) every time the edge binder 25 is moved. The target position of the edge binder 25 is the position at which the binding process is performed on the sheet bundle Pb by the crimper 32. The crimper 32 performs the binding processes at multiple positions to form one sheet bundle Pb. In this case, the multiple positions are written as a first binding position B1*a*, a second binding position B2*a*, and the like (see FIGS. 18A to 19, FIGS. 21A to 22, and FIGS. 24A and 25). The details of the binding positions will be described below.

The post-processing apparatus 3 further includes a standby position sensor 540 and an encoder sensor 541. The standby position sensor 540 is, for example, a light-shielding optical sensor (see FIG. 11) to detect that the edge binder 25 has reached a standby position HP (HP means a home position) (see FIG. 15A). The encoder sensor 541 (see FIG. 11) is attached to an output shaft of the edge binder movement motor 50. The controller 100*b*, which will be described below, detects that the edge binder 25 has reached the standby position HP, based on a detection result of the standby position sensor 540. The controller 100*b* also counts pulse signals output from the encoder sensor 541 to ascertain the current position of the edge binder 25 moved from the standby position HP.

However, a specific method of stopping the edge binder 25 at the target position without returning the edge binder 25 to the origin position is not limited to the aforementioned example. As another example, the post-processing apparatus 3 may include a sensor that detects the arrival of the edge binder 25 at a given target position.

The edge binder movement assembly 47 can move the edge binder 25 by the shortest distance between the position at which the liquid applier 31 faces a first liquid application position B1 and the position at which the liquid applier 31 faces a second liquid application position B2 without passing through the standby position HP. The edge binder movement assembly 47 can also move the edge binder 25 by the shortest distance between the position at which the crimper 32 faces the first binding position B1 and the position at which the crimper 32 faces the second binding position B2 without passing through the standby position HP. The edge binder movement assembly 47 can move the edge binder 25 by the shortest distance between the position at which the liquid applier 31 faces a first liquid application position B1 (or a second liquid application position B2) and the position at which the crimper 32 faces the first binding position B1 (or the second binding position B2) without passing through the standby position HP.

In the above description, the edge binder 25 has a configuration of moving along the guide shaft 49 with the crimper 32 and the liquid applier 31 being integrated, the embodiments of the present disclosure are not limited to the above-described configuration. For example, the crimper 32 and the liquid applier 31 may have a configuration of moving separately from each other.

The position (the liquid application position) to which liquid is applied on a sheet P or a sheet bundle Pb by the liquid applier 31 corresponds to the binding position on the sheet bundle Pb to be crimped by the crimper 32. For this reason, in the following description, the first and second liquid application positions and the first and second crimp binding positions are denoted by the same reference signs such as B1 and B2 as described above.

A description is given below of a modification of the edge binder 25 described above.

Specifically, referring now to FIGS. 6 to 8C, a description is given of an edge binder 25' as a modification of the edge binder 25 included in the post-processing apparatus 3. A difference of the edge binder 25' from the edge binder 25 according to the first embodiment is that the liquid applier 31 and the crimper 32 are integrated as a single unit. In the following description, components like those of the edge binder 25 according to the first embodiment are denoted by like reference numerals, and redundant descriptions thereof may be omitted.

Figure 6:
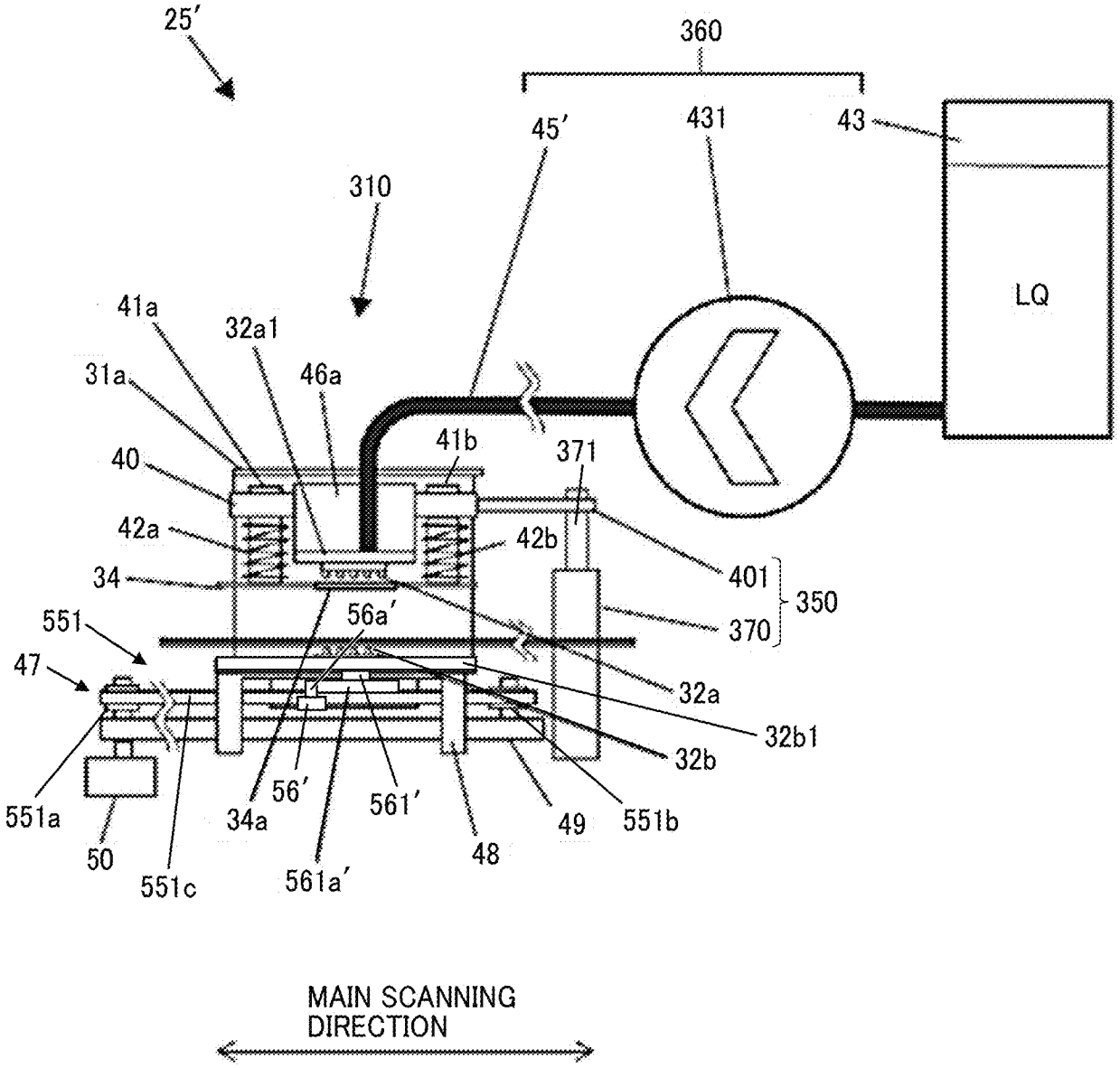
FIG. 6 is a diagram illustrating an edge binder as a modification of the edge binder of FIG. 3.

FIG. 6 is a schematic diagram illustrating the edge binder 25', viewed from the upstream side of the edge binder 25' in the conveyance direction.

Figure 7A:
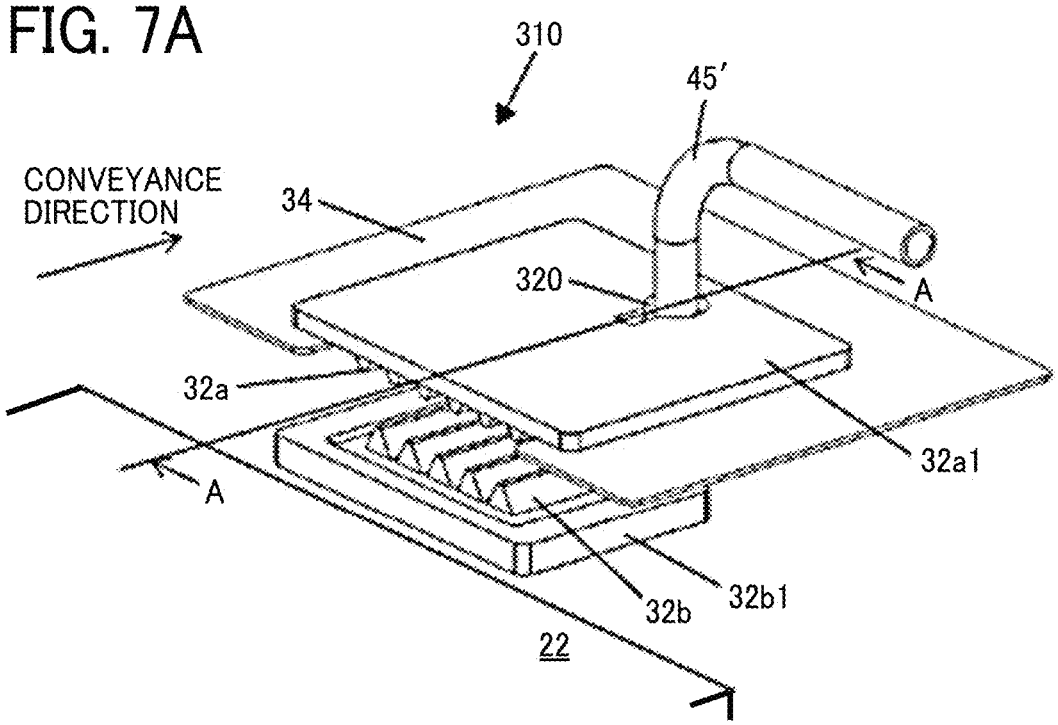
FIGS. 7A, 7B, and 7C are diagrams each illustrating a liquid application crimper of the edge binder of FIG. 6.

FIG. 7A is a perspective view of a liquid application crimper 310.

Figure 7B:
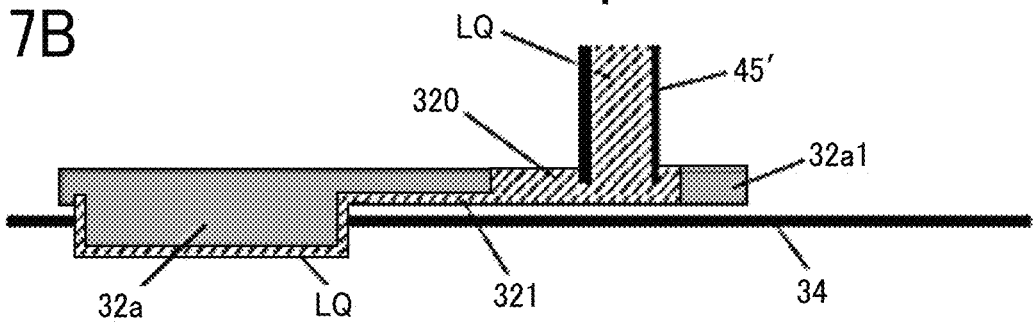

FIG. 7B is a cross-sectional view of the liquid application crimper 310 taken along line A-A in FIG. 7A.

Figure 7C:
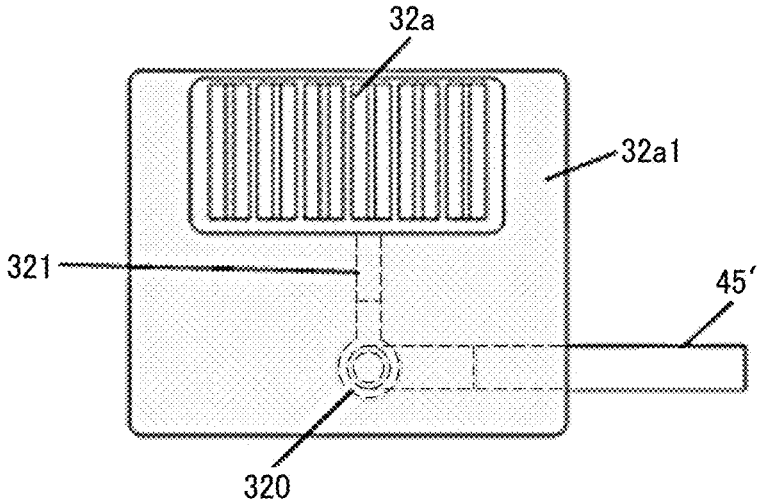

FIG. 7C is a plan view of the upper crimping teeth 32*a* of FIG. 7A as viewed from the lower crimping teeth 32*b*.

Figure 8A:
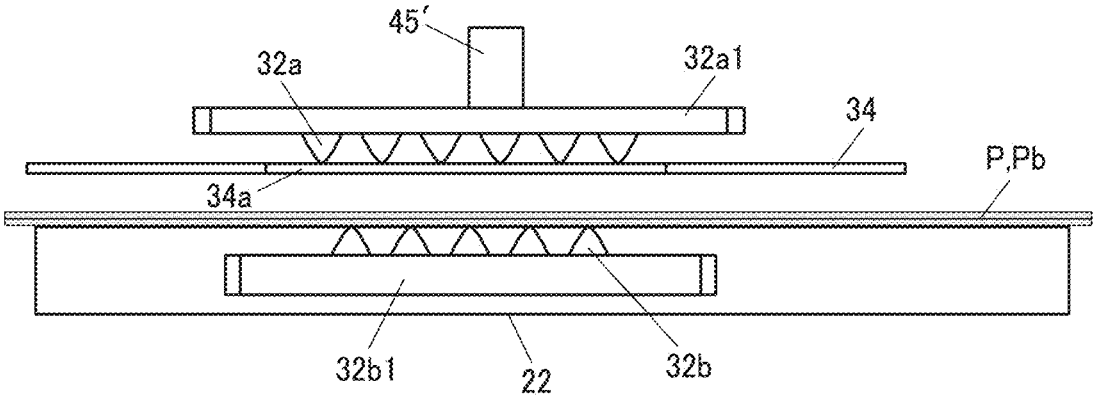
FIGS. 8A, 8B, and 8C are diagrams each illustrating a liquid application operation and a crimp binding operation performed by the liquid application crimper of FIGS. 7A, 7B, and 7C.
Figure 8B:
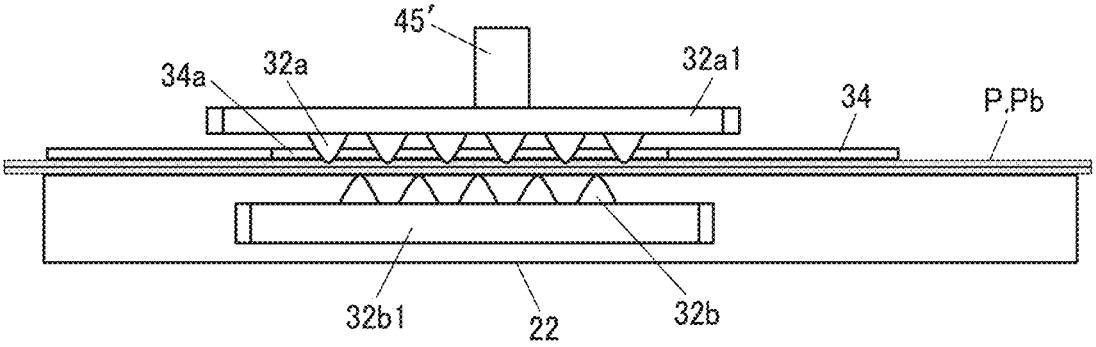
Figure 8C:
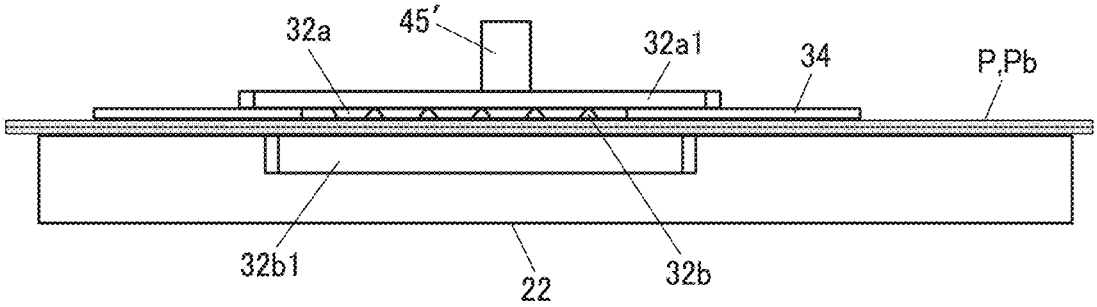

FIGS. 8A to 8C are diagrams illustrating the liquid application crimper 310 performing a liquid application operation and a crimp binding operation viewed from the downstream side in the conveyance direction.

As illustrated in FIG. 6, the edge binder 25' includes the liquid application crimper 310 in which the liquid applier 31 and the crimper 32 (serving as a post-processing device) of the edge binder 25 according to the first embodiment are integrated as a single unit. The liquid application crimper 310 is disposed downstream from the internal tray 22 in the conveyance direction.

The liquid application crimper 310 applies liquid LQ stored in the first liquid storage tank 43 to the sheet P or the sheet bundle Pb placed on the internal tray 22. The liquid application crimper 310 can be moved in the main scanning direction by the driving force that is transmitted from the edge binder movement motor 50 to the base 48 by the driving force transmission assembly 551. The liquid application crimper 310 includes the upper pressure plate 34, the upper crimping teeth 32*a*, the lower crimping teeth 32*b*, a liquid application crimper movement assembly 350, and a liquid supply assembly 360. The components of the liquid application crimper 310 are held by the liquid application frame 31*a* and the base 48.

A liquid application crimper shaft 561' including a drive transmission gear 561*a'* is fixed to the bottom face of the liquid application frame 31*a*. The liquid application crimper shaft 561' and the drive transmission gear 561*a'* are held by the base 48 on which the liquid application frame 31*a* is disposed, so as to be rotatable in the forward and reverse directions. The drive transmission gear 561*a'* meshes with an output gear 56*a'* of a liquid application crimper pivot motor 56'. The liquid application crimper 310 can be rotated in the forward and reverse directions about the liquid application crimper shaft 561' on the base 48 by a driving force transmitted from the liquid application crimper pivot motor 56' to the liquid application crimper shaft 561' via the output gear 56*a'* and the drive transmission gear 561*a'*.

In the liquid application crimper movement assembly 350, an electric cylinder 370 moves the upper pressure plate 34, the base plate 40, and the upper crimping teeth 32*a* in cooperation with each other in the thickness direction of the sheet P or the sheet bundle Pb. The base plate 40 holds the upper crimping teeth 32*a* and an upper crimping teeth holder 32*al* via a holder 46*a*. The base plate 40 movably holds the upper pressure plate 34 via the columns 41*a* and 41*b*. The base plate 40 is attached to the distal end of a rod 371 of the electric cylinder 370 via a connecter 401.

The columns 41*a* and 41*b* have respective lower ends holding the upper pressure plate 34. The coil springs 42*a* and 42*b* are externally inserted into the columns 41*a* and 41*b* between the base plate 40 and the upper pressure plate 34. The coil springs 42*a* and 42*b* bias the upper pressure plate 34 and the columns 41*a* and 41*b* in a direction away from the base plate 40.

The liquid supply assembly 360 includes the first liquid storage tank 43, a liquid supply pump 431, and a liquid supply member 45'. The liquid supply pump 431 supplies the liquid LQ to a liquid reservoir 320 disposed in the upper crimping teeth holder 32*al* as illustrated in FIG. 7A via the liquid supply member 45'. The base end of the liquid supply member 45' is coupled to the liquid supply pump 431, and the tip end of the liquid supply member 45' is coupled to the liquid reservoir 320. The liquid supply member 45' includes a long and elastic member.

As illustrated in FIG. 7B, the upper crimping teeth 32*a* are integrated with the upper crimping teeth holder 32*al*. The upper crimping teeth holder 32*al* includes the liquid reservoir 320 and a liquid supply path 321, and the liquid LQ stored in the liquid reservoir 320 is supplied to the upper crimping teeth 32*a* through the liquid supply path 321. The surface of the upper crimping teeth 32*a* is subjected to a hydrophilic treatment so that the liquid LQ that is supplied through the liquid supply path 321 uniformly spreads over the surfaces of the upper crimping teeth 32*a*. On the other hand, the portions of the upper crimping teeth holder 32*al* other than the upper crimping teeth 32*a* are subjected to a hydrophobic treatment so that the liquid LQ efficiently spreads over the surfaces of the upper crimping teeth 32*a*.

As illustrated in FIG. 6, the lower crimping teeth 32*b* are integrated with a lower crimping teeth holder 32*b*1, which is a part of the liquid application frame 31*a*. The lower crimping teeth 32*b* are attached to the base 48 via the lower crimping teeth holder 32*b*1.

Referring now to FIGS. 8A to 8C, a description is given of the liquid application operation and the crimp binding operation by the liquid application crimper 310. In the process of supplying the sheet P to the internal tray 22, as illustrated in FIG. 8A, the upper crimping teeth 32*a* and the lower crimping teeth 32*b* are separated from each other. When the sheet P is placed on the internal tray 22, the electric cylinder 370 is contracted to move the upper crimping teeth 32*a* and the upper pressure plate 34 toward the sheet P. Then, as illustrated in FIG. 8B, the upper pressure plate 34 first contacts the sheet P, and then the upper crimping teeth 32*a* pass through the through hole 34*a* of the upper pressure plate 34 and contacts the sheet P. At this time, since the liquid LQ has spread over the surface of the upper crimping teeth 32*a*, the liquid is applied from the upper crimping teeth 32*a* in contact with the sheet P to the liquid application position on the sheet P. When liquid application to the liquid application position is completed, the electric cylinder 370 is extended to separate the upper crimping teeth 32*a* and the upper pressure plate 34 from the sheet P. The above-described contact and separation operation (liquid application operation) of the upper crimping teeth 32*a* and the upper pressure plate 34 with respect to the sheets P is repeatedly performed on sheets P of the sheet bundle Pb.

In response to reaching the number of the sheets of the sheet bundle Pb placed on the internal tray 22 to a predetermined number, the electric cylinder 370 is further contracted to move the upper crimping teeth 32*a* toward the lower crimping teeth 32*b*. As illustrated in FIG. 8C, the upper crimping teeth 32*a* further moves toward the lower crimping teeth 32*b* with the sheet bundle Pb sandwiched between the upper crimping teeth 32*a* and the lower crimping teeth 32*b*. Thus, the upper crimping teeth 32*a* and the lower crimping teeth 32*b* press and deform the sheet bundle Pb to crimp and bind the sheet bundle Pb. In short, the crimp binding operation is performed.

A description is given of the staple binder 55.

Details of the staple binder 55 having the function of executing the stapling process are described below.

Figure 9:
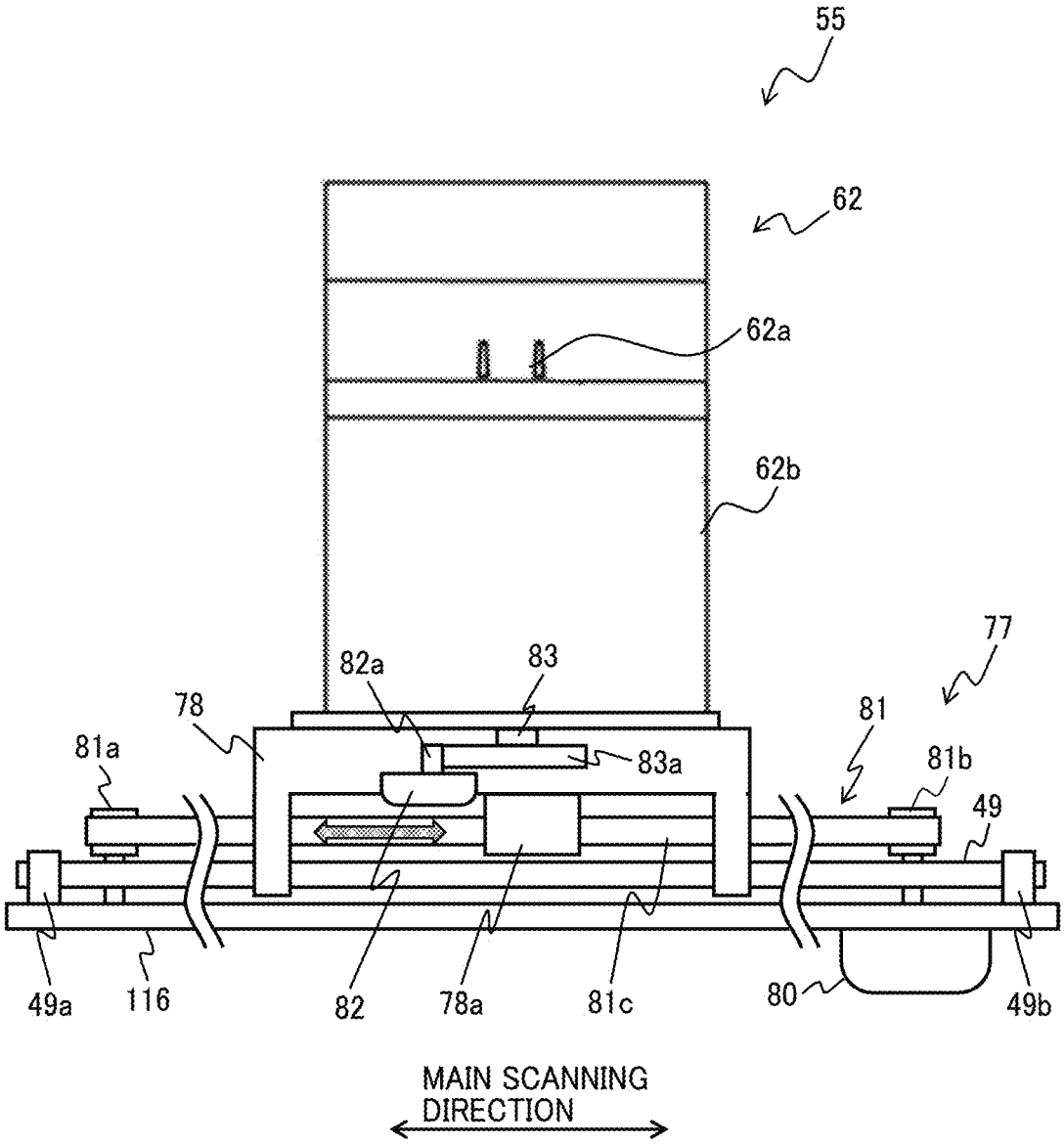
FIG. 9 is a schematic diagram illustrating a staple binder, viewed from the upstream side of the staple binder in the conveyance direction.

FIG. 9 is a schematic diagram illustrating the staple binder 55 viewed from the upstream side in the conveyance direction.

The staple binder 55 includes a stapler 62 that binds the sheet bundle Pb with a staple or staples. The stapler 62 is disposed downstream from the internal tray 22 in the conveyance direction and spaced apart from the edge binder 25 in the main scanning direction.

The stapler 62 serving as a post-processing device has a configuration of performing so-called "staple binding" to bind a sheet bundle Pb with the staple(s). Specifically, the stapler 62 includes a stapler drive motor 62*d* (see FIG. 11) that drives a stapling part 62*a*. The driving force of the stapler drive motor 62*d* causes the staple loaded in the stapling part 62*a* to penetrate through a sheet bundle Pb to bind the sheet bundle Pb. The configuration of the stapler 62 is already known, and thus detailed description thereof will be omitted.

As illustrated in FIG. 9, the staple binder 55 includes a staple binder movement assembly 77.

The staple binder movement assembly 77 moves the staple binder 55 in the main scanning direction along a downstream end in the conveyance direction of the sheet P or the sheet bundle Pb placed on the internal tray 22. The staple binder movement assembly 77 includes, for example, a base 78, the guide shaft 49, a staple binder movement motor 80, and a driving force transmission assembly 81. The driving force transmission assembly 81 transmits a driving force of the staple binder movement motor 80 to the base 78 via pulleys 81*a* and 81*b*, a timing belt 81*c*, and a fastening portion 78*a* that fastens the base 78 and the timing belt 81*c*. A stapler shaft 83 including a drive transmission gear 83*a* is fixed to a bottom face of a stapling frame 62*b* that holds the components of the stapler 62.

The stapler shaft 83 and the drive transmission gear 83*a* are held by the base 78 on which the stapling frame 62*b* is disposed, so as to be rotatable in the forward and reverse directions. The drive transmission gear 83*a* meshes with an output gear 82*a* of a stapler pivot motor 82. The stapler 62 is rotatable in the forward and reverse directions about the stapler shaft 83 on the base 78 by a driving force transmitted from the stapler pivot motor 82 to the stapler shaft 83 via the output gear 82*a* and the drive transmission gear 83*a*.

The edge binder 25 and the staple binder 55 are supported by the common guide shaft 49. In other words, the edge binder movement assembly 47 and the staple binder movement assembly 77 move the edge binder 25 and the staple binder 55 in the main scanning direction along the common guide shaft 49. Further, the edge binder movement assembly 47 and the staple binder movement assembly 77 can move the edge binder 25 and the staple binder 55 separately.

Figure 10:
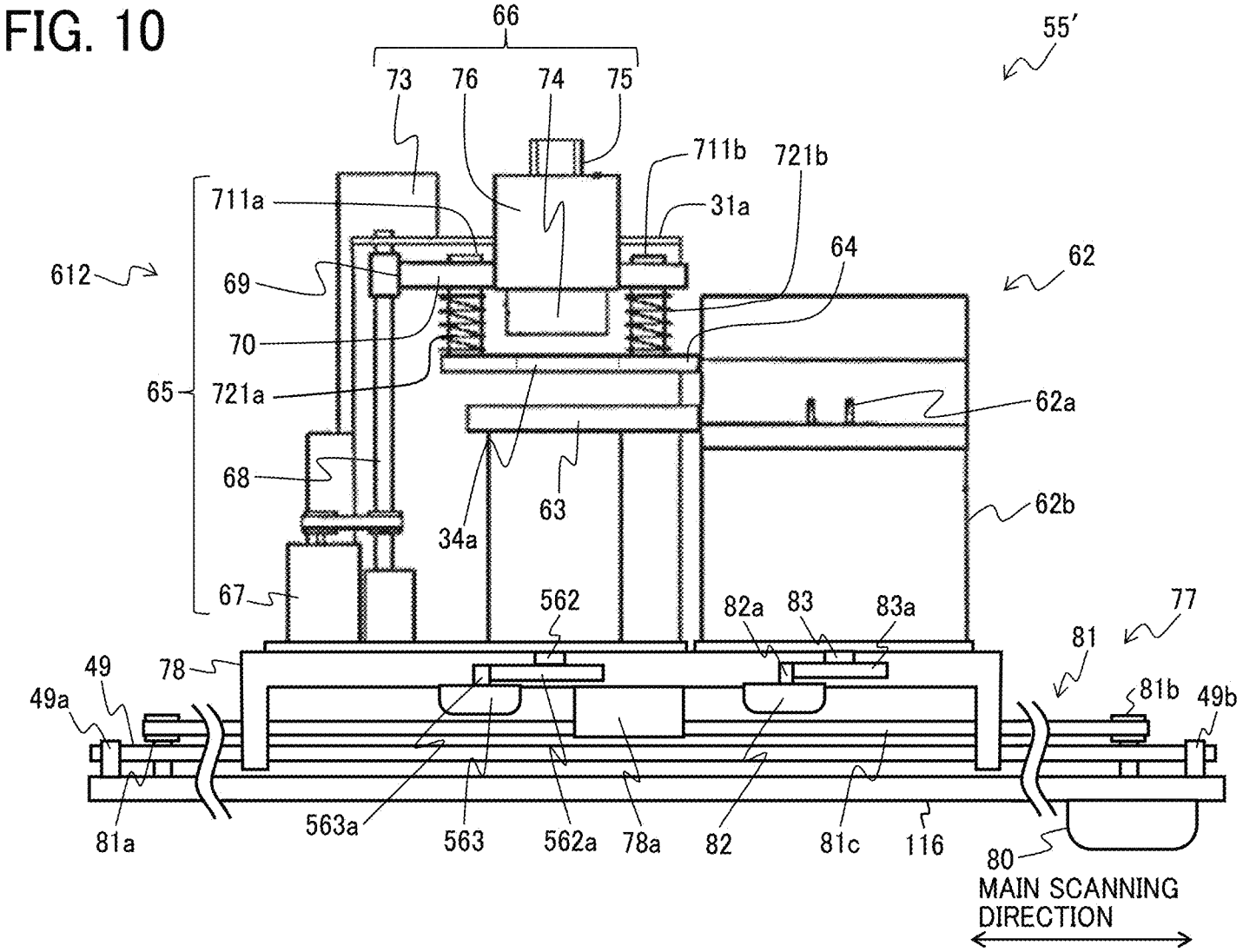
FIG. 10 is a diagram of a schematic configuration of a staple binder according to a modification of the above embodiments of the present disclosure, viewed from the upstream side of the staple binder in the conveyance direction.

FIG. 10 is a schematic diagram of a staple binder 55' as a modification of the staple binder 55, viewed from the upstream side of the staple binder 55' in the conveyance direction. The staple binder 55' is different from the staple binder 55 in that the staple binder 55' includes a second liquid applier 612 in addition to the stapler 62.

As illustrated in FIG. 10, the staple binder 55' includes the second liquid applier 612 and the stapler 62. The second liquid applier 612 and the stapler 62 are disposed adjacent to each other in the main scanning direction on the downstream side of the internal tray 22 in the conveyance direction.

The second liquid applier 612 executes "liquid application" of applying liquid stored in a second liquid storage tank 73 to the sheet P or the sheet bundle Pb placed on the internal tray 22. A given area including a position to which the liquid is applied on the sheet P or the sheet bundle Pb by the second liquid applier 612 corresponds to a binding position to be stapled by the stapler 62. As illustrated in FIG. 10, the second liquid applier 612 includes a second lower pressure plate 63, a second upper pressure plate 64, a second liquid applier movement assembly 65, and a second liquid application assembly 66.

The second liquid applier movement assembly 65 includes, for example, a second liquid applier movement motor 67, a second trapezoidal screw 68, a second nut 69, a second base plate 70, second columns 711*a* and 711*b*, and second coil springs 721*a* and 721*b*. The second liquid application assembly 66 includes the second liquid storage tank 73, a second liquid application member 74, a second liquid supply portion 75, and a second joint 76.

Since the second liquid application assembly 66 and the liquid application assembly 36 of the liquid applier 31 illustrated in FIGS. 3 and 4 have common configurations, redundant descriptions thereof will be omitted unless otherwise required. Since the configuration of the stapler 62 illustrated in FIG. 10 is similar to the configuration of the stapler 62 illustrated in FIG. 9, a detailed description thereof is omitted below unless otherwise required. Since the pivot assembly of the second liquid applier 612 has the same structure as the pivot assembly of the liquid applier 31 illustrated in FIG. 3, redundant descriptions thereof will be omitted unless otherwise required. The pivot assembly of the second liquid applier 612 includes a liquid applier pivot motor 563, an output gear 563*a*, a drive transmission gear 562*a*, and a liquid applier shaft 562.

In the staple binding process, the staple binder 55' illustrated in FIG. 10 performs the liquid application process on the sheet P to loosen and soften a portion of the sheet at the binding position, allowing the staple to easily pass through the sheet bundle Pb. As a result, the number of sheets to be bound per sheet bundle Pb can be increased as compared with a case where the staple binding process is performed without applying the liquid.

A description is given of a control block of the post-processing apparatus 3.

A control block configuration of the post-processing apparatus 3 according to the first embodiment is described with reference to FIG. 11.

Figure 11:
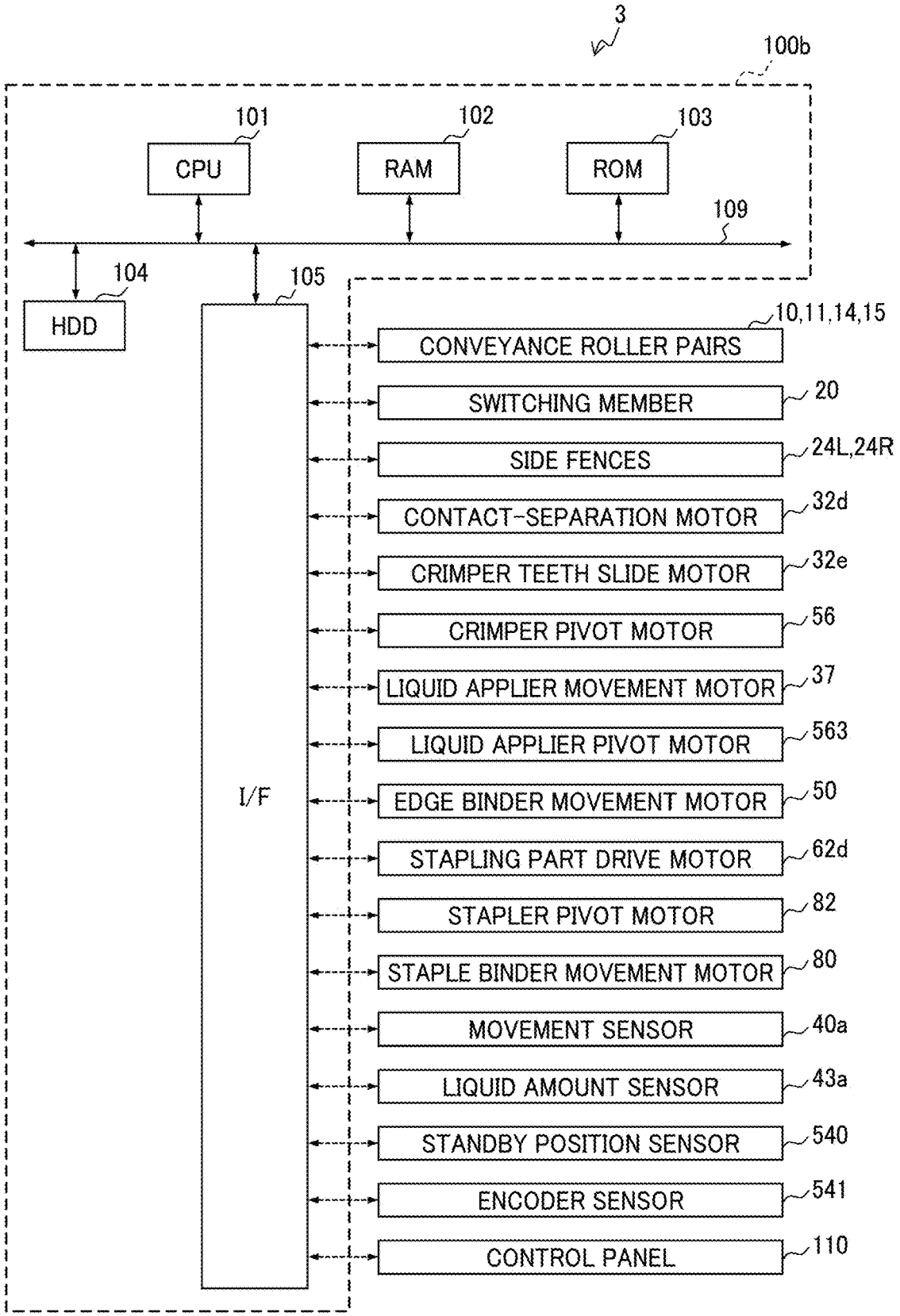
FIG. 11 is a block diagram illustrating a hardware configuration of the post-processing apparatus of FIG. 2 to control the operation of the post-processing apparatus.

FIG. 11 is a block diagram illustrating a hardware configuration for executing control processing in the post-processing apparatus 3.

As illustrated in FIG. 11, the post-processing apparatus 3 includes a central processing unit (CPU) 101, a random-access memory (RAM) 102, a read-only memory (ROM) 103, a hard disk drive (HDD) 104, and an interface (I/F) 105. The CPU 101, the RAM 102, the ROM 103, the HDD 104, and the I/F 105 are connected to each other via a common bus 109.

The CPU 101 is an arithmetic unit and controls the operation of the overall operation of the post-processing apparatus 3.

The RAM 102 is a volatile storage medium that allows data to be read and written at high speed. The CPU 101 uses the RAM 102 as a work area for data processing.

The ROM 103 is a read-only non-volatile storage medium that stores programs such as firmware.

The HDD 104 is a non-volatile storage medium that allows data to be read and written and has a relatively large storage capacity. The HDD 104 stores, for example, an operating system (OS), various control programs, and application programs.

In the post-processing apparatus 3, an arithmetic function of the CPU 101 executes a control program stored in the ROM 103 and an information processing program (or application program) loaded into the RAM 102 from a storage medium such as the HDD 104. Such processing configures a software controller including various functional modules of the post-processing apparatus 3. The software controller that is thus configured cooperates with hardware resources of the post-processing apparatus 3 to construct functional blocks that implement functions of the post-processing apparatus 3. In other words, the CPU 101, the RAM 102, the ROM 103, the HDD 104, and the I/F 105 constitute at least part of the controller 100*b* serving as a control device that controls the operation of the post-processing apparatus 3.

The I/F 105 is an interface that connects the conveyance roller pairs 10, 11, 14, and 15, the switching member 20, the side fences 24L and 24R, the contact-separation motor 32*d*, the crimping teeth slider motor 32*e*, the crimper pivot motor 56, the liquid applier movement motor 37, the liquid applier pivot motor 563, the edge binder movement motor 50, the stapler drive motor 62*d*, the stapler pivot motor 82, the staple binder movement motor 80, the movement sensor 40*a*, the liquid level sensor 43*a*, the standby position sensor 540, the encoder sensor 541, and a control panel 110 to the common bus 109.

The controller 100*b* controls, via the I/F 105, the operations of the conveyance roller pairs 10, 11, 14, and 15, the switching member 20, the side fences 24L and 24R, the contact-separation motor 32*d*, the crimping teeth slider motor 32*e*, the crimper pivot motor 56, the liquid applier movement motor 37, the liquid applier pivot motor 563, the edge binder movement motor 50, the stapler drive motor 62*d*, the stapler pivot motor 82, and the staple binder movement motor 80. The controller 100*b* acquires detection results from the movement sensor 40*a*, the liquid level sensor 43*a*, the standby position sensor 540, and the encoder sensor 541. Although FIG. 11 illustrates the components related to the edge binder 25 and the staple binder 55 that perform the edge binding, the components related to the saddle binder 28 that performs the saddle binding are also controlled by the controller 100*b*.

As illustrated in FIG. 1, the image forming apparatus 2 includes the control panel 110. The control panel 110 includes an operating device that receives instructions input by a user and a display serving as a notifier that notifies the user of information. The operation unit includes, for example, hard keys and a touch panel superimposed on the display. The control panel 110 acquires information from the user through the operation unit and provides the information to the user through the display. A specific example of the notification unit is not limited to the display and may be a light-emitting diode (LED) lamp or a speaker. The post-processing apparatus 3 may include a control panel 110 similar to the above-described control panel 110 of the image forming apparatus 2.

As described above, the post-processing apparatus 3 according to the present embodiment includes the edge binder 25 that can perform the post-processing such as the crimp binding process and the staple binding process after the liquid application process. When the number of sheets P of the sheet bundle Pb is small, the edge binder 25 can also perform the crimp binding process without applying liquid (that is, only the crimper 32 performs the crimp binding process), as in the crimp binding process as known in the art.

In the edge binder 25, the crimping teeth slider 322, the edge binder movement assembly 47, or both can move the liquid applier 31 and the crimper 32 in the main scanning direction. The above-described configuration enables moving the liquid applier 31, the crimper 32, or both in the main scanning direction to change the liquid application position, the binding position, or both and perform multiple crimp binding processes. As a result, the crimp binding processes performed by the upper crimping teeth 32*a* and the lower crimping teeth 32*b* can form crimping traces adjacent to each other to increase the binding strength of the sheet bundle Pb.

The following describes a method to change the number of repetitions of the crimp binding processes on one sheet bundle Pb (hereinafter, referred to as the "number of crimp binding" and methods of the binding processes (the post-processing) according to binding conditions such as the number of sheets P of the sheet bundle Pb to be subjected to the binding process (the post-processing) and the binding posture of the crimper 32 with respect to the sheet bundle Pb.

The following describes a flowchart of a selection process to select a type of binding process as the post-processing.

Figures 12, 12A:
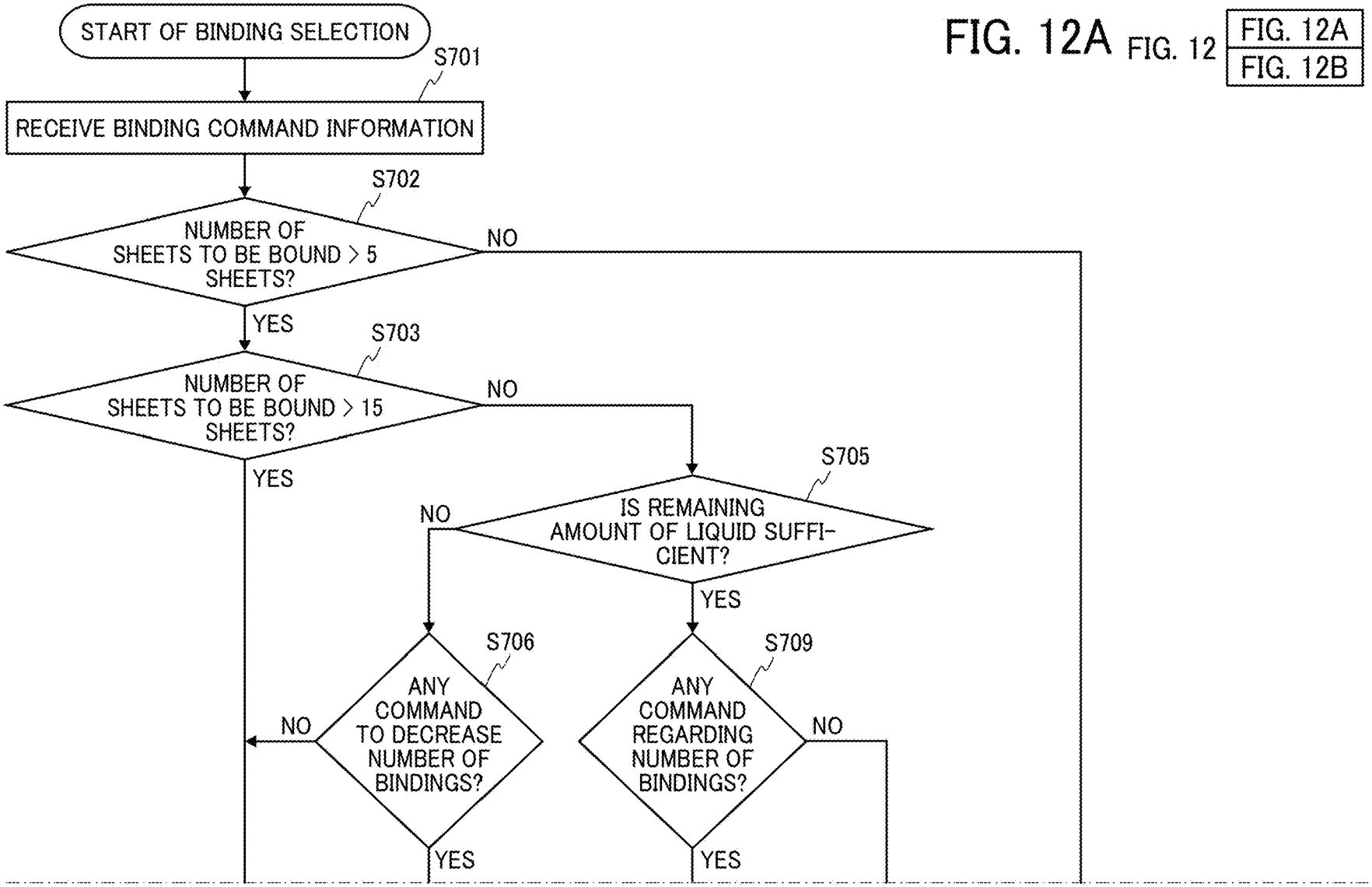
FIG. 12 including
FIGS. 12A and 12B is a flowchart of a selection process to select a type of binding process (post-processing) performed by the edge binder of FIG. 3.
Figure 12B:
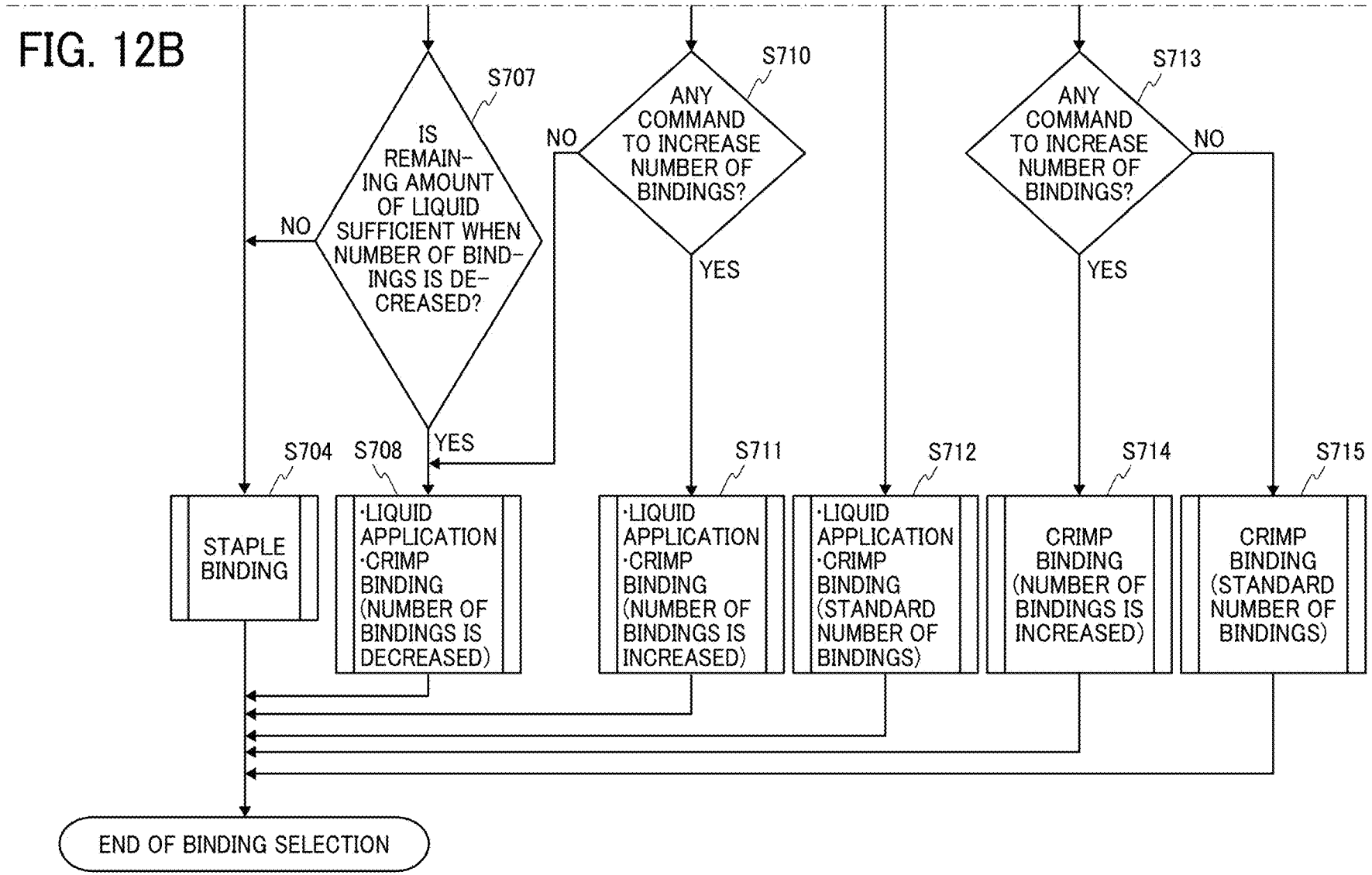

FIG. 12 is the flowchart of the selection process to select the type of binding process (the post-processing) performed by the edge binder 25 and the staple binder 55 in the post-processing apparatus 3 according to the present embodiment.

The controller 100*b* executes a control program controlling the crimping assembly of the post-processing apparatus 3 described above to achieve the binding process (the post-processing) according to the present embodiment.

Binding processes (the post-processing) illustrated in FIG. 12 are selected and executed according to the type of binding mode described below, the number of crimp bindings set for the crimp binding process, and the number of sheets to be bound.

Figure 13:
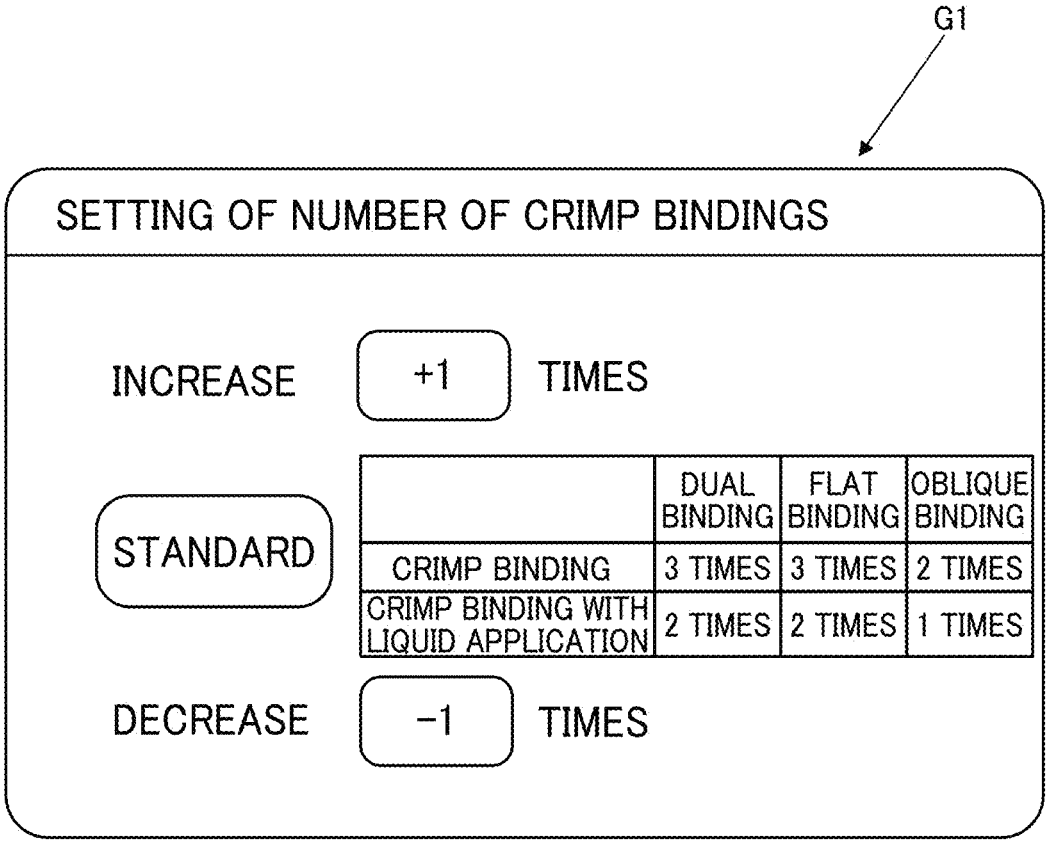
FIG. 13 is a view of an interface to set an increase or decrease in the number of crimp bindings performed by the edge binder of FIG. 3.

FIG. 13 is an example of a setting screen G1 for the user using the post-processing apparatus 3 to set the number of crimp bindings (in other words, the number of times of execution of post-processing) when the post-processing apparatus 3 executes a liquid-application crimp binding or an ordinary crimp binding described below.

Using the setting screen G1 illustrated in FIG. 13, the user can select whether to increase or decrease the number of crimp bindings from an ordinary setting, which is referred to as a "standard number of bindings," when the post-processing apparatus performs the liquid-application crimp binding in which the liquid is applied to the sheets or the ordinary crimp binding in which the liquid is not applied to the sheets. If the user wants to increase the productivity (the number of sheet bundles Pb to be bound per unit time) of the post-processing apparatus 3, the user operates the setting screen G1 and decreases the number of crimp binding.

In contrast, if the user wants to increase the binding strength of the sheet bundle Pb, the user operates the setting screen G1 and increases the number of crimp binding. The setting screen G1 is displayed on the control panel 110 provided for the image forming apparatus 2 and/or the post-processing apparatus 3, and the user can operate the setting screen G1 to set the number of crimp bindings as described above. In addition, the user can operate the setting screen G1 to set the type of binding mode such as "dual binding, "parallel binding," and "oblique binding." The user can operate the setting screen G1 to change the number of crimp bindings (the number of times of execution of post-processing) according to the type of binding mode such as the "dual binding," the "parallel binding," or "oblique binding" and the type of binding process (post-processing) such as the "liquid-application crimp binding" or the "ordinary crimp binding."

The above-described type of binding mode and the above-described type of binding process (post-processing) determines the number of crimp bindings (the number of times of execution of post-processing) for one sheet bundle Pb that is a target of crimp binding process as the post-processing, and such one sheet bundle is referred to as an object unit of binding process. Specifically, as illustrated in FIG. 13, the initial setting value for the number of execution of post-processing (the above-described "standard number of bindings") is determined based on the type of binding mode and the type of binding process (post-processing). For example, when the type of binding process (post-processing) is the "ordinary crimp binding", the initial setting value is set to three times for the dual binding, three times for the parallel edge binding, and two times for the oblique binding for the type of binding mode. When the type of binding process (post-processing) is the "liquid application crimp binding", the initial setting value is set to two times for the dual binding, two times for the parallel edge binding, and once for the oblique binding for the type of binding mode. Accordingly, since the binding force applied to the sheet bundle Pb is greater in the "liquid application crimp binding" than in the "ordinary crimp binding", the initial setting value for the "standard number of bindings" is set to be less in the "liquid application crimp binding." The user sets the number of crimp bindings (the number of times of execution of post-processing) for each object unit of the binding process via the interface of FIG. 13. Thus, the setting of the number of crimp binding (the number of times of execution of post-processing) for each object unit of the binding process is selected. The controller 100*b* changes the number of crimp bindings (the number of times of execution of post-processing) performed by the edge binder 25 according to the number of crimp bindings (the number of times of execution of post-processing) set by the user.

For example, the standard number of bindings when the liquid-application crimp binding is performed is set to twice (which means that liquid application and crimp binding are performed at two positions), and the standard number of ordinary crimp bindings is set to third times (which means that only crimp binding is performed at three positions). Since the binding force of the liquid-application crimp binding is larger than the binding force of the ordinary crimp binding, the liquid-application crimp binding can maintain a sufficient binding force even when the number of crimp bindings is reduced.

In the following description, for example, "a number A of sheets to be bound" means that the number of sheets P of the sheet bundle Pb is set to 15, and the number B of sheet to be bound means that the number of sheet P of the sheet bundle Pb is set to 5. First, the controller 100*b* receives binding command information from the image forming apparatus 2. The binding command information instructs an execution content of the post-processing in the post-processing apparatus 3. The binding command information is included in, for example, the job information that is used to execute image forming processes and is transmitted from the controller 100*a* of the image forming apparatus 2, which serves as an apparatus disposed upstream from the post-processing apparatus 3.

First Example

The controller 100*b* receives the binding command information from the image forming apparatus 2 in step S701, starts a binding process control, and refers to the number of sheets to be bound included in the binding command information. For example, when the binding command information instructs "oblique binding/20 sheets," the controller 100*b* determines whether the number of sheets to be bound, which may be referred to as "the number of sheets instructed to be bound" in the following description, included in the binding command information is larger than five in the first binding number determination step S702. Since the number of sheets instructed to be bound is 20 as described above, the controller 100*b* determines that the number of sheets instructed to be bound is larger than 5 (Yes in step S702) and proceeds to the second binding number determination step S703.

In the second binding number determination step S703, the controller 100*b* determines whether the number of sheets instructed to be bound is larger than 15. Since the number of sheets instructed to be bound is 20 as described above, the controller 100*b* determines that the number of sheets instructed to be bound is larger than 15 (Yes in step S703). Then, the controller 100*b* controls the staple binder 55 to execute the staple binding in step S704.

Second Example

For example, when the binding command information received from the image forming apparatus 2 in the above-described step S701 instructs "dual binding/12 sheets," the controller 100*b* determines whether the number of sheets to be bound included in the binding command information is larger than five in the first binding number determination step S702. Since the number of sheets instructed to be bound is 12 as described above, the controller 100*b* determines that the number of sheets instructed to be bound is larger than 5 (Yes in step S702) and proceeds to the second binding number determination step S703.

In the second binding number determination step S703, the controller 100*b* determines whether the number of sheets instructed to be bound is larger than 15. Since the number of sheets instructed to be bound is 12 as described above, the controller 100*b* determines that the number of sheets instructed to be bound is smaller than 15 (No in step S703) and proceeds to determination processes S705 to S712 for the liquid-application crimp binding. Firstly, the controller 100*b* determines whether the remaining amount of the liquid used for the liquid application by the liquid applier 31 (the remaining amount of the liquid in the first liquid storage tank 43) is sufficient for executing the number of crimp binding included in the binding command information in step S705. Specifically, the controller 100*b* determines the amount of liquid stored in the first liquid storage tank 43 based on the detection result of the liquid level sensor 43*a*. Further, the controller 100*b* determines the amount of liquid for the binding on the number of copies of the sheet bundles PB included in the binding command information, based on the number of the sheet bundles Pb included in the binding command information, the number of sheets P per sheet bundle Pb, the number of crimp bindings per sheet P, and the amount of liquid application per the predetermined number of crimp bindings. The controller 100*b* compares the amount of liquid stored in the first liquid storage tank 43 determined as described above and the amount of liquid for the binding on the requested copies of sheet bundles Pb to determine whether the amount of liquid stored in the first liquid storage tank 43 is sufficient to perform the number of crimp bindings included in the binding command information.

When the controller 100*b* determines that the remaining amount of the liquid in the first liquid storage tank 43 is sufficient for executing the number of crimp binding included in the binding command information (Yes in step S705), the controller 100*b* determines whether any command regarding the number of bindings described above with reference to FIG. 13 is present in step S709. When the controller 100*b* determines that any command regarding the number of bindings is not present (No in step S709), the controller 100*b* controls the liquid applier 31 and the crimper 32 to execute the liquid-application crimp binding with the "standard number of bindings" in step S712. When the controller 100*b* determines that any command regarding the number of bindings is present (Yes in step S709), the controller 100*b* determines whether any command to increase the number of bindings is present in step S710.

When the controller 100*b* determines that any command to increase the number of bindings is present (Yes in step S710), the controller 100*b* controls the liquid applier 31 and the crimper 32 to execute the liquid-application crimp binding with the number of crimp bindings larger than the standard number of bindings in step S711. In contrast, when the controller 100*b* determines that any command to increase the number of bindings is not present (No in step S710), the controller 100*b* controls the liquid applier 31 and the crimper 32 to execute the liquid-application crimp binding with the number of crimp bindings smaller than the standard number of bindings in step S708.

When the controller 100*b* determines that the remaining amount of the liquid in the first liquid storage tank 43 is not sufficient for executing the number of crimp binding included in the binding command information (No in step S705), the controller 100*b* determines whether any command regarding the number of bindings described above with reference to FIG. 13 is any command to decrease the number of bindings in step S706. When the controller 100*b* determines that any command to decrease the number of bindings is present (Yes in step S706), the controller 100*b* determines whether the remaining amount of the liquid in the first liquid storage tank 43 is sufficient for the liquid applier 31 and the crimper 32 to execute the liquid-application crimp binding with the number of crimp bindings smaller than the standard number of bindings in step S707. When the controller 100*b* determines that the remaining amount of the liquid in the first liquid storage tank 43 is sufficient to execute the liquid-application crimp binding (Yes in step S707), the controller 100*b* controls the liquid applier 31 and the crimper 32 to execute the liquid-application crimp binding with the number of crimp bindings smaller than the standard number of bindings in step S708.

In contrast, when the controller 100*b* determines that any command to decrease the number of bindings is not present (No in step S706), the controller 100*b* controls the staple binder 55 to execute the staple binding in step S704. In addition, when the controller 100*b* determines that any command to decrease the number of bindings is present (Yes in step S706) and that the remaining amount of the liquid in the first liquid storage tank 43 is not sufficient to execute the liquid-application crimp binding (No in step S707), the controller 100*b* controls the staple binder 55 to execute the staple binding in step S704.

Third Example

For example, when the binding command information received from the image forming apparatus 2 in step S701 described above instructs "dual binding/4 sheets," the controller 100*b* determines whether the number of sheets to be bound included in the binding command information is larger than five in the first binding number determination step S702. Since the number of sheets instructed to be bound is 4 as described above, the controller 100*b* determines that the number of sheets instructed to be bound is smaller than 5 (No in step S703) and proceeds to determination processes S713 to S715 to determine the type of crimp binding. In this case, the controller 100*b* determines whether any command to increase the number of bindings is present in the binding command information in step S713.

When the controller 100*b* determines that any command to increase the number of bindings is present (Yes in step S713), the controller 100*b* controls the liquid applier 31 and the crimper 32 to execute the liquid-application crimp binding with the number of crimp bindings larger than the standard number of bindings in step S714. In contrast, when the controller 100*b* determines that any command to increase the number of bindings is not present (No in step S713), the controller 100*b* controls the liquid applier 31 and the crimper 32 to execute the liquid-application crimp binding with the number of crimp bindings equal to the standard number of bindings in step S715.

When the standard number of bindings is two, inputting "−1" on the right side of "DECREASE" on the setting screen G1 illustrated in FIG. 13 leads to the number of bindings to be one time. Since the binding strength of the liquid-application crimp binding is larger than the binding strength of the ordinary crimp binding, the liquid-application crimp binding can obtain the substantially same binding strength as the ordinary crimp binding even when the number of crimp bindings in the liquid-application crimp binding is reduced. When further increasing the binding strength is desired, inputting "+1" on the right side of "INCREASE" on the setting screen G1 changes the number of bindings to be three times when the standard number of bindings is two times, which can increase the binding strength of the liquid-application crimp binding. When the standard number of bindings is one time, inputting "−1" on the right side of "DECREASE" on the setting screen G1 leads to the number of bindings to be one time. In other words, inputting a negative number on the right side of "DECREASE" on the setting screen G1 changes the number of bindings only when the result caused by inputting the negative number is larger than 0.

As described above, the post-processing apparatus 3 according to the present embodiment can change the number of crimp bindings (the number of times of execution of post-processing) in accordance with the number of sheets P of the sheet bundle Pb, the binding condition such as the binding posture, and the type of binding (the post-processing) when the liquid-application crimp binding is executed.

In other words, the number of crimp bindings in the present embodiment may be selected and changed from the standard number, the number increased as described above, and the number decreased as described above, and the edge binder 25 can move in a direction orthogonal to the thickness direction of the sheet bundle Pb (that is, the main scanning direction) and perform the one or more binding processes at the one or more binding positions in a binding portion of the sheet bundle Pb in accordance with the number of crimp bindings that is desired and changed as described above. The setting of the number of crimp bindings can be selected according to the number of sheets P of the sheet bundle Pb, the remaining amount of liquid used in the liquid application by the liquid applier 31 (the remaining amount of liquid in the first liquid storage tank 43), and the type of binding (the post-processing). The above-described configuration enables appropriately setting the binding force according to the type of binding (the post-processing) and setting a binding process speed in consideration of the productivity of the binding (the post-processing).

A description is given of binding processes (the post-processing).

The following describes a flow of each of the binding processes that are the staple binding, the liquid-application crimp binding, and the crimp binding that is executed by the edge binder 25 and the staple binder 55 included in the post-processing apparatus 3, and a transition of positions of the edge binder 25 and the staple binder 55. The position (the liquid application position) to which liquid is applied on the sheet P or the sheet bundle Pb by the liquid applier 31 corresponds to the binding portion on the sheet bundle Pb to be crimped by the crimper 32. For this reason, in the following description, the liquid application position and the binding position are denoted by the same reference sign.

The following describes a control flow of the staple binding process.

Figure 14:
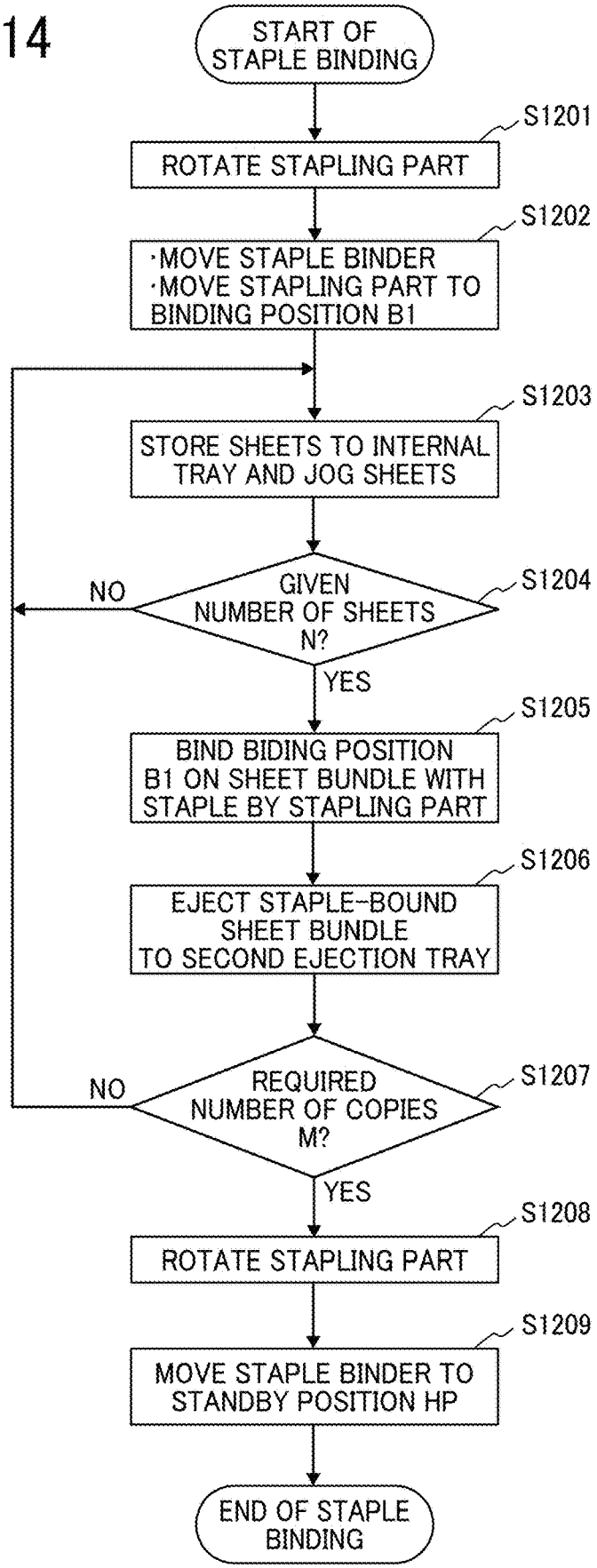
FIG. 14 is a flowchart of a staple binding process performed by the edge binder of FIG. 3.

FIG. 14 is a flowchart of the control of the staple binding process executed in step S704 of FIG. 12.

Figure 15A:
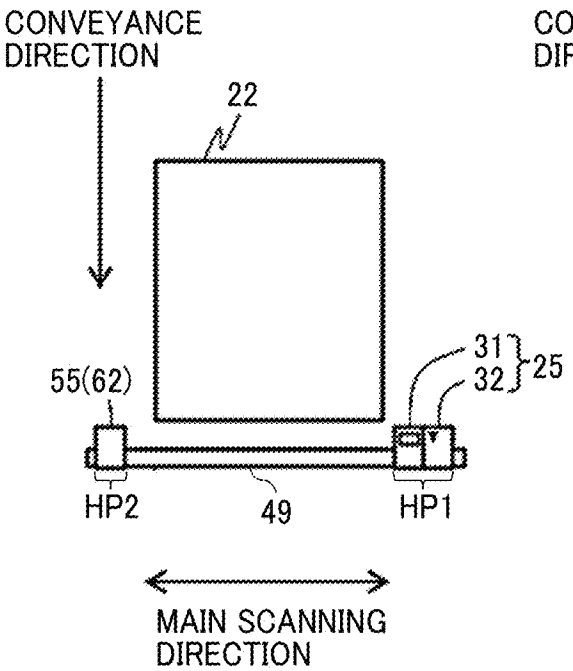
FIGS. 15A, 15B, and 15C are diagrams illustrating positions of an edge binder during the execution of the staple binding process illustrated in FIG. 14.
Figure 15B:
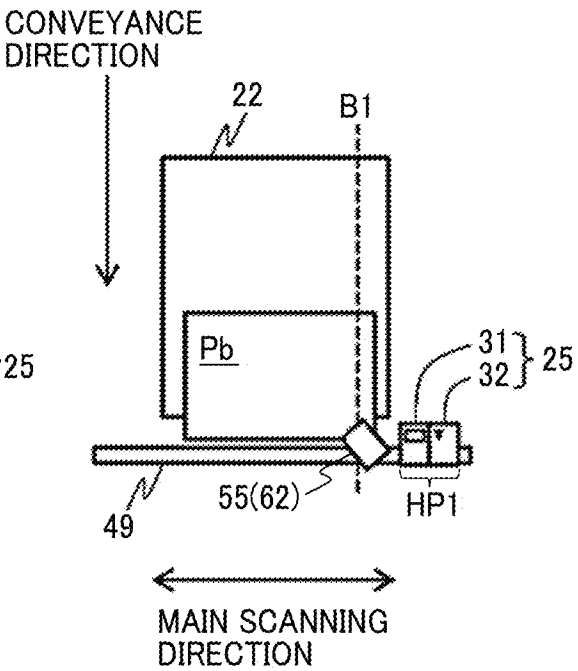
Figure 15C:
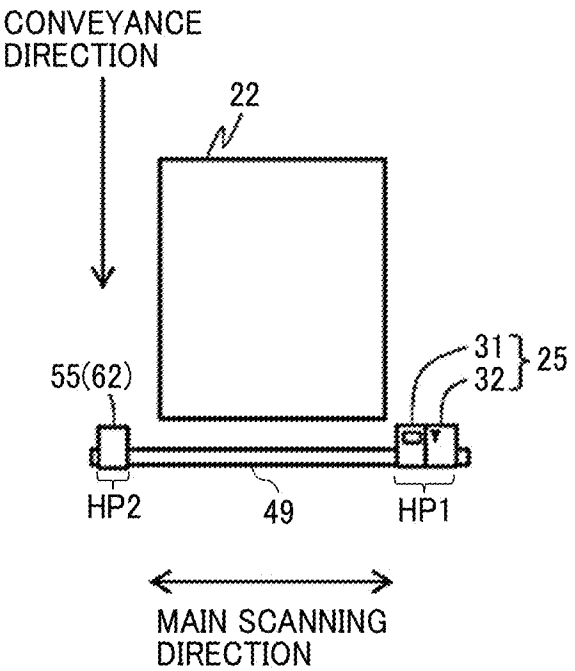

FIGS. 15A, 15B, and 15C are diagrams illustrating the transition of positions of the edge binder 25 and the staple binder 55 during the execution of the staple binding process.

For example, the controller 100*b* starts the staple binding process illustrated in FIG. 14 when the controller 100*b* acquires an instruction to execute the staple binding process from the image forming apparatus 2. In the following description, the instruction to execute the binding process may be referred to as a "binding command."

The binding command includes, for example, the type of the sheet P (i.e., information affecting the spread of liquid, such as material and thickness), the number of sheets P of the sheet bundle Pb, the number of sheet bundles Pb to be bound, the binding portion on the sheet bundle Pb, and the binding posture of the edge binder 25 (the type of binding). In the following description, the number of sheets P of the sheet bundle Pb may be referred to as "given number of sheets N" whereas the number of sheet bundles Pb to be bound may be referred to as "requested number of copies M." Each of the staple binder 55 (the stapler 62) and the edge binder 25 (the liquid applier 31 and the crimper 32) is assumed to be in a parallel binding posture and located at a standby position HP as illustrated in FIG. 15A) at the start of the binding process.

When the posture that is instructed by the binding command is an "oblique binding posture," the controller 100*b* drives the stapler pivot motor 82 to rotate the stapler 62 to the oblique binding posture in step S1201. On the other hand, when the posture that is instructed by the binding command is a "parallel binding posture," the controller 100*b* omits the aforementioned operation of rotating the stapler 62 to the oblique binding posture. As illustrated in FIG. 15B, the controller 100*b* drives the staple binder movement motor 80 to move the staple binder 55 in the main scanning direction so that the stapler 62 (the stapling part 62*a*) faces the first binding position B1 instructed by the binding command in step S1202. The controller 100*b* executes the operation of step S1201, S1202, or S1201 and S1202 before a first sheet P is conveyed to the internal tray 22 by the conveyance roller pairs 10, 11, 14, and 15.

The controller 100*b* rotates the conveyance roller pairs 10, 11, 14, and 15 to store the sheet P, on which the image has been formed by the image forming apparatus 2, onto the internal tray 22 in step S1203. The controller 100*b* moves the side fences 24L and 24R to align the position of the sheet P or the sheet bundle Pb placed on the internal tray 22 in the main scanning direction in step S1203. In short, the controller 100*b* performs so-called jogging.

The controller 100*b* determines whether the number of sheets P placed on the internal tray 22 has reached the given number of sheets N instructed by the binding command in step S1204. When the controller 100*b* determines that the number of sheets P placed on the internal tray 22 has not reached the given number of sheets N (NO in step S1204), the controller 100*b* executes the operation of step S1203 again until the number of sheets P placed on the internal tray 22 reaches the given number of sheets N (YES in step S1204). In other words, the controller 100*b* executes the processing of steps S1203 each time the sheet P is conveyed to the internal tray 22 by the conveyance roller pairs 10, 11, 14, and 15.

When the controller 100*b* determines that the number of sheets P placed on the internal tray 22 has reached the given number of sheets N (Yes in step S1204), in step S1205, the controller 100*b* controls the stapler 62 to execute the staple binding on the sheet bundle Pb placed on the internal tray 22. The controller 100*b* causes the conveyance roller pair 15 to eject the sheet bundle Pb bound by the staple binding performed by the stapler 62 to the second ejection tray 26 in step S1206. Specifically, the controller 100*b* drives the stapler drive motor 62*d* to cause the stapling part 62*a* to perform the staple binding at the first binding position B1 on the sheet bundle Pb placed on the internal tray 22. Then, the controller 100*b* rotates the conveyance roller pair 15 to eject the sheet bundle Pb bound by the staple binding to the second ejection tray 26.

The controller 100*b* determines whether the number of sheet bundles Pb thus ejected to the second ejection tray 26 has reached the requested number of copies M indicated by the binding command in step S1207. When the controller 100*b* determines that the number of sheet bundles Pb thus ejected has not reached the requested number of copies M (NO in step S1207), the controller 100*b* executes the operations of step S1203 and the following steps again. In other words, when the controller 100*b* determines that the number of sheet bundles Pb thus ejected has not reached the requested number of copies M (NO in step S1207), the controller 100*b* repeats the operations of steps S1203 to S1207 until the number of sheet bundles Pb ejected to the second ejection tray 26 reaches the requested number of copies M.

On the other hand, when the controller 100*b* determines that the number of sheet bundles Pb output to the second ejection tray 26 has reached the requested number of copies M (YES in step S1207), the controller 100*b* drives the staple binder movement motor 80 to move the staple binder 55 (the stapler 62) to the standby position HP as illustrated in FIG. 10C in step S1209. When the posture that is instructed by the binding command is the "oblique binding posture," the controller 100*b* drives the stapler pivot motor 82 to rotate the stapler 62 to the parallel binding posture in step S1208 before the staple binder 55 moves the standby position HP. On the other hand, when the posture that is instructed by the binding command is the "parallel binding posture," the controller 100*b* omits the aforementioned operation in step S1208 of rotating the stapler 62 to the parallel binding posture. As a result, the stapler 62 returns to the standby position HP illustrated in FIG. 15C. In steps S1201, S1202, S1208, and S1209, the execution order of the movement in the main scanning direction and the rotation in the forward and reverse directions of the staple binder 55 is not limited to the aforementioned order and may be reversed.

Figure 16:
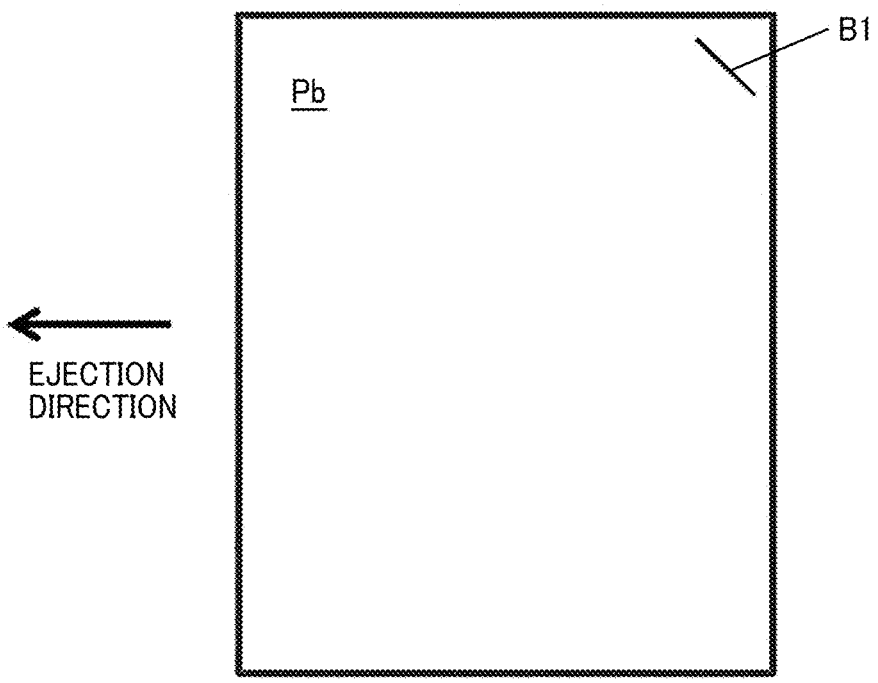
FIG. 16 is an image diagram of a sheet bundle after the staple binding process illustrated in FIG. 14.

FIG. 16 is an image diagram of the sheet bundle Pb on which the stapler 62 performs the staple binding when the user sets "oblique binding" as the type of binding process on the control panel 110 and the number of sheets to be bound is 15 or more.

The following describes a control flow of the liquid-application crimp binding (the standard number of bindings).

Figure 17:
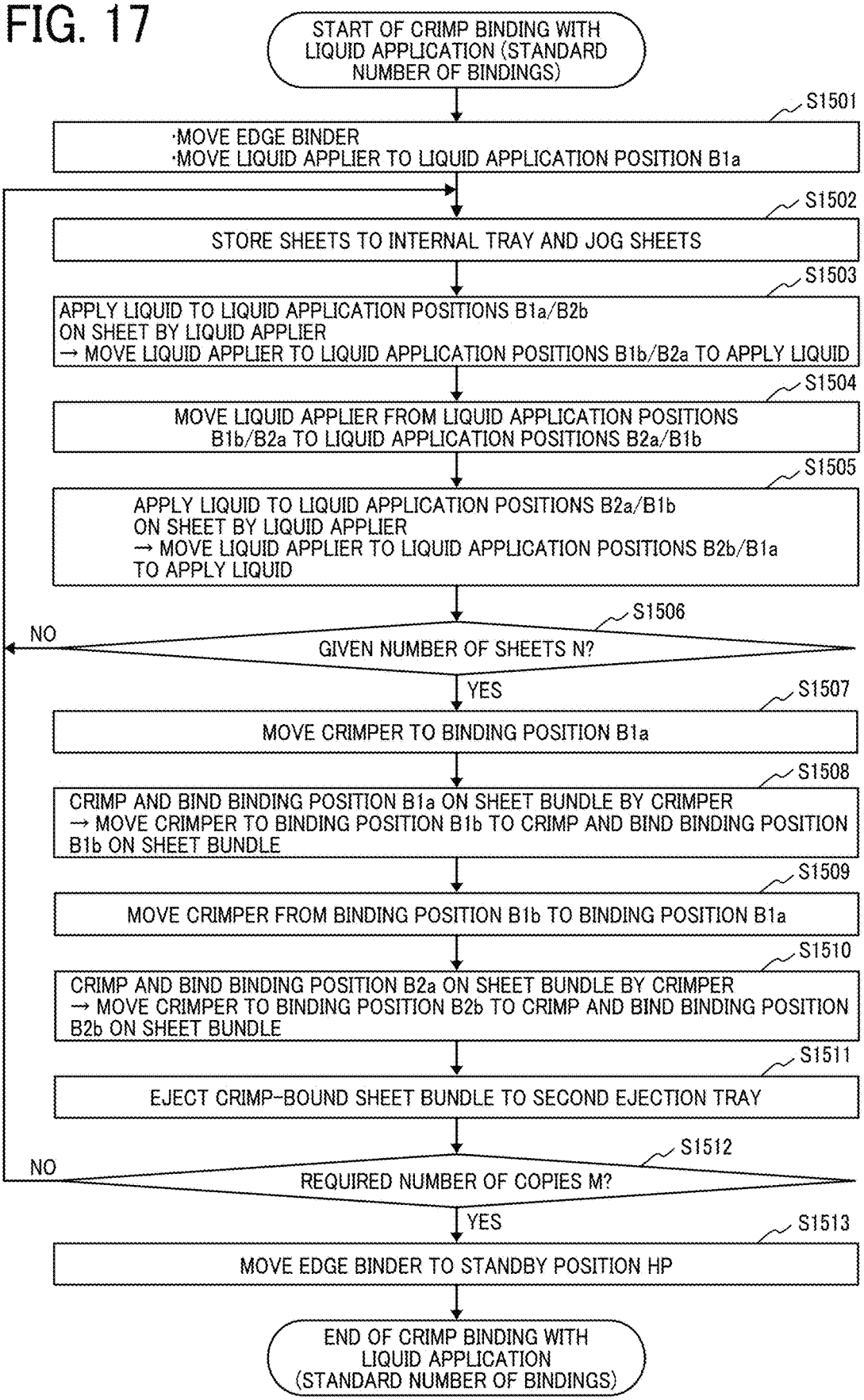
FIG. 17 is a flowchart of a liquid-application crimp binding process in which the edge binder performs dual binding with a standard number of bindings.

FIG. 17 is a flowchart of control of the liquid-application crimp binding process (the standard number of bindings) executed in step S712 of FIG. 12.

FIG. 17 illustrates an example of the "dual binding" performed by the liquid-application crimp binding two times that is set as the standard number of bindings of the crimp bindings (see FIG. 13).

Figure 18A:
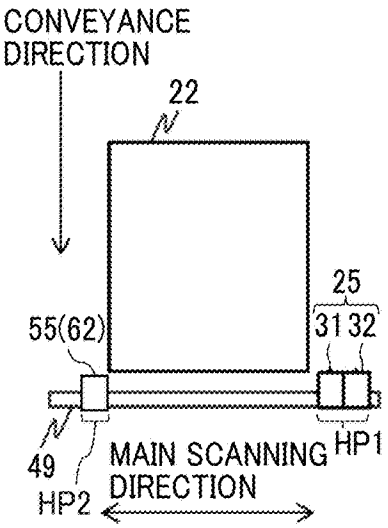
FIGS. 18A to 18N are diagrams illustrating positions of an edge binder during the execution of the liquid-application crimp binding process illustrated in FIG. 17.
Figure 18B:
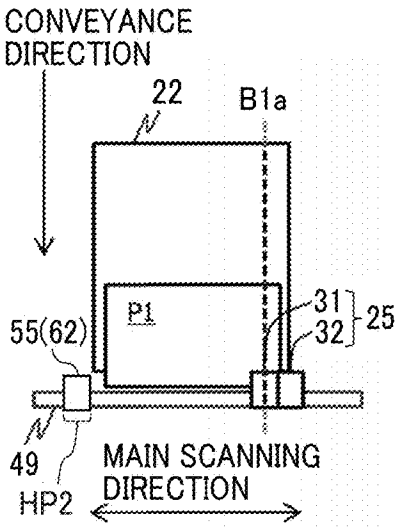
Figure 18C:
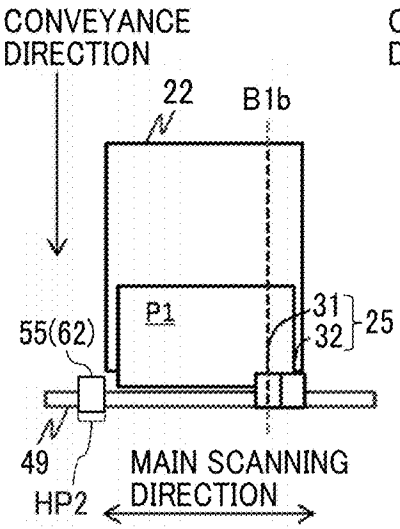
Figure 18D:
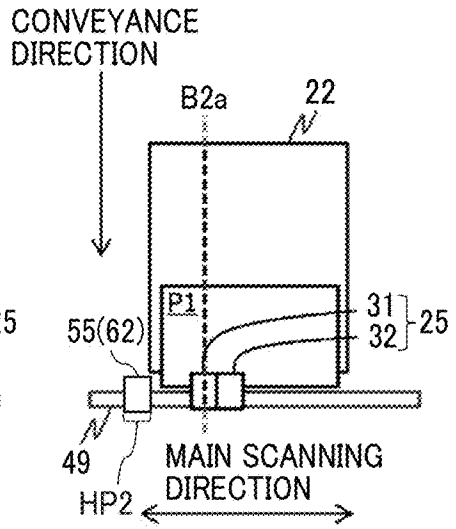
Figure 18E:
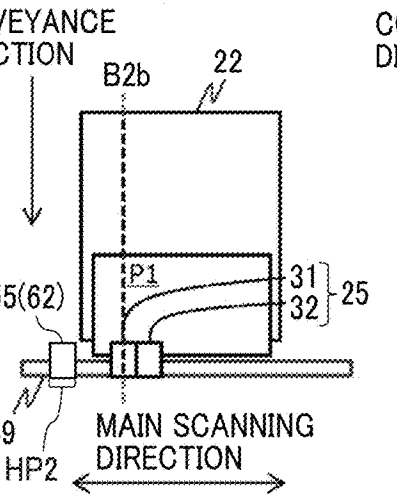
Figure 18F:
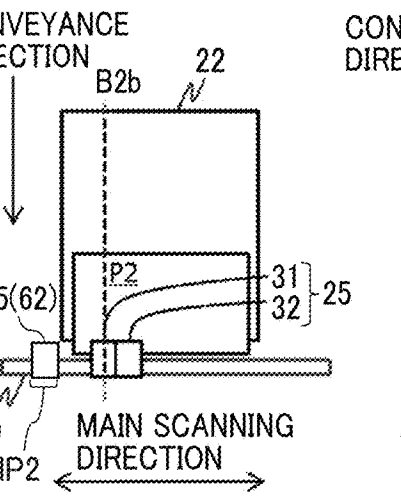
Figure 18G:
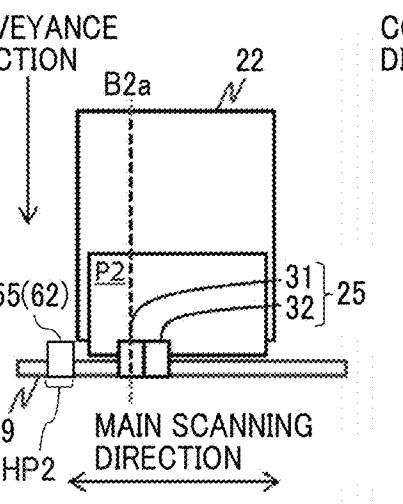
Figure 18H:
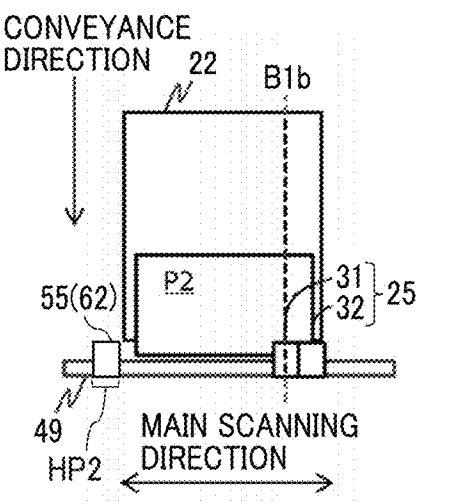
Figure 18I:
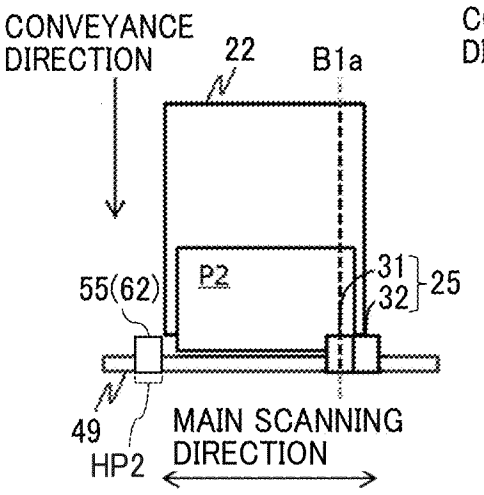
Figure 18J:
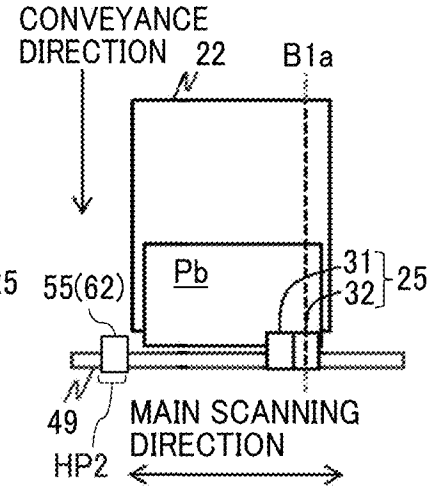
Figure 18K:
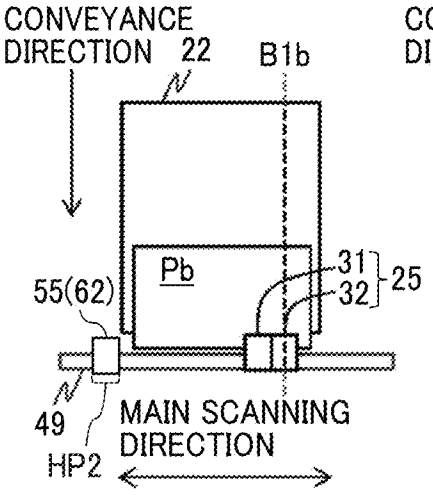
Figure 18L:
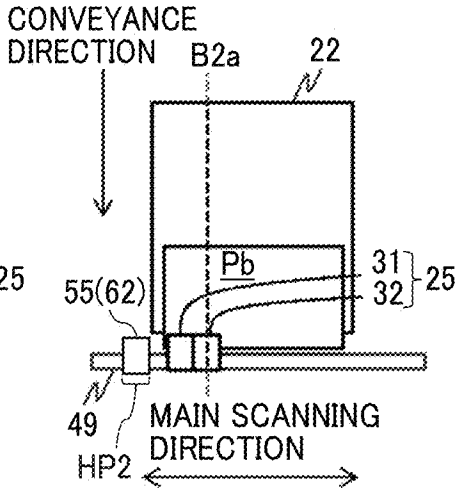
Figure 18M:
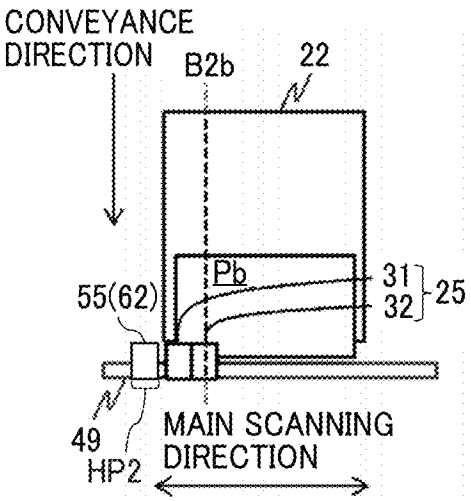
Figure 18N:
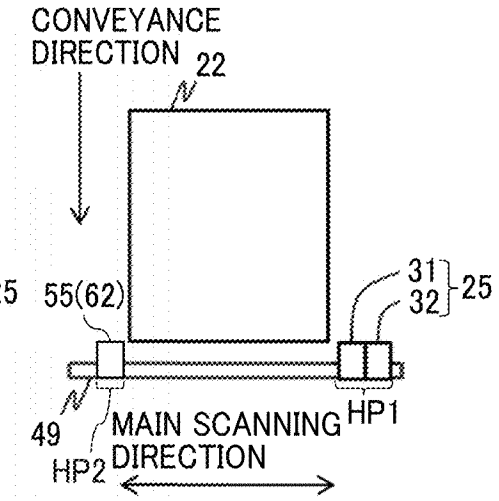

FIGS. 18A to 18N are diagrams illustrating the transition of positions of the edge binder 25 corresponding to the flowchart of FIG. 17 illustrating the control of the liquid-application crimp binding (the standard number of bindings).

A detailed description of points common to the process described with reference to FIG. 12 may be omitted, and differences will be mainly described below.

As illustrated in FIG. 18A, it is assumed that the edge binder 25 is located at the standby position HP at the start point of the dual binding performed by the liquid-application crimp binding. First binding positions B1*a* and B1*b* that correspond to first liquid application positions B1*a* and B1*b* are separated from second binding positions B2*a* and B2*b* that correspond to second liquid application positions B2*a* and B2*b* in the main scanning direction. In FIGS. 18A to 18N, the number of sheets P to be bound is twelve (the given number of sheets N=12), but no limitation is indicated thereby. In FIGS. 18A to 18N, the liquid application and the crimp binding are performed twice in one binding portion.

Since the number of sheets instructed to be bound is 12 as described above, the controller 100*b* determines that the number of sheets instructed to be bound is larger than 5 in the first binding number determination step S702 in the flowchart of FIG. 12 (Yes in step S702). Subsequently, the controller 100*b* proceeds to the second binding number determination process in step S703. Since the number of sheets instructed to be bound is 12 as described above, the controller 100*b* determines that the number of sheets instructed to be bound is smaller than 15 (No in step S703) and proceeds to the determination processes S705 to S712 for the liquid-application crimp binding. The controller 100*b* determines whether the remaining amount of the liquid in the first liquid storage tank 43 is sufficient for executing the number of crimp binding included in the binding command information in step S705. When the controller 100*b* determines that the remaining amount of the liquid in the first liquid storage tank 43 is sufficient for executing the number of crimp binding included in the binding command information (Yes in step S705), the controller 100*b* determines whether any command regarding the number of bindings is present in step S709. Since the user sets the standard number of bindings as the number of crimp bindings as described above, the controller 100*b* determines that any command regarding the number of bindings is not present (No in step S709). The controller 100*b* controls the liquid applier 31 and the crimper 32 to execute the liquid-application crimp binding with the "standard number of bindings" in step S712.

After the liquid-application crimp binding process (the standard number of bindings) is started, and before the first sheet P1 of the sheet bundle Pb is supplied to the internal tray 22, the controller 100*b* moves the edge binder 25 in the main scanning direction so that the liquid applier 31 faces the first liquid application position B1*a* of a first sheet P1, which corresponds to the first binding portion in step S1501 as illustrated in FIG. 17. As illustrated in FIG. 18B, the controller 100*b* arranges the liquid applier 31 at a position facing the first liquid application position B1*a* in the first sheet P1. Subsequently, the first sheet P1 on which the image has been formed by the image forming apparatus 2 is accommodated on the internal tray 22 in step S1502. The controller 100*b* moves the side fences 24L and 24R to perform the jogging to the first sheet P1 placed on the internal tray 22 in step S1502.

After the controller 100*b* completes the jogging to the first sheet P1 placed on the internal tray 22, the controller 100*b* controls the liquid applier 31 to perform a first liquid application at the first liquid application position B1*a* of the first sheet P1, which corresponds to the first binding portion, in step S1503.

Subsequently, as illustrated in FIG. 18C, the controller 100*b* controls the edge binder 25 to move in the main scanning direction so that the liquid applier 31 faces the first liquid application position B1*b* of the first sheet P1, which is the second liquid application position corresponding to the first binding portion, in step S1503. The controller 100*b* controls the liquid applier 31 to perform a second liquid application at the first liquid application position B1*b* of the first sheet P1, which corresponds to the first binding portion, in step S1503.

In this case of the standard number of bindings in which crimp bindings of two times are selected (see FIG. 13), the controller 100*b* completes the first liquid application at the first binding portion. Subsequently, as illustrated in FIG. 18D, the controller 100*b* controls the edge binder 25 to move in the main scanning direction so that the liquid applier 31 faces the second liquid application position B2*a* of the first sheet P1, which is the first liquid application position corresponding to a second binding portion, in step S1504. The controller 100*b* controls the liquid applier 31 to perform a first liquid application at the second liquid application position B2*a* of the first sheet P1, which corresponds to the second binding portion, in step S1505.

Subsequently, as illustrated in FIG. 18E, the controller 100*b* controls the edge binder 25 to move in the main scanning direction so that the liquid applier 31 faces the second liquid application position B2*b* of the first sheet P1, which is the second liquid application position corresponding to the second binding portion, in step S1505. The controller 100*b* controls the liquid applier 31 to perform a second liquid application to the second binding portion on the second liquid application position B2*b* of the first sheet P1 in step S1505.

After the liquid applier 31 completes applying the liquid to the first liquid application positions B1*a* and B1*b* and the second liquid application positions B2*a* and B2*b* in the first sheet P1, the controller 100*b* determines whether the number of sheets P placed on the internal tray 22 has reached the given number of sheets N instructed by the binding command in step S1506. Since the given number of sheets Nis 12 as described above, the controller 100*b* determines that the number of sheets P placed on the internal tray 22 does not reach the given number of sheets N (No in step S1506). As a result, the controller 100*b* returns to step S1502. As illustrated in FIG. 18F, a second sheet P2 of the sheet bundle Pb is conveyed from the image forming apparatus 2 and accommodated in the internal tray 22, and the liquid applier 31 is disposed at a position facing the second liquid application position B2*b* of the second sheet P2, which is the first liquid application position corresponding to the second binding portion. The controller 100*b* performs the jogging to the second sheet P2 placed in the internal 2 in step S1502. In step S1503, the controller 100*b* controls the liquid applier 31 to perform a first liquid application at the second liquid application position B2*b* of the second sheet P2, which corresponds to the second binding portion, as illustrated in FIG. 18F.

As a result, the controller 100*b* controls the conveyance roller pairs 10, 11, 14, and 15 and the liquid applier 31 to repeat the conveyance of the sheet P and the liquid application to the first liquid application positions B1*a* and B1*b* and the second liquid application positions B2*a* and B2*b* until the number of sheets P placed on the internal tray 22 reaches the given number N as illustrated in FIGS. 18A to 18N. At this time, the controller 100*b* controls the liquid applier 31 to apply the liquid to the B-th sheet P (B<N) in the order of the first liquid application positions B1*a* and B1*b* and the second liquid application positions B2*a* and B2*b*. Subsequently, the controller 100*b* controls the liquid applier 31 to apply the liquid to the (B+1)-th sheet P in the order of the second liquid application positions B2*b* and B2*a* and the first liquid application positions B1*b* and B1*a*. In other words, the controller 100*b* changes the order in which the liquid applier 31 applies the liquid to the first liquid application positions B1*a* and B1*b* and the second liquid application positions B2*a* and B2*b* for each sheet P. The controller 100*b* also causes the edge binder 25 to move from one of the first binding portion including the first liquid application positions B1*a* and B1*b* and the second binding portion including the second liquid application positions B2*a* and B2*b* to the other one of the first binding portion and the second binding portion at the shortest distance without passing through the standby position HP in steps S1503 to S1506 (see FIGS. 18B to 18I).

When the controller 100*b* determines that the number of sheets P placed on the internal tray 22 has reached the given number N that is 12 sheets in the present embodiment (YES in step S1506), the controller 100*b* controls the edge binder 25 to move in the main scanning direction such that the crimper 32 faces the first binding position B1*a* of the sheet bundle Pb, which is the first binding position of the first binding portion, as illustrated in FIG. 18J in step S1507. The controller 100*b* controls the crimper 32 to perform the first crimp binding, which corresponds to the first binding portion, at the first binding position B1*a* in the first binding portion of the sheet bundle Pb placed on the internal tray 22 in step S1508. Subsequently, as illustrated in FIG. 18K, the controller 100*b* controls the edge binder 25 to move in the main scanning direction so that the crimper 32 faces the first binding position B1*b* of the sheet bundle Pb, which is the second binding position corresponding to the first binding portion, in step S1508. The controller 100*b* controls the crimper 32 to perform the second crimp binding at the first binding position B1*b* of the sheet bundle Pb, which corresponds to the first binding portion, in step S1508.

Subsequently, as illustrated in FIG. 18L, the controller 100*b* controls the edge binder 25 to move in the main scanning direction so that the crimper 32 faces the second binding position B2*a* of the sheet bundle Pb, which is the first binding position corresponding to the second binding portion, in step S1509. The controller 100*b* controls the crimper 32 to perform the first crimp binding at the second binding position B2*a* of the sheet bundle Pb, which corresponds to the second binding portion, in step S1510. Subsequently, as illustrated in FIG. 18M, the controller 100*b* controls the edge binder 25 to move in the main scanning direction so that the crimper 32 faces the second binding position B2*b* of the sheet bundle Pb, which is the second binding position corresponding to the second binding portion, in step S1510. The controller 100*b* controls the crimper 32 to perform the second crimp binding at the second binding position B2*b* of the sheet bundle Pb, which corresponds to the second binding portion, in step S1510.

In the example illustrated in FIGS. 18A to 18N, since the liquid applier 31 finally applies the liquid to the first liquid application position B1*a*, the crimper 32 performs the binding processes in the order of the first binding positions B1*a* and B1*b* and the second binding positions B2*a* and B2*b*. On the other hand, when the liquid applier 31 finally applies the liquid to the second liquid application position B1*b*, the crimper 32 performs the binding processes in the order of the second binding positions B2*b* and B2*a* and the first binding positions B1*b* and B1*a*.

After the sheet bundle Pb is crimped at the first binding positions B1*a* and B1*b* and the second binding positions B2*a* and B2*b*, the controller 100*b* rotates the conveyance roller pair 15 to eject the crimped sheet bundle Pb to the second ejection tray 26 in step S1511. The controller 100*b* determines whether the number of sheet bundles Pb thus ejected to the second ejection tray 26 has reached the requested number of copies M indicated by the binding command in step S1512. When the controller 100*b* determines that the number of sheet bundles Pb thus ejected has not reached the requested number of copies M (NO in step S1512), the controller 100*b* executes the operations of step S1502 and the following steps again. In other words, when the controller 100*b* determines that the number of sheet bundles Pb thus ejected has not reached the requested number of copies M (NO in step S1512), the controller 100*b* repeats the operations of steps S1502 to S1512 until the number of sheet bundles Pb ejected to the second ejection tray 26 reaches the requested number of copies M. On the other hand, when the controller 100*b* determines that the number of sheet bundles Pb output to the second ejection tray 26 has reached the requested number of copies M (YES in step S1512), the controller 100*b* drives the edge binder movement motor 50 to move the edge binder 25 to the standby position HP as illustrated in FIG. 18N in step S1513. As described above, the liquid-application crimp bindings can be executed under the condition of "dual binding" and the number of times of the crimp binding (the number of times of execution of the post-process) that is "the standard number of times (twice)."

Figure 19:
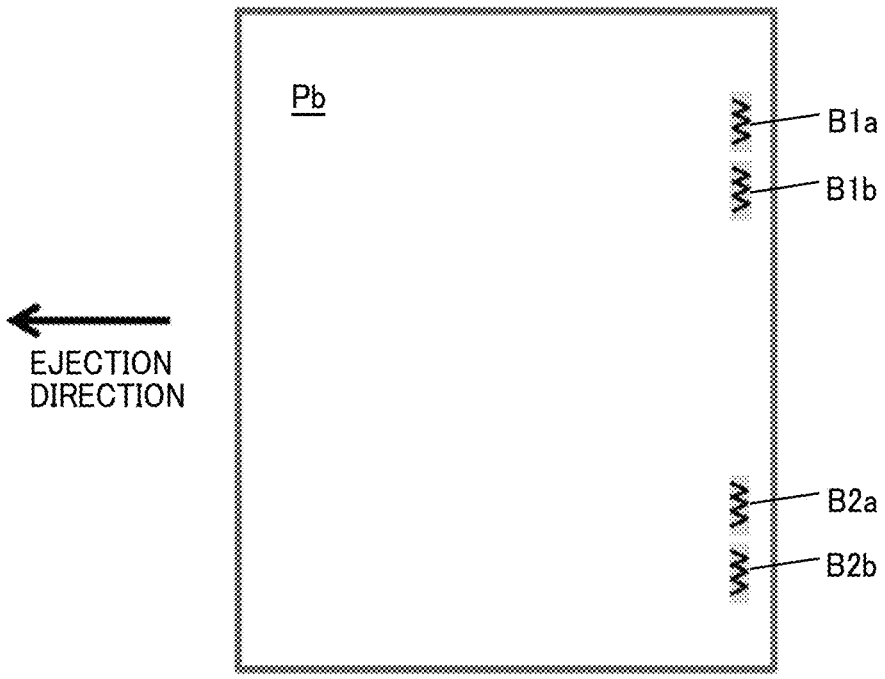
FIG. 19 is an image diagram of a sheet bundle after the liquid-application crimp binding process illustrated in FIG. 17 in which the edge binder performs dual binding with a standard number of bindings.

FIG. 19 is an image diagram of the sheet bundle Pb after the liquid application crimp bindings are performed under the following conditions.

The user operates the control panel 110 to set the "parallel binding" as the type of binding. In addition, the user sets the "dual binding" and "the standard number of bindings (twice)" as "the number of crimp bindings (the number of times of execution of the post-processing" on the setting screen G1 illustrated in FIG. 13.

The following describes a control flow of the liquid-application crimp binding when the number of bindings is increased.

Figure 20:
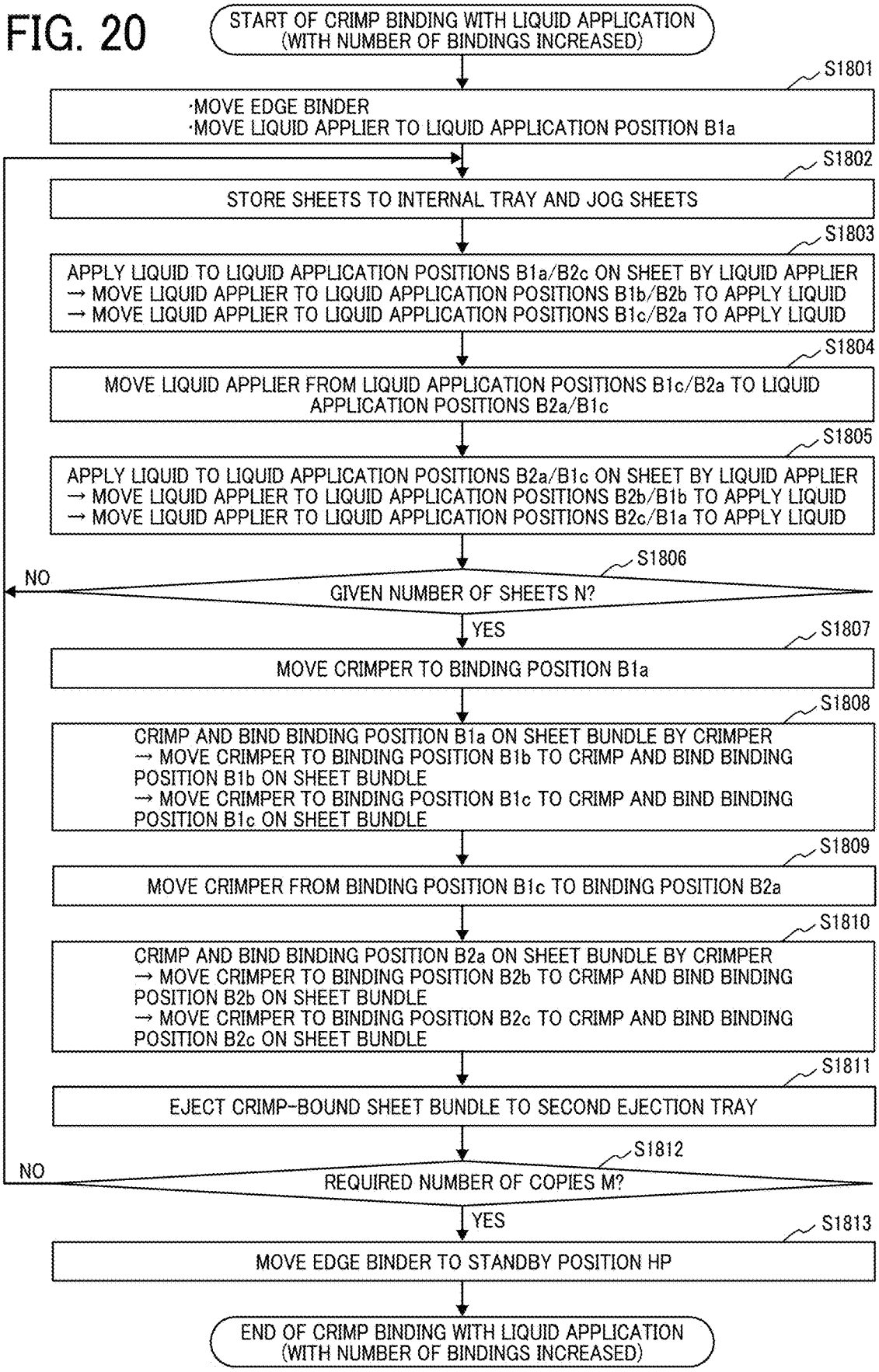
FIG. 20 is a flowchart of a liquid-application crimp binding process in which an edge binder performs dual binding with an increased number of bindings.

FIG. 20 is a flowchart of the control of the liquid-application crimp binding process executed in step S711 of FIG. 12 when the number of bindings is increased.

FIG. 20 illustrates an example of the "dual binding" performed by the liquid-application crimp binding three times that is "the number of crimp bindings (the number of times of execution of the post-processing" set by inputting "+1" to the right side of "INCREASE" on the setting screen G1 illustrated in FIG. 13.

Figure 21A:
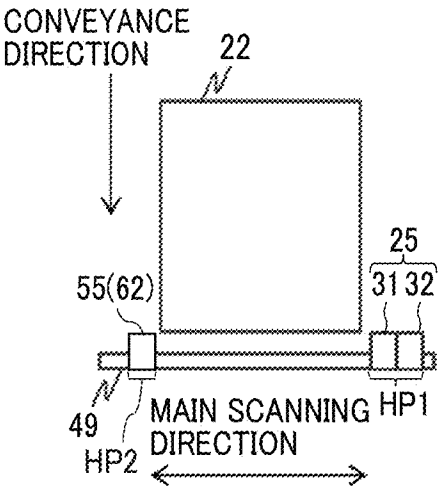
FIGS. 21A to 21T are diagrams illustrating positions of the edge binder during the execution of the liquid-application crimp binding process illustrated in FIG. 20.
Figure 21B:
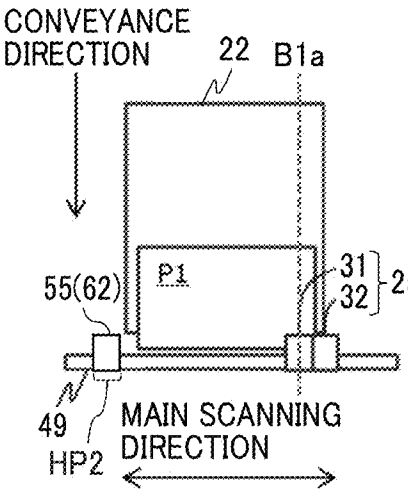
Figure 21C:
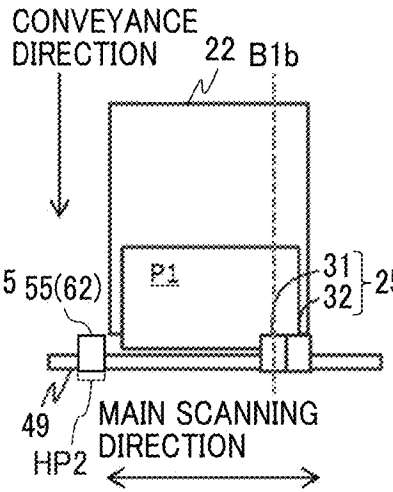
Figure 21D:
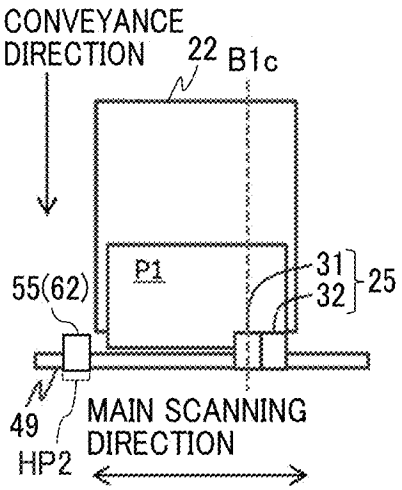
Figure 21E:
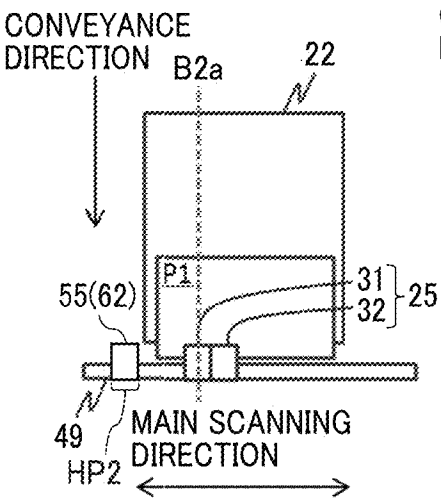
Figure 21F:
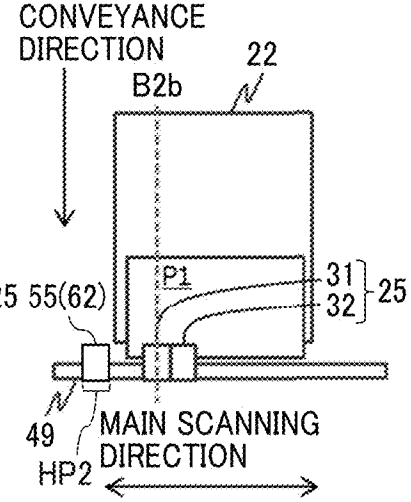
Figure 21G:
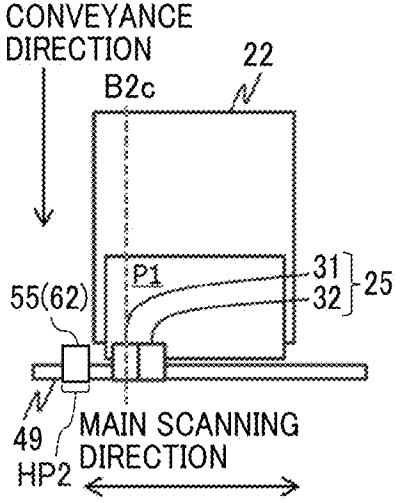
Figure 21H:
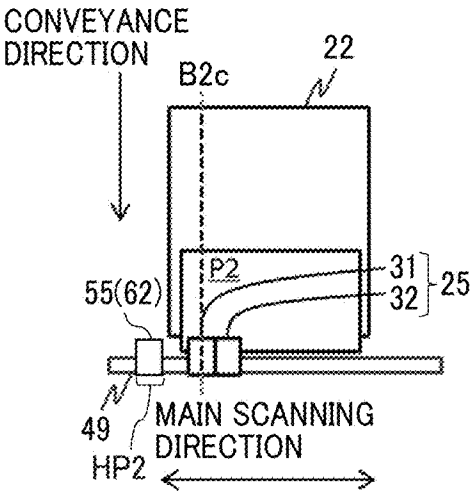
Figure 21I:
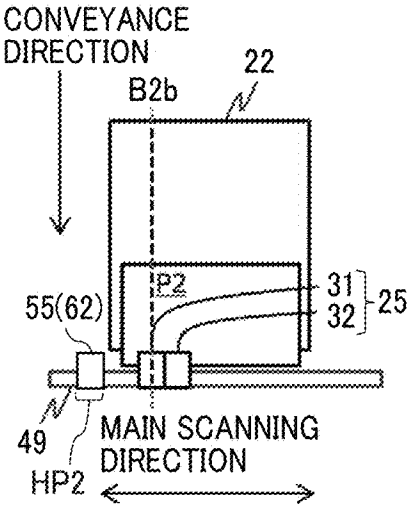
Figure 21J:
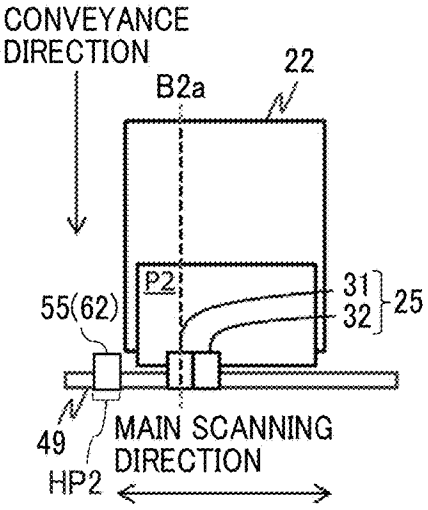
Figure 21K:
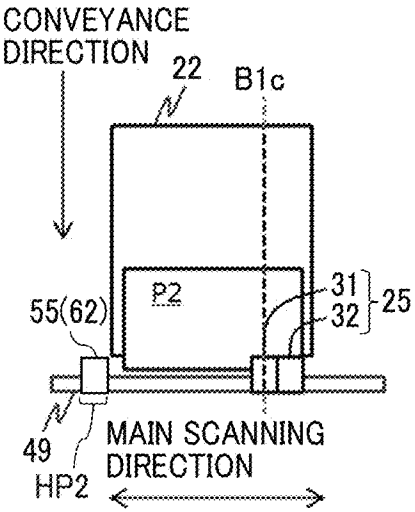
Figure 21L:
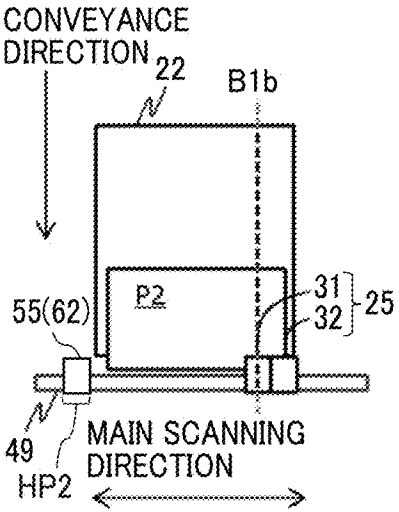
Figure 21M:
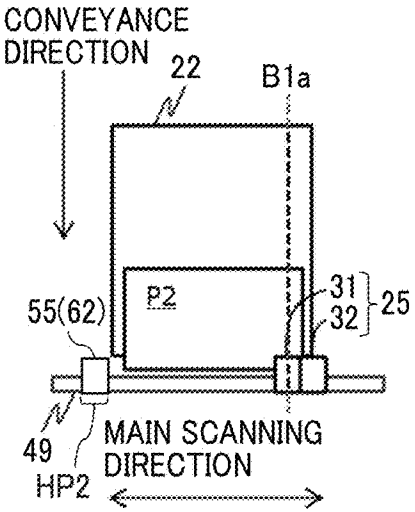
Figure 21N:
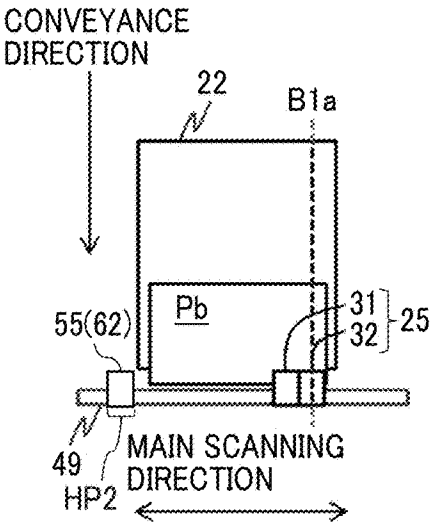
Figure 21O:
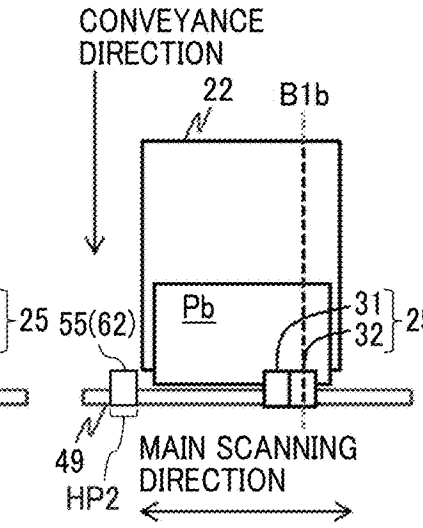
Figure 21P:
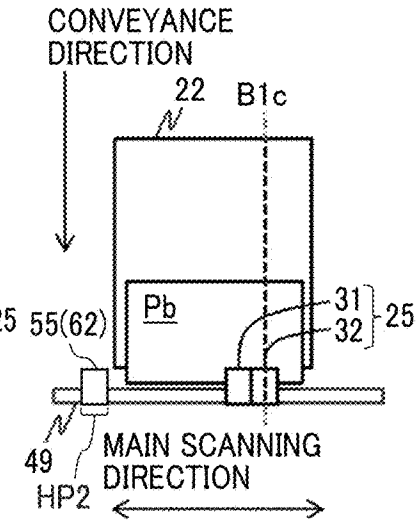
Figure 21Q:
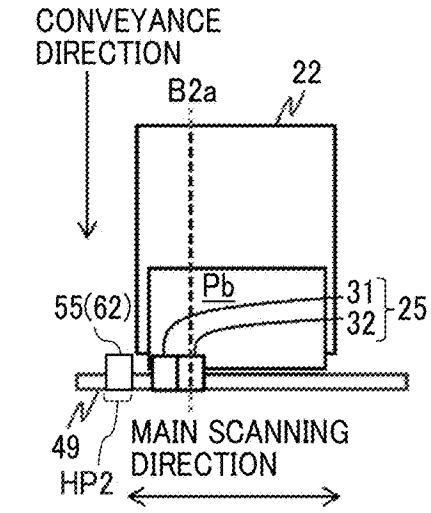
Figure 21R:
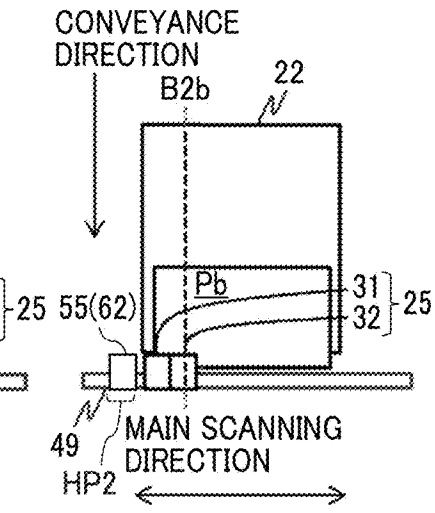
Figure 21S:
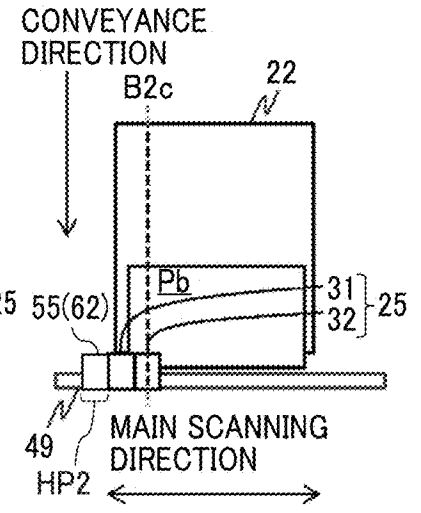
Figure 21T:
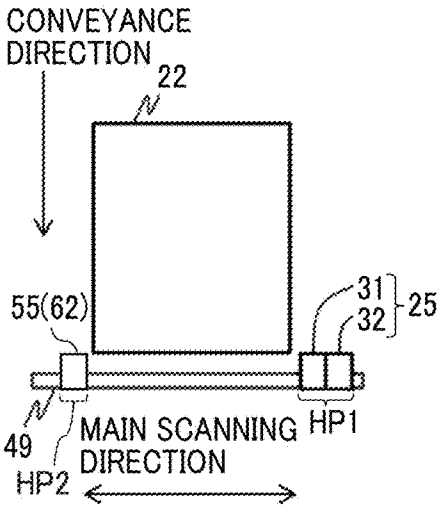

FIGS. 21A to 21T are diagrams illustrating the transition of positions of the edge binder 25 corresponding to the flowchart of FIG. 20 illustrating the control of the liquid-application crimp binding when the number of bindings is increased.

A detailed description of points common to the process described with reference to FIG. 12 may be omitted, and differences will be mainly described below.

As illustrated in FIG. 21A, it is assumed that the edge binder 25 is located at the standby position HP at the start point of the dual binding performed by the liquid-application crimp binding. First binding positions B1*a* to B1*c* that correspond to first liquid application positions B1*a* to B1*c* are separated from second binding positions B2*a* to B2*c* that correspond to second liquid application positions B2*a* to B2*c* in the main scanning direction. In FIG. 21, the number of sheets P to be bound is twelve (in other words, the given number of sheets N=12), but the present embodiment is not limited to this. In FIG. 21, the liquid application and the crimp binding are performed three times in one binding portion.

Since the number of sheets instructed to be bound is 12 as described above, the controller 100*b* determines that the number of sheets instructed to be bound is larger than 5 in the first binding number determination step S702 in the flowchart of FIG. 12 (Yes in step S702). Subsequently, the controller 100*b* proceeds to the second binding number determination process in step S703. Since the number of sheets instructed to be bound is 12 as described above, the controller 100*b* determines that the number of sheets instructed to be bound is smaller than 15 (No in step S703) and proceeds to the determination processes S705 to S712 for the liquid-application crimp binding. The controller 100*b* determines whether the remaining amount of the liquid in the first liquid storage tank 43 is sufficient for executing the number of crimp bindings included in the binding command information in step S705. When the controller 100*b* determines that the remaining amount of the liquid in the first liquid storage tank 43 is sufficient for executing the number of crimp binding included in the binding command information (Yes in step S705), the controller 100*b* determines whether any command regarding the number of bindings is present in step S709. Since the user sets the number of crimp bindings to increase to be three times as described above (in other words, the user inputs "+1" at the right side of the "INCREASE" on the setting screen G1," the controller 100*b* determines that any command regarding the number of bindings is present (Yes in step S709 and Yes in step S710). The controller 100*b* controls the liquid applier 31 and the crimper 32 to execute the liquid-application crimp binding with the increased number of bindings that is three times in this example in step S711.

After the liquid-application crimp binding process with the increased number of bindings is started, and before the first sheet P1 of the sheet bundle Pb is supplied to the internal tray 22, the controller 100*b* moves the edge binder 25 in the main scanning direction so that the liquid applier 31 faces the first liquid application position B1*a* of a first sheet P1, which corresponding to the first binding portion in step S1801 as illustrated in FIG. 20. As illustrated in FIG. 21B, the controller 100*b* arranges the liquid applier 31 at a position facing the first liquid application position B1*a* in the first sheet P1. Subsequently, the first sheet P1 on which the image has been formed by the image forming apparatus 2 is accommodated on the internal tray 22 in step S1802. The controller 100*b* moves the side fences 24L and 24R to perform the jogging to the first sheet P1 placed on the internal tray 22 in step S1802.

After the controller 100*b* completes the jogging to the first sheet P1 placed on the internal tray 22, the controller 100*b* controls the liquid applier 31 to perform a first liquid application at the first liquid application position B1*a* of the first sheet P1, which corresponds to the first binding portion, in step S1803.

Subsequently, as illustrated in FIG. 21C, the controller 100*b* controls the edge binder 25 to move in the main scanning direction so that the liquid applier 31 faces the first liquid application position B1*b* of the first sheet P1, which is the second liquid application position corresponding to the first binding portion, in step S1803. The controller 100*b* controls the liquid applier 31 to perform a second liquid application at the first liquid application position B1*b* of the first sheet P1, which corresponds to the first binding portion, in step S1803.

Subsequently, as illustrated in FIG. 21D, the controller 100*b* controls the edge binder 25 to move in the main scanning direction so that the liquid applier 31 faces the first liquid application position B1*c* of the first sheet P1, which is the third liquid application position corresponding to the first binding portion, in step S1803. The controller 100*b* controls the liquid applier 31 to perform the third liquid application at the first liquid application position B1*c* of the first sheet P1, which corresponds to the first binding portion, in step S1803.

Subsequently, as illustrated in FIG. 21E, the controller 100*b* controls the edge binder 25 to move in the main scanning direction so that the liquid applier 31 faces the second liquid application position B2*a* of the first sheet P1, which is the first liquid application position corresponding to the second binding portion, in step S1804. The controller 100*b* controls the liquid applier 31 to perform the first liquid application at the second liquid application position B2*a* of the first sheet P1, which corresponds to the second binding portion, in step S1805.

Subsequently, as illustrated in FIG. 21F, the controller 100*b* controls the edge binder 25 to move in the main scanning direction so that the liquid applier 31 faces the second liquid application position B2*b* of the first sheet P1, which is the second liquid application position corresponding to the second binding portion. The controller 100*b* controls the liquid applier 31 to perform the second liquid application at the second liquid application position B2*b* of the first sheet P1, which corresponds to the second binding portion, in step S1805.

Subsequently, as illustrated in FIG. 21G, the controller 100*b* controls the edge binder 25 to move in the main scanning direction so that the liquid applier 31 faces the second liquid application position B2*c* of the first sheet P1, which is the third liquid application position corresponding to the second binding portion, in step S1805. The controller 100*b* controls the liquid applier 31 to perform the third liquid application at the second liquid application position B2*c* of the first sheet P1, which corresponds to the second binding portion, in step S1805.

After the liquid applier 31 completes applying the liquid to the first liquid application positions B1*a* to B1*c* and the second liquid application positions B2*a* to B2*c* in the first sheet P1, the controller 100*b* determines whether the number of sheets P placed on the internal tray 22 has reached the given number of sheets N instructed by the binding command in step S1806. Since the given number of sheets Nis 12 as described above, the controller 100*b* determines that the number of sheets P placed on the internal tray 22 does not reach the given number of sheets N (No in step S1806). As a result, the controller 100*b* returns to step S1802. As illustrated in FIG. 21H, a second sheet P2 of the sheet bundle Pb is accommodated in the internal tray 22, and the liquid applier 31 is disposed at a position facing the second liquid application position B2*c* of the second sheet P2, which is the first liquid application position corresponding to the second binding portion. The controller 100*b* performs the jogging to the second sheet P2 placed on the internal tray 22 in step S1802.

In step S1803, the controller 100*b* controls the liquid applier 31 to perform a first liquid application at the second liquid application position B2*b* of the second sheet P2, which corresponds to the second binding portion, as illustrated in FIG. 21H. Subsequently, as illustrated in FIG. 21I, the controller 100*b* controls the edge binder 25 to move in the main scanning direction so that the liquid applier 31 faces the second liquid application position B2*b* of the second sheet P2, which is the second liquid application position in the second binding portion, in step S1803. The controller 100*b* controls the liquid applier 31 to perform the second liquid application at the second liquid application position B2*b* of the second sheet P2, which corresponds to the second binding portion, in step S1803.

As a result, the controller 100*b* repeats the conveyance of the sheet P by the conveyance roller pairs 10, 11, 14, and 15 and the liquid application to the first liquid application positions B1*a* to B1*c* and the second liquid application positions B2*a* to B2*c* by the liquid applier 31 until the number of sheets P placed on the internal tray 22 reaches the given number N as illustrated in FIGS. 21A to 21M. At this time, the controller 100*b* controls the liquid applier 31 to apply the liquid to the B-th sheet P (B<N) in the order of the first liquid application positions B1*a* to B1*c* and the second liquid application positions B2*a* to B2*c*. Subsequently, the controller 100*b* controls the liquid applier 31 to apply the liquid to the (B+1)-th sheet P in the order of the second liquid application positions B2*c* to B2*a* and the first liquid application positions B1*c* to B1*a*. In other words, the controller 100*b* changes the order in which the liquid applier 31 applies the liquid to the first liquid application positions B1*a* to B1*c* and the second liquid application positions B2*a* to B2*c* for each sheet P. The controller 100*b* also causes the edge binder 25 to move from one of the first binding portion including the first liquid application positions B1*a* to B1*c* and the second binding portion including the second liquid application positions B2*a* to B2*c* to the other one of the first binding portion and the second binding portion at the shortest distance without passing through the standby position HP in steps S1803 to S1806 (see FIGS. 21B to 21M).

When the controller 100*b* determines that the number of sheets P placed on the internal tray 22 has reached the given number N that is 12 sheets in the present embodiment (YES in step S1806), the controller 100*b* controls the edge binder 25 to move in the main scanning direction such that the crimper 32 faces the first binding position B1*a* of the sheet bundle Pb, which is the first binding position corresponding to the first binding portion, as illustrated in FIG. 21N, in step S1807. The controller 100*b* controls the crimper 32 to perform the first crimp binding, which corresponds to the first binding portion, at the first binding position B1*a* of the sheet bundle Pb placed on the internal tray 22 in step S1808. Subsequently, as illustrated in FIG. 21O, the controller 100*b* controls the edge binder 25 to move in the main scanning direction so that the crimper 32 faces the first binding position B1*b* of the sheet bundle Pb, which is the second binding position corresponding to the first binding portion, in step S1808. The controller 100*b* controls the crimper 32 to perform the second crimp binding at the first binding position B1*b* of the sheet bundle Pb, which corresponds to the first binding portion, in step S1808.

Subsequently, as illustrated in FIG. 21P, the controller 100*b* controls the edge binder 25 to move in the main scanning direction so that the crimper 32 faces the first binding position B1*c* of the sheet bundle Pb, which is the third binding position corresponding to the first binding portion, in step S1808. The controller 100*b* controls the crimper 32 to perform the third crimp binding at the first binding position B1*c* of the sheet bundle Pb, which corresponds to the first binding portion, in step S1808. Subsequently, as illustrated in FIG. 21Q, the controller 100*b* controls the edge binder 25 to move in the main scanning direction so that the crimper 32 faces the second binding position B2*a* of the sheet bundle Pb, which is the first binding position corresponding to the second binding portion, in step S1809. The controller 100*b* controls the crimper 32 to perform the first crimp binding at the second binding position B2*a* of the sheet bundle Pb, which corresponds to the second binding portion, in step S1810.

Subsequently, as illustrated in FIG. 21R, the controller 100*b* controls the edge binder 25 to move in the main scanning direction so that the crimper 32 faces the second binding position B2*b* of the sheet bundle Pb, which corresponds to the second binding position, in step S1810. The controller 100*b* controls the crimper 32 to perform the second crimp binding at the second binding position B2*b* of the sheet bundle Pb, which corresponds to the second binding portion, in step S1810. Subsequently, as illustrated in FIG. 21S, the controller 100*b* controls the edge binder 25 to move in the main scanning direction so that the crimper 32 faces the second binding position B2*c* of the sheet bundle Pb, which is the third binding position corresponding to the second binding portion, in step S1810. The controller 100*b* controls the crimper 32 to perform the third crimp binding at the second binding position B2*c* of the sheet bundle Pb, which corresponds to the second binding portion, in step S1810.

In the example illustrated in FIGS. 21A to 21T, since the liquid applier 31 finally applies the liquid to the first liquid application position B1*a*, the crimper 32 performs the binding processes in the order of the first binding positions B1*a* to B1*c* and the second binding positions B2*a* to B2*c*. On the other hand, when the liquid applier 31 finally applies the liquid to the second liquid application position B2*c*, the crimper 32 performs the binding processes in the order of the second binding positions B2*c* to B2*a* and the first binding positions B1*c* to B1*a*.

After the sheet bundle Pb is crimped at the first binding positions B1*a* to B1*c* and the second binding positions B2*a* to B2*c*, the controller 100*b* rotates the conveyance roller pair 15 to eject the crimped sheet bundle Pb to the second ejection tray 26 in step S1811. The controller 100*b* determines whether the number of sheet bundles Pb thus ejected to the second ejection tray 26 has reached the requested number of copies M indicated by the binding command in step S1812. When the controller 100*b* determines that the number of sheet bundles Pb thus ejected has not reached the requested number of copies M (No in step S1812), the controller 100*b* executes the operations of step S1802 and the following steps again. In other words, when the controller 100*b* determines that the number of sheet bundles Pb thus ejected has not reached the requested number of copies M (No in step S1812), the controller 100*b* repeats the operations of steps S1802 to S1812 until the number of sheet bundles Pb ejected to the second ejection tray 26 reaches the requested number of copies M. On the other hand, when the controller 100*b* determines that the number of sheet bundles Pb output to the second ejection tray 26 has reached the requested number of copies M (YES in step S1812), the controller 100*b* drives the edge binder movement motor 50 to move the edge binder 25 to the standby position HP as illustrated in FIG. 21T in step S1813. As described above, the liquid-application crimp bindings can be executed under the condition of "dual binding" and the number of times of the crimp binding (the number of times of execution of the post-process) that is the increased number of bindings (three times) (in other words, the increased number of bindings set by inputting "+1" at the right side of the "INCREASE" on the setting screen G1).

Figure 22:
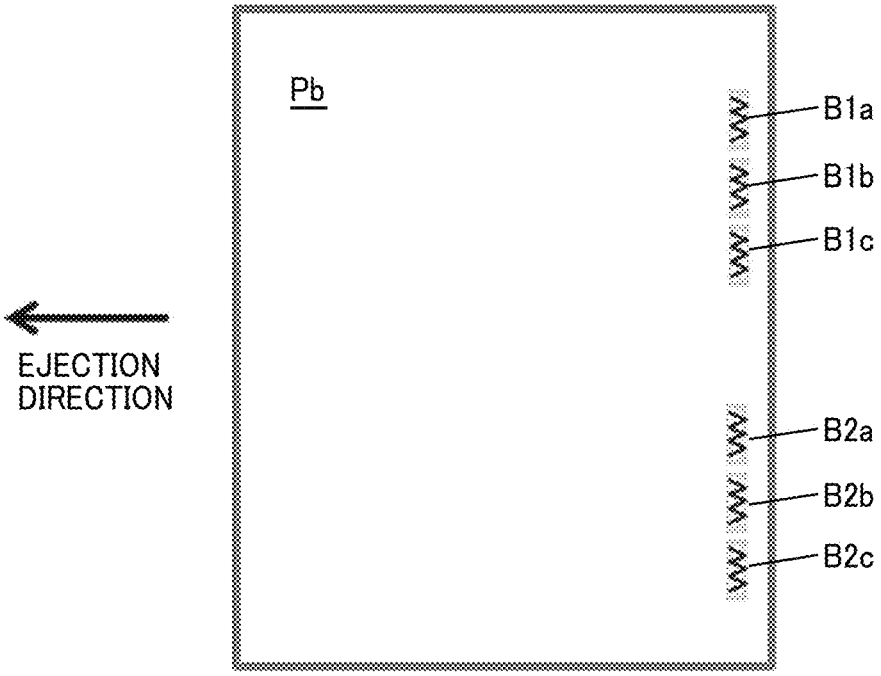
FIG. 22 is an image diagram of a sheet bundle after the liquid-application crimp binding process illustrated in FIG. 20 in which the edge binder performs dual binding with a standard number of bindings.

FIG. 22 is an image diagram of the sheet bundle Pb after the liquid application crimp bindings are performed under the following conditions.

The user operates the control panel 110 to set the "parallel binding" as the type of binding. In addition, the user sets the "dual binding" on the setting screen G1 and inputs "+1" at the right side of the "INCREASE" on the setting screen G1 in FIG. 13 to set the number of crimp bindings (the number of times of execution of the post-processing) to be three times.

Although an example in which one or two positions of the sheet bundle Pb are crimped and bound has been described in the above-described embodiment, an embodiment of the present disclosure is also applicable to a case in which three or more positions of the sheet bundle Pb spaced apart from each other in the main scanning direction are crimped and bound. In this case, the controller 100*b* causes the liquid applier 31 to apply the liquid to three or more crimp binding positions and causes the crimper 32 to perform the crimp binding. According to an embodiment of the present disclosure, the productivity of the crimp binding can be enhanced even when three or more positions are crimped and bound.

However, it is not necessary for the liquid applier 31 to apply the liquid to all the liquid application positions corresponding to the binding positions of all the sheets P of the sheet bundle Pb. For example, when crimp binding is performed at three crimp binding positions apart from each other in the main scanning direction, the controller 100*b* may cause the liquid applier 31 to apply the liquid to three liquid application positions of an E-th sheet P1 (E<N−2), apply the liquid to two liquid application positions of an (E+1)-th sheet P2, and apply the liquid to one liquid application position of an (E+2)-th sheet P2.

The following describes a control flow of the ordinary crimp binding (the standard number of bindings).

Figure 23:
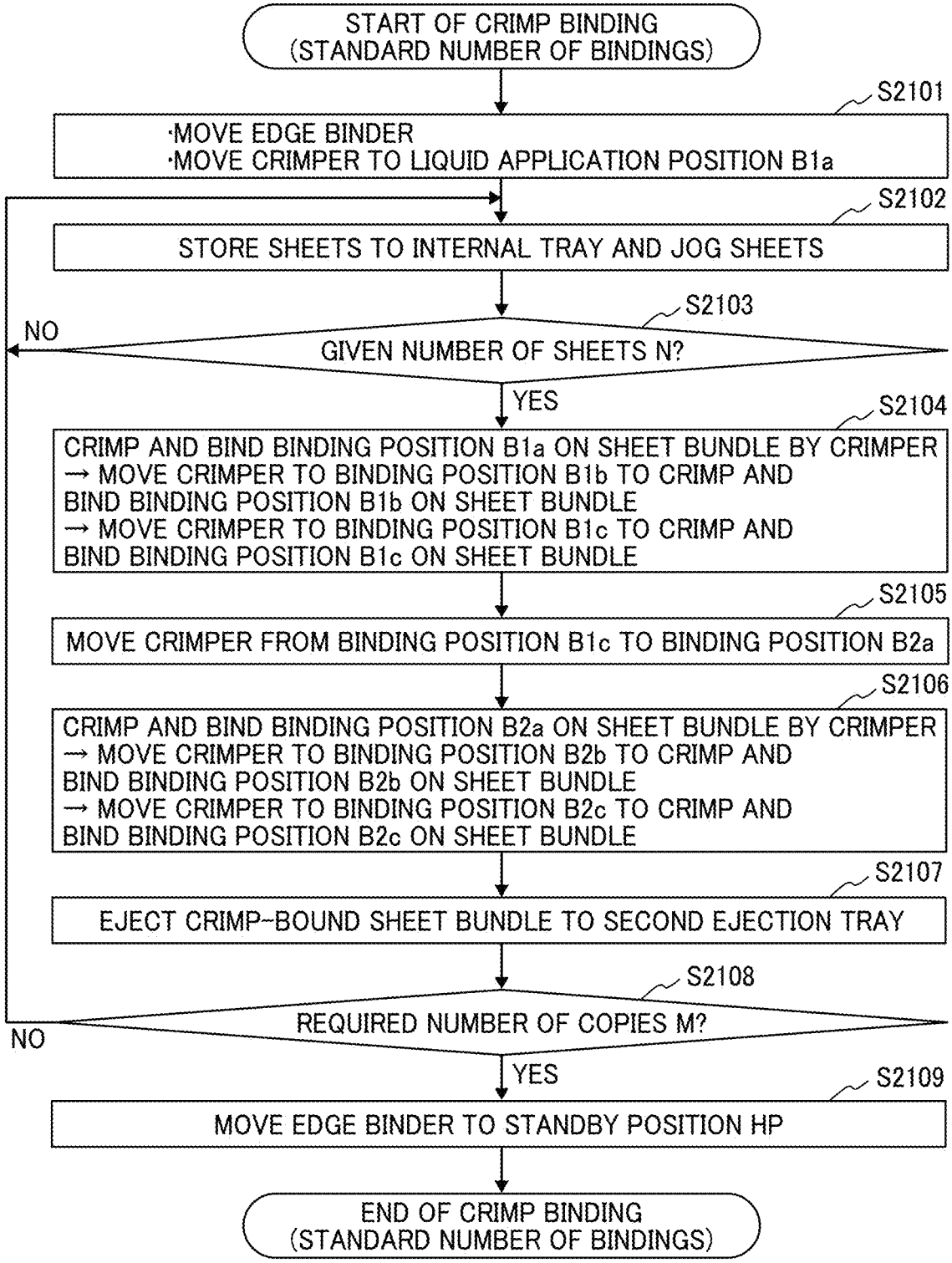
FIG. 23 is a flowchart of a crimp binding process in which the edge binder performs dual binding with a standard number of bindings.

FIG. 23 is a flowchart of control of the ordinary crimp binding process (the standard number of bindings) executed in step S715 of FIG. 12.

FIG. 23 illustrates an example of the "dual binding" performed by the crimp binding three times that is the number of crimp bindings (the number of execution of the post-processing) set as the standard number of bindings (see FIG. 13).

FIGS. 24A to 24H are diagrams illustrating the transition of positions of the edge binder 25 corresponding to the flowchart of FIG. 23 illustrating the control of the ordinary crimp binding (the standard number of bindings).

A detailed description of points common to the process described with reference to FIG. 12 may be omitted, and differences will be mainly described below.

Figure 24A:
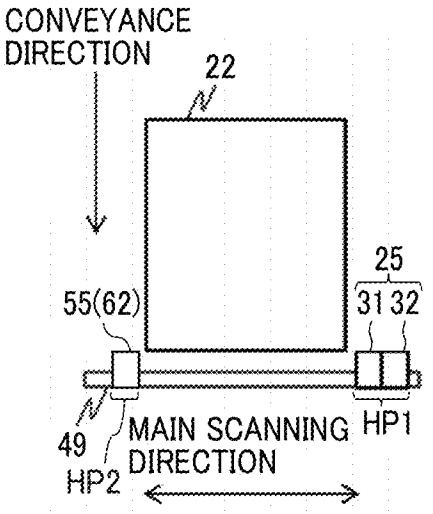
FIGS. 24A to 24H are diagrams illustrating positions of the edge binder during the execution of the crimp binding process illustrated in FIG. 23.

As illustrated in FIG. 24A, it is assumed that the edge binder 25 is located at the standby position HP at the start point of the dual binding performed by the crimp binding. First binding positions B1*a* to B1*c* that correspond to first liquid application positions B1*a* to B1*c* are separated from second binding positions B2*a* to B2*c* that correspond to second liquid application positions B2*a* to B2*c* in the main scanning direction. In FIG. 24, the number of sheets P to be bound is two (in other words, the given number of sheets N=2), but the present embodiment is not limited to this. In FIG. 24, the ordinary crimp bindings are performed three times in one binding portion.

Since the number of sheets instructed to be bound is 2 as described above, the controller 100*b* determines that the number of sheets instructed to be bound is smaller than 5 in the first binding number determination step S702 in the flowchart of FIG. 12 (No in step S702). Subsequently, the controller 100*b* determines whether any command to increase the number of bindings is present in the binding command information in step S713. Since the user sets the standard number of bindings as the number of crimp bindings as described above, the controller 100*b* determines that any command regarding the number of bindings is not present (No in step S709). The controller 100*b* controls the liquid applier 31 and the crimper 32 to execute the ordinary crimp binding with the "standard number of bindings" that is three in this example in step S715.

After the ordinary crimp binding process with the standard number of bindings is started, and before the first sheet P1 of the sheet bundle Pb is supplied to the internal tray 22, the controller 100*b* moves the edge binder 25 in the main scanning direction so that the crimper 32 faces the first binding position B1*a* of the first sheet P1, which corresponds to the first binding portion, in step S2101 as illustrated in FIG. 23.

Figure 24B:
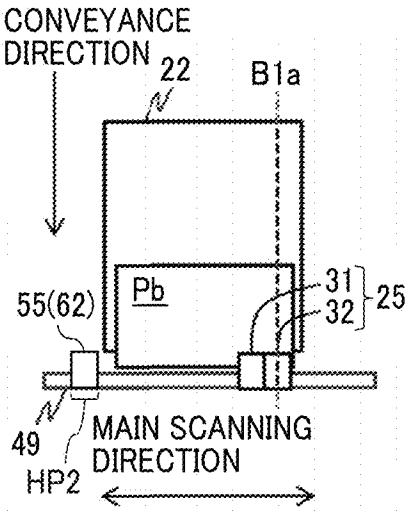

As illustrated in FIG. 24B, the controller 100*b* arranges the crimper 32 at a position facing the first binding position B1*a* in the first sheet P1. Subsequently, the first sheet P1 on which the image has been formed by the image forming apparatus 2 is accommodated on the internal tray 22 in step S2102. The controller 100*b* moves the side fences 24L and 24R to perform the jogging to the first sheet P1 placed on the internal tray 22 in step S2102.

After the side fences 24L and 24R complete the jogging to the first sheet P1 placed on the internal tray 22, the controller 100*b* determines whether the number of sheets P placed on the internal tray 22 has reached the given number of sheets N instructed by the binding command in step S2103. Since the given number of sheets N is two as described above, the controller 100*b* determines that the number of sheets P placed on the internal tray 22 does not reach the given number of sheets N (No in step S2103). As a result, the controller 100*b* returns to step S2102. The controller 100*b* arranges the crimper 32 at a position facing the first binding position B1*a*. Subsequently, a second sheet P2 is conveyed from the image forming apparatus 2 and accommodated on the internal tray 22 in step S2102. The controller 100*b* moves the side fences 24L and 24R to perform the jogging to the sheet bundle Pb of two sheets that are the first sheet P1 and the second sheet P2 placed on the internal tray 22 in step S2102.

Figure 24C:
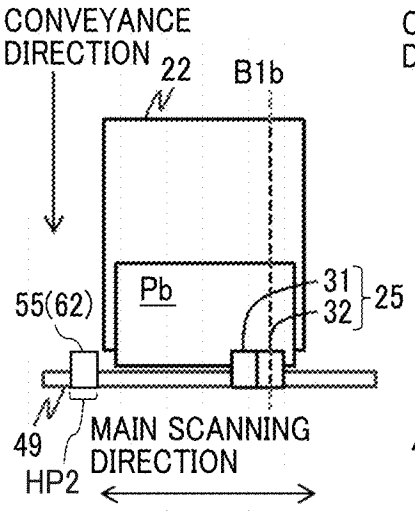

Subsequently, the controller 100*b* controls the crimper 32 to perform the first crimp binding at the first binding position B1*a* of the sheet bundle Pb, which corresponds to the first binding portion, in step S2104 as illustrated in FIG. 24B. Subsequently, as illustrated in FIG. 24C, the controller 100*b* controls the edge binder 25 to move in the main scanning direction so that the crimper 32 faces the first binding position B1*b* of the sheet bundle Pb, which is the second binding position corresponding to the first binding portion, in step S2104. The controller 100*b* controls the crimper 32 to perform the second crimp binding at the first binding position B1*b* of the sheet bundle Pb, which corresponds to the first binding portion, in step S2104.

Figure 24D:
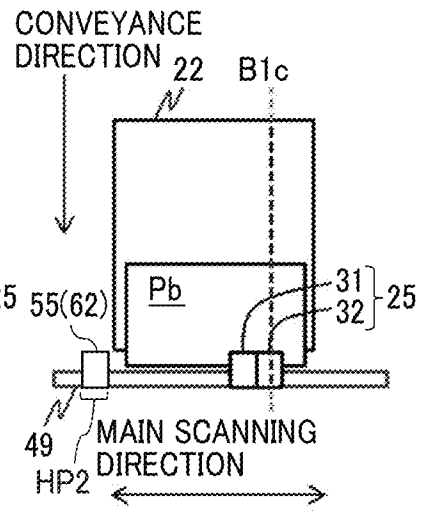

Subsequently, as illustrated in FIG. 24D, the controller 100*b* controls the edge binder 25 to move in the main scanning direction so that the crimper 32 faces the first binding position B1*c* of the sheet bundle Pb, which is the third binding position corresponding to the first binding portion, in step S2104. The controller 100*b* controls the crimper 32 to perform the third crimp binding at the first binding position B1*c* of the sheet bundle Pb, which corresponds to the first binding portion, in step S2104.

Figure 24E:
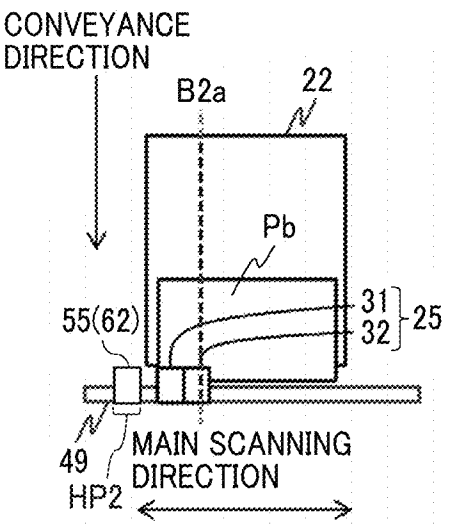

Subsequently, as illustrated in FIG. 24E, the controller 100*b* controls the edge binder 25 to move in the main scanning direction so that the crimper 32 faces the second binding position B2*a* of the sheet bundle Pb, which is the first binding position corresponding to the second binding portion, in step S2105. The controller 100*b* controls the crimper 32 to perform the first crimp binding at the second binding position B2*a* of the sheet bundle Pb, which corresponds to the second binding portion, in step S2106.

Figure 24F:
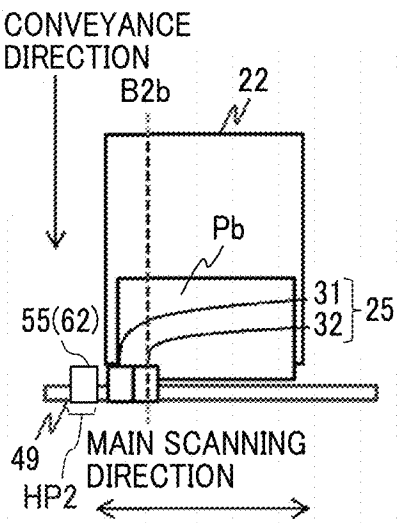

Subsequently, as illustrated in FIG. 24F, the controller 100*b* controls the edge binder 25 to move in the main scanning direction so that the crimper 32 faces the second binding position B2*b* of the sheet bundle Pb, which is the second binding position corresponding to the second binding portion, in step S2106. The controller 100*b* controls the crimper 32 to perform the second crimp binding at the second binding position B2*b* of the sheet bundle Pb, which corresponds to the second binding portion, in step S2106.

Figure 24G:
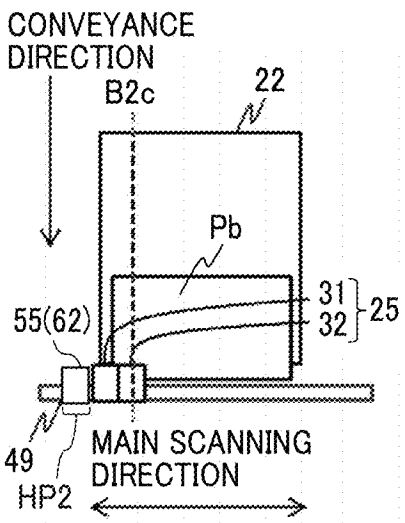

Subsequently, as illustrated in FIG. 24G, the controller 100*b* controls the edge binder 25 to move in the main scanning direction so that the crimper 32 faces the second binding position B2*c* of the sheet bundle Pb, which is the third binding position corresponding to the second binding portion, in step S2106. The controller 100*b* controls the crimper 32 to perform the third crimp binding at the second binding position B2*c* of the sheet bundle Pb, which corresponds to the second binding portion, in step S2106.

Figure 24H:
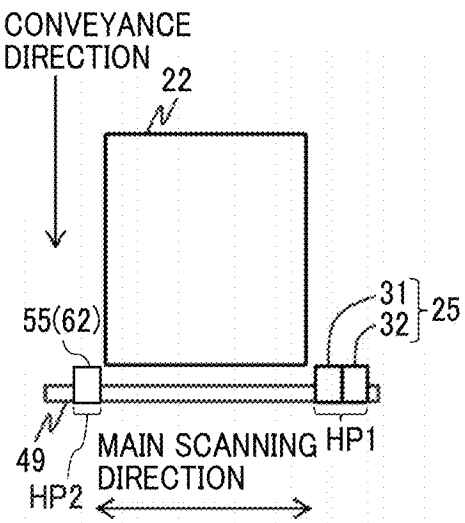

After the sheet bundle Pb is crimped at the first binding positions B1*a* to B1*c* and the second binding positions B2*a* to B2*c*, the controller 100*b* rotates the conveyance roller pair 15 to eject the crimped sheet bundle Pb to the second ejection tray 26 in step S2107. The controller 100*b* determines whether the number of sheet bundles Pb thus ejected to the second ejection tray 26 has reached the requested number of copies M indicated by the binding command in step S2108. When the controller 100*b* determines that the number of sheet bundles Pb thus ejected has not reached the requested number of copies M (No in step S2108), the controller 100*b* executes the operations of step S2102 and the following steps again. In other words, when the controller 100*b* determines that the number of sheet bundles Pb thus ejected has not reached the requested number of copies M (No in step S2108), the controller 100*b* repeats the operations of steps S2102 to S2108 until the number of sheet bundles Pb ejected to the second ejection tray 26 reaches the requested number of copies M. On the other hand, when the controller 100*b* determines that the number of sheet bundles Pb output to the second ejection tray 26 has reached the requested number of copies M (YES in step S2108), the controller 100*b* drives the edge binder movement motor 50 to move the edge binder 25 to the standby position HP as illustrated in FIG. 24H in step S2109. As described above, the ordinary crimp bindings can be executed under the condition of "dual binding" and the number of times of the crimp binding (the number of times of execution of the post-process) that is the standard number of bindings (three times).

Figure 25:
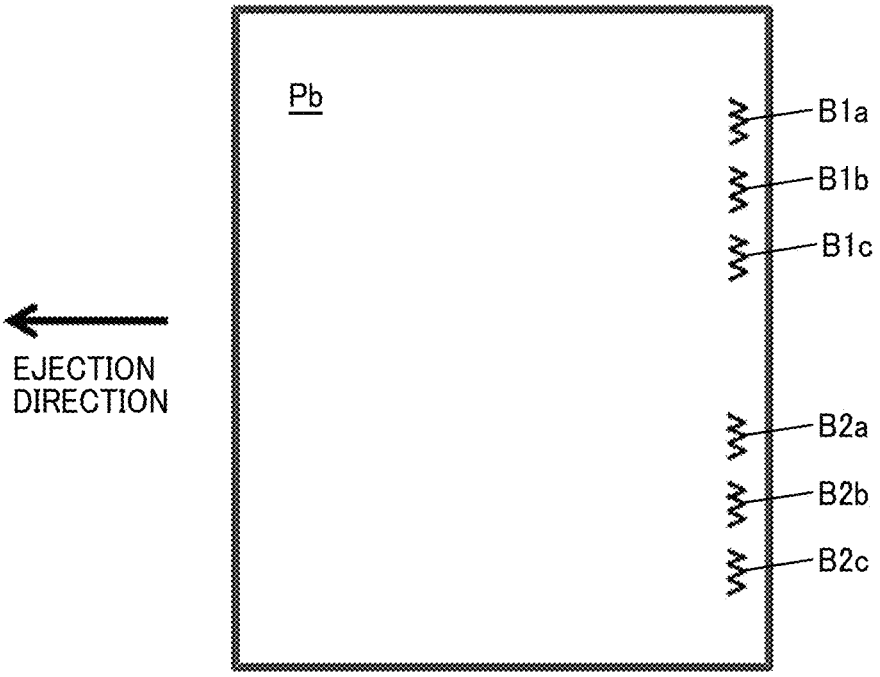
FIG. 25 is an image diagram of a sheet bundle after the crimp binding process illustrated in FIG. 23 in which the edge binder performs dual binding with the standard number of bindings.

FIG. 25 is an image diagram of the sheet bundle Pb after the ordinary crimp bindings are performed under the following conditions.

The user sets the "parallel binding" as the type of binding on the control panel 110. In addition, the user sets the "dual binding" and "the standard number of bindings (three times)" as "the number of crimp bindings (the number of times of execution of the post-processing" on the setting screen G1 illustrated in FIG. 13.

In the above description, moving the edge binder 25 in the main scanning direction moves the crimper 32 to the positions facing the first binding positions B1*a* to B1*c* and the second binding positions B2*a* to B1*c* of the sheet bundle Pb. However, the crimping teeth slider 322 of the crimper 32 may move the upper crimping teeth 32*a* and the lower crimping teeth 32*b* to the positions facing the first binding positions B1*a* to B1*c* and the second binding positions B2*a* to B1*c*.

As described above, the post-processing apparatus according to the present embodiment can change the number of crimp bindings (the number of times of execution of post-processing) for the sheet bundle Pb according to the type of post-processing and set an appropriate binding force (in other words, an appropriate binding strength) and an appropriate binding speed (in other words, appropriate productivity) according to the type of post-processing. The above-described configuration enhances the convenience of the users and the productivity of the post-processing apparatus 3.

Figure 35A:
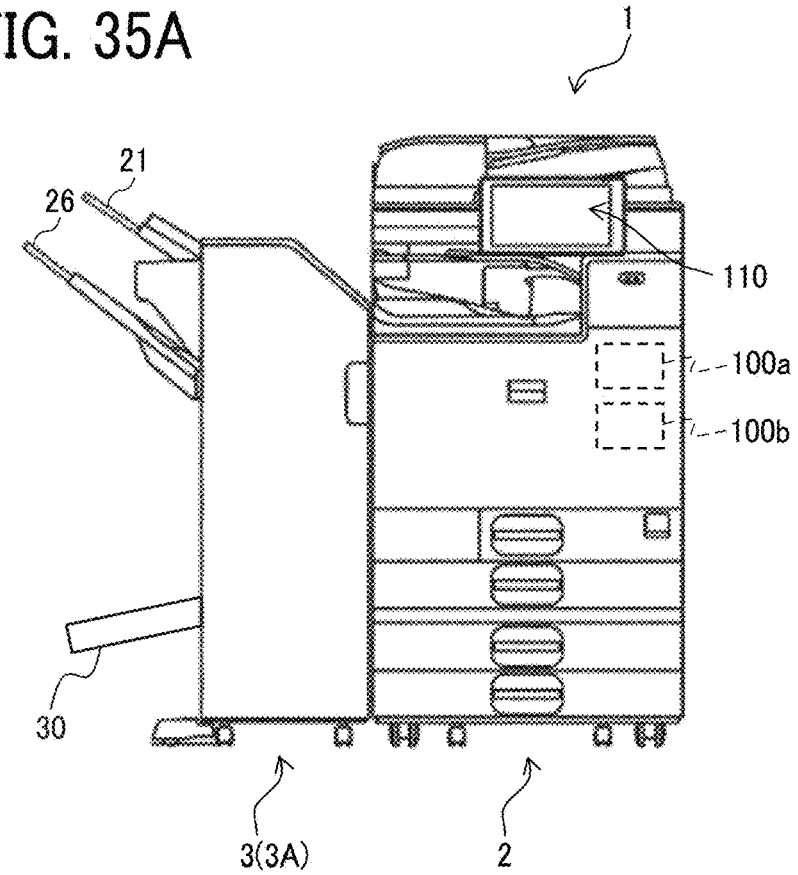
FIGS. 35A and 35B are diagrams each illustrating a post-processing apparatus including controllers as a first modification of the present embodiment.
Figure 35B:
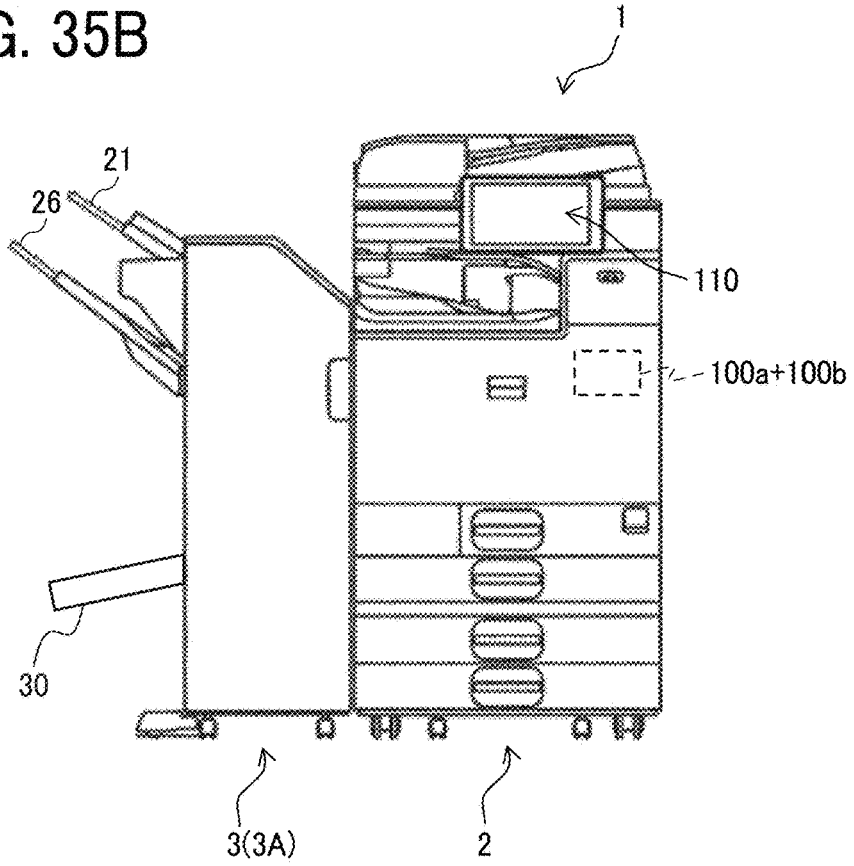

In the above description, the controller 100*b* of the post-processing apparatus 3 is provided separately from the controller 100*a* of the image forming apparatus 2 as illustrated in FIG. 1. However, embodiments of the present disclosure are not limited to the above-described configuration. For example, as illustrated in FIG. 35A, the controller 100*b* of the post-processing apparatus 3 may be disposed in the image forming apparatus 2. Further, as illustrated in FIG. 35B, the controller 100*b* of the post-processing apparatus 3 may be integrated with the controller 100*a* of the image forming apparatus 2.

Figure 36A:
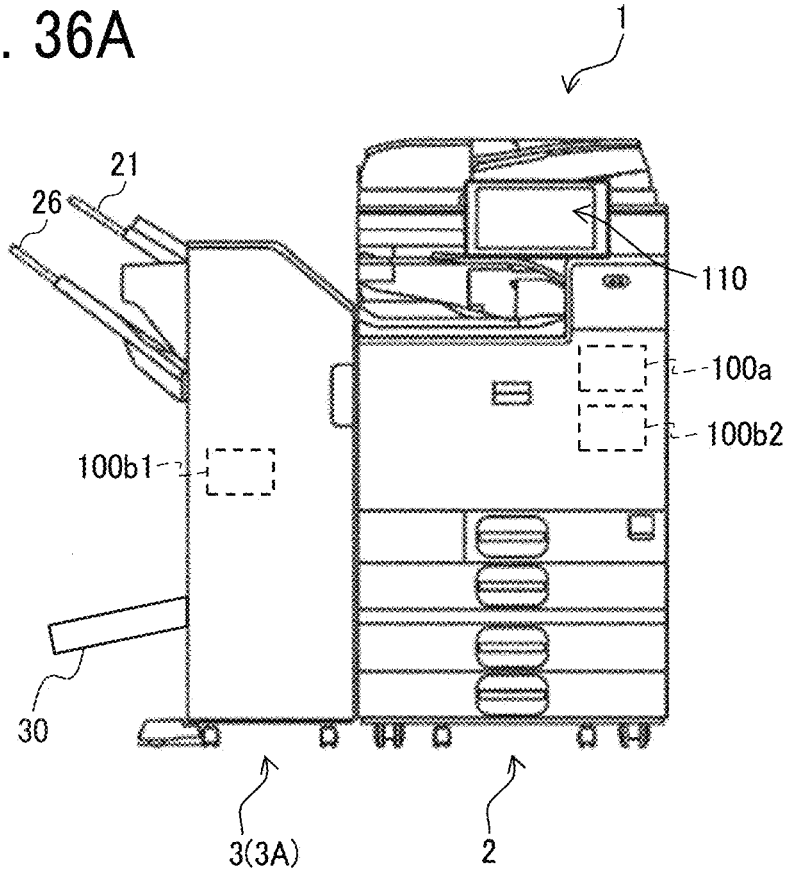
FIGS. 36A and 36B are diagrams each illustrating a post-processing apparatus including controllers as a second modification of the present embodiment.
Figure 36B:
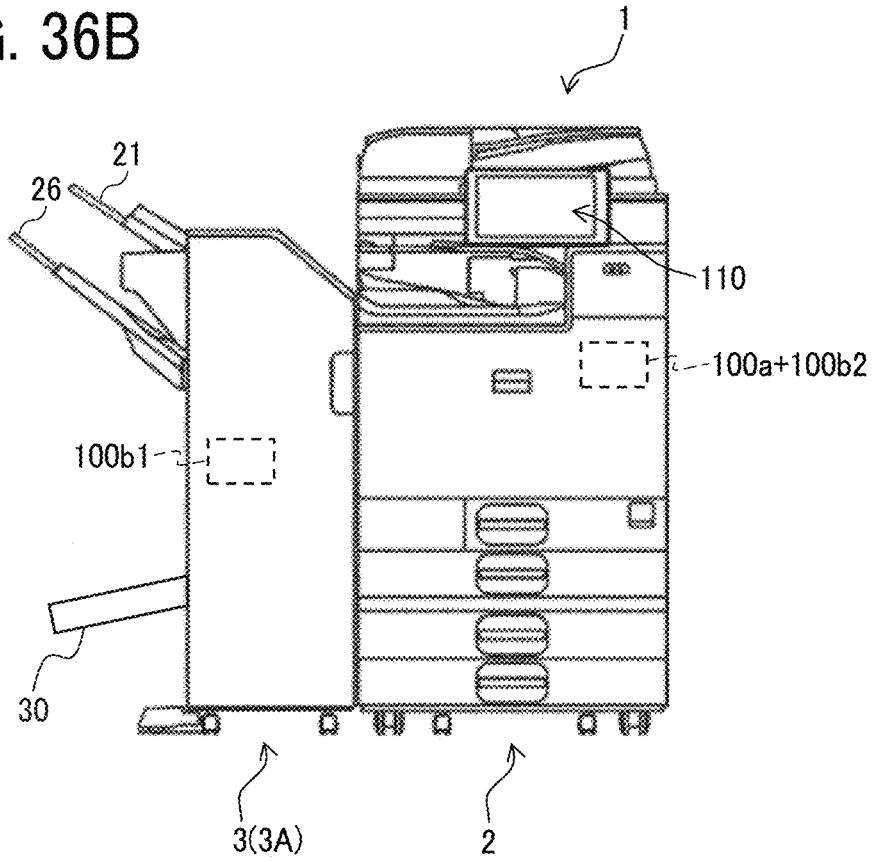

As illustrated in FIG. 36A, the controller 100*b* of the post-processing apparatus 3 may be divided into a controller 100*b*1 (e.g., a drive unit such as a motor) and a controller 100*b*2 (a detector such as a sensor) according to the function, and the controller 100*b*2 of the post-processing apparatus 3 may be disposed in the image forming apparatus 2. Further, as illustrated in FIG. 36B, the controller 100*b*2 of the post-processing apparatus 3 disposed in the image forming apparatus 2 may be integrated with the controller 100*a* of the image forming apparatus 2.

A description is given below of a post-processing apparatus 3 according to a second embodiment of the present disclosure.

Referring now to FIGS. 26 to 34, a description is given of a post-processing apparatus 3A according to the second embodiment of the present disclosure.

In the following description, components like those of the first embodiment are denoted by like reference numerals, and redundant descriptions thereof may be omitted.

The post-processing apparatus 3A according to the second embodiment includes an edge binder 251. The edge binder 251 is different from the edge binder 25 of the post-processing apparatus 3 according to the first embodiment in which the liquid applier 31 and the crimper 32 are arranged side by side. The edge binder 251 includes a crimper 32', and a liquid applier 131 is disposed at the first conveyance passage upstream from the edge binder 251 in a direction in which the sheet P is conveyed. Such a configuration allows a given number of sheets P to be stacked in advance after the liquid application process and conveyed to the crimper 32' of the edge binder 251 disposed downstream from the liquid applier 131 in the direction in which the sheet P is conveyed. Accordingly, the productivity of the binding process performed by the crimper 32' is enhanced.

Since the direction in which the conveyance roller pairs 10, 11, and 14 convey the sheet P is opposite to the "conveyance direction" defined above, the direction in which the conveyance roller pairs 10, 11, and 14 convey the sheet P is defined as an "opposite conveyance direction" in the following description. A direction that is orthogonal to both the opposite conveyance direction and the thickness direction of the sheet P is defined as the "main scanning direction" or the "width direction of the sheet P."

The liquid application position to which the liquid is applied on the sheet P or the sheet bundle Pb by the liquid applier 131 corresponds to the binding position on the sheet bundle Pb to be crimped and bound by the crimper 32'. For this reason, in the following description, the liquid application position and the binding position are denoted by the same reference sign (B1).

Figure 26:
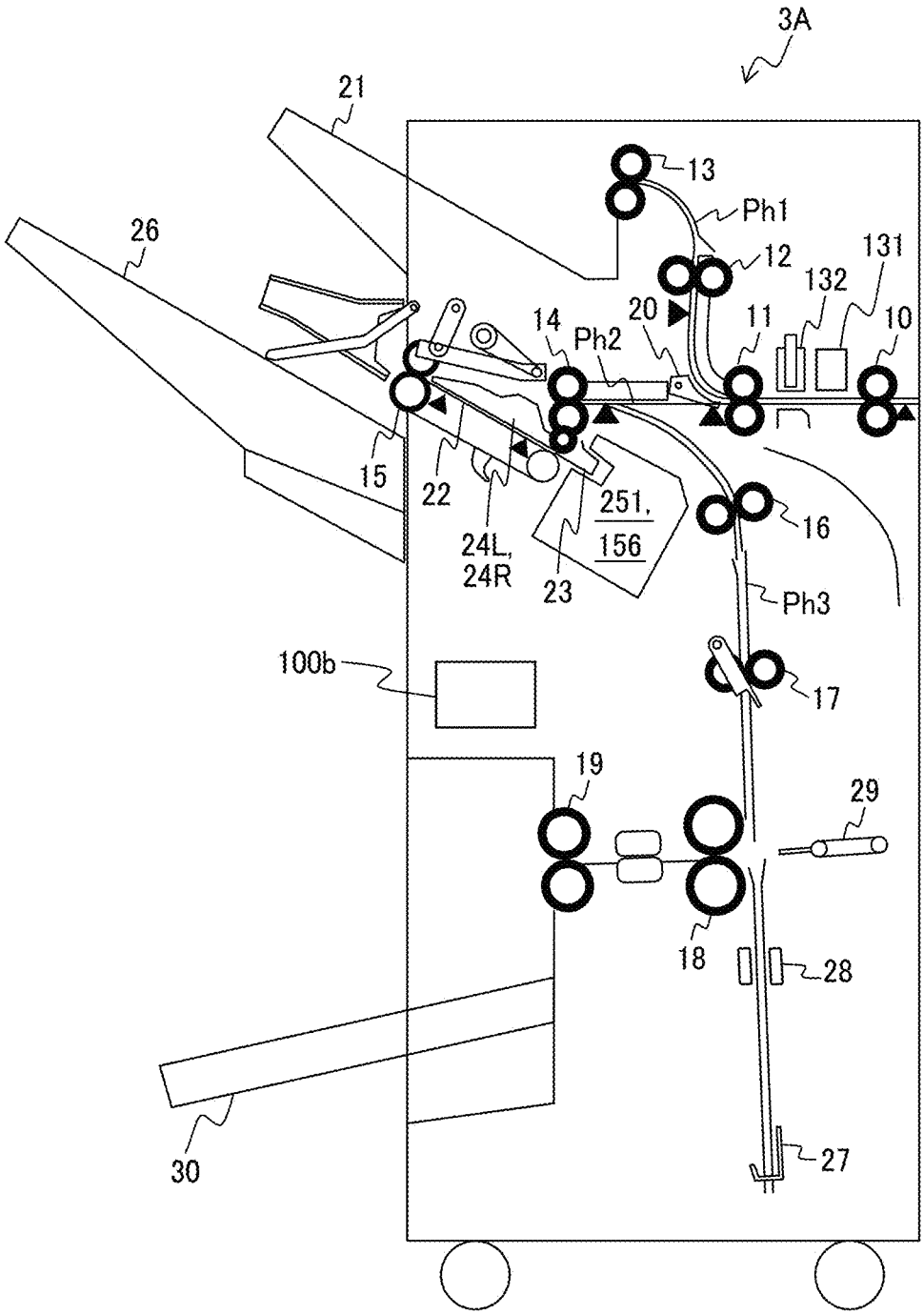
FIG. 26 is a diagram illustrating an internal configuration of a post-processing apparatus according to a second embodiment of the present disclosure.

FIG. 26 is a diagram illustrating an internal configuration of the post-processing apparatus 3A according to the second embodiment of the present disclosure.

Figure 27A:
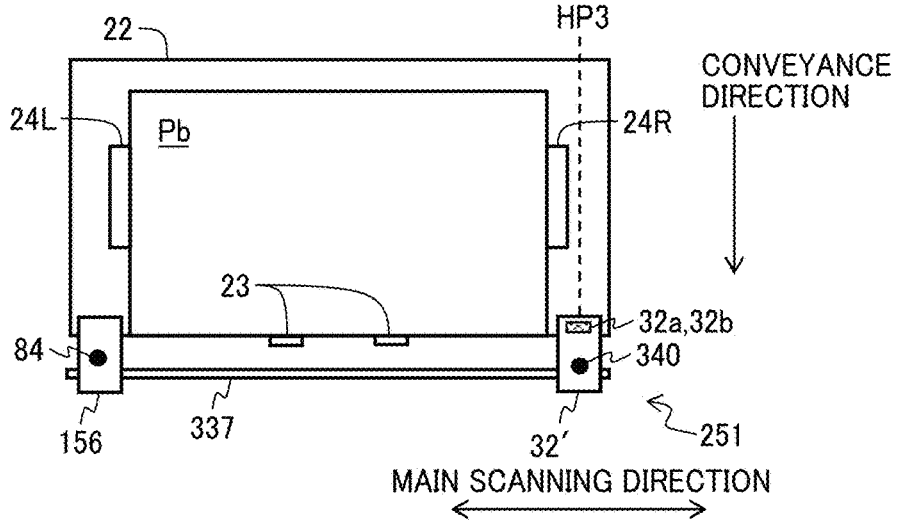
FIGS. 27A, 27B, and 27C are views of an internal tray of a post-processing apparatus according to the second embodiment, in the thickness direction of a sheet.
Figure 27B:
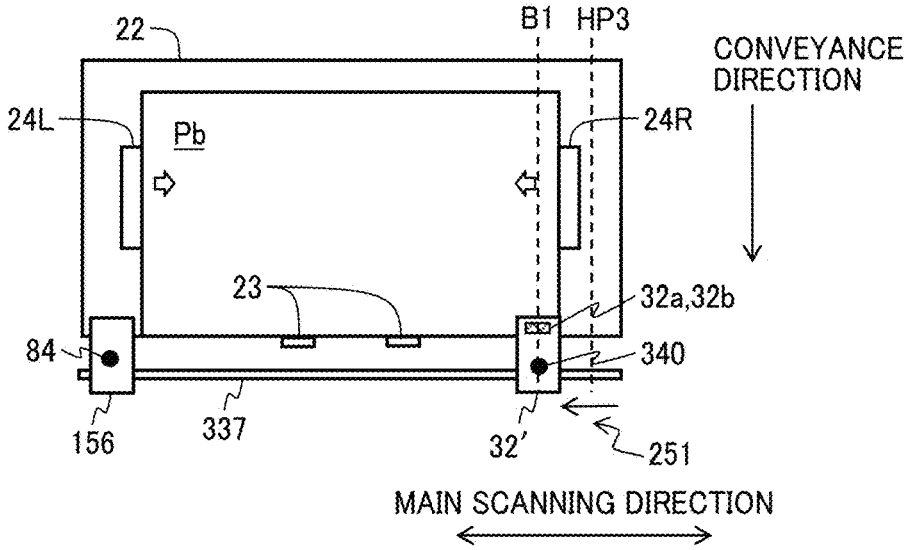
Figure 27C:
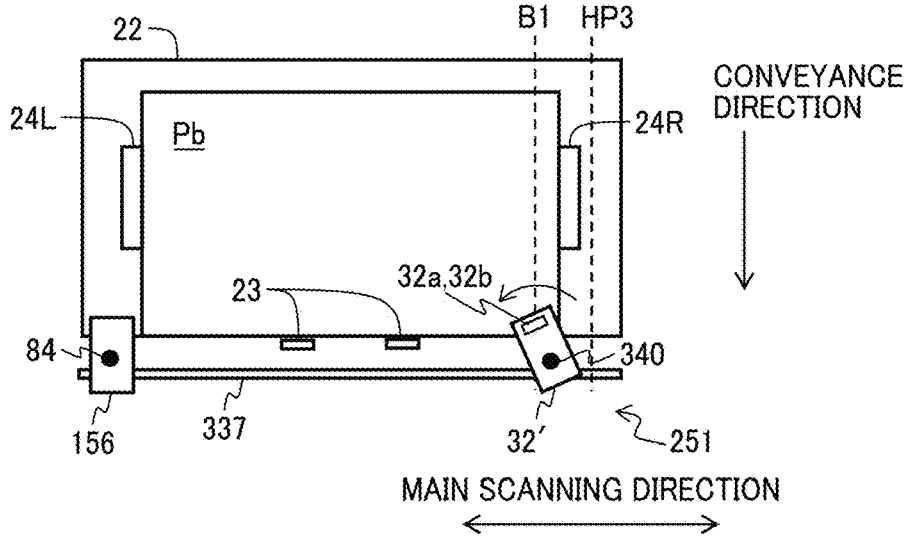
Figure 30A:
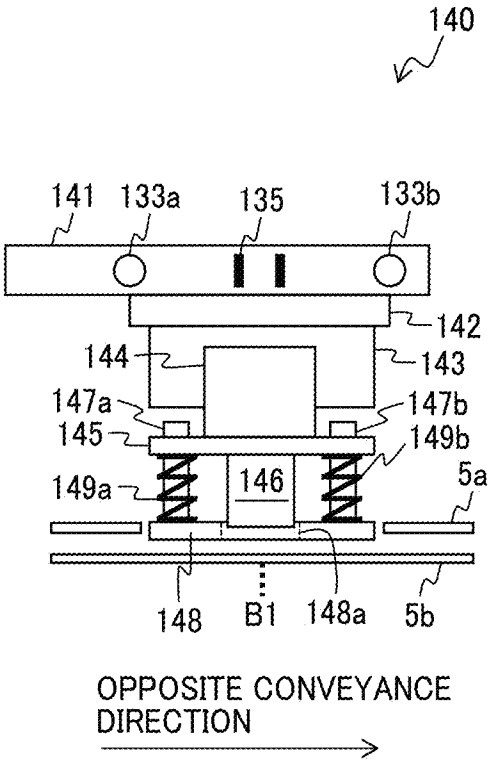
FIGS. 30A, 30B, and 30C are cross-sectional views of a liquid application unit of the liquid applier taken through XXV-XXV of FIG. 29A.
Figure 30B:
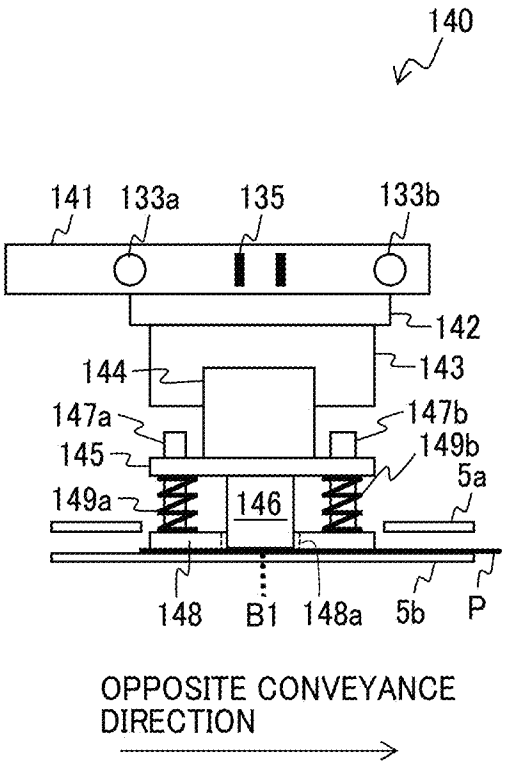
Figure 30C:
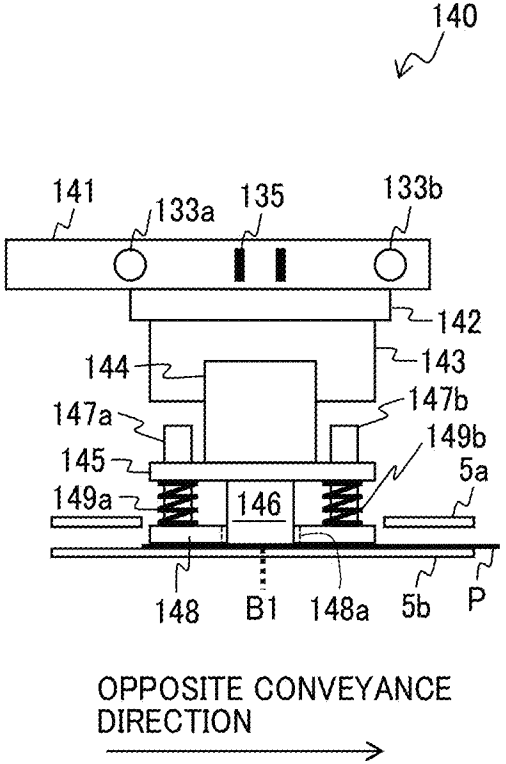

As illustrated in FIGS. 30A to 30C, the edge binder 251 includes the crimper 32'. As illustrated in FIGS. 27A to 27C, the crimper 32' and the staple binder 156 are disposed downstream from the internal tray 22 in the conveyance direction. In addition, the crimper 32' and the staple binder 156 are located to face a downstream end, in the conveyance direction, of the sheet bundle Pb placed on the internal tray 22 and is movable in the main scanning direction.

Further, the crimper 32' and the staple binder 156 are respectively rotatable in the forward and reverse directions about a crimper shaft 340 and a stapler shaft 84 both extending in the thickness direction of the sheet bundle Pb placed on the internal tray 22. In other words, the crimper 32' and the staple binder 156 can bind the sheet bundle Pb placed on the internal tray 22 at a desired angle and a desired position in the main scanning direction and perform, for example, corner oblique binding, parallel one-point binding, or parallel two-point binding.

The crimper 32' presses and deforms the sheet bundle Pb with the serrate upper crimping teeth 32*a* and the serrate lower crimping teeth 32*b* to bind the sheet bundle Pb. In the following description, such a binding way may be referred to as "crimp binding." In other words, the crimper 32' crimps and binds the sheet bundle Pb or performs the crimp binding on the sheet bundle Pb.

On the other hand, the staple binder 156 passes the staple through a binding position on the sheet bundle Pb placed on the internal tray 22 to staple the sheet bundle Pb.

FIGS. 27A, 27B, and 27C are schematic views of the internal tray 22 as viewed in the thickness direction of the sheet bundle Pb.

Figure 28:
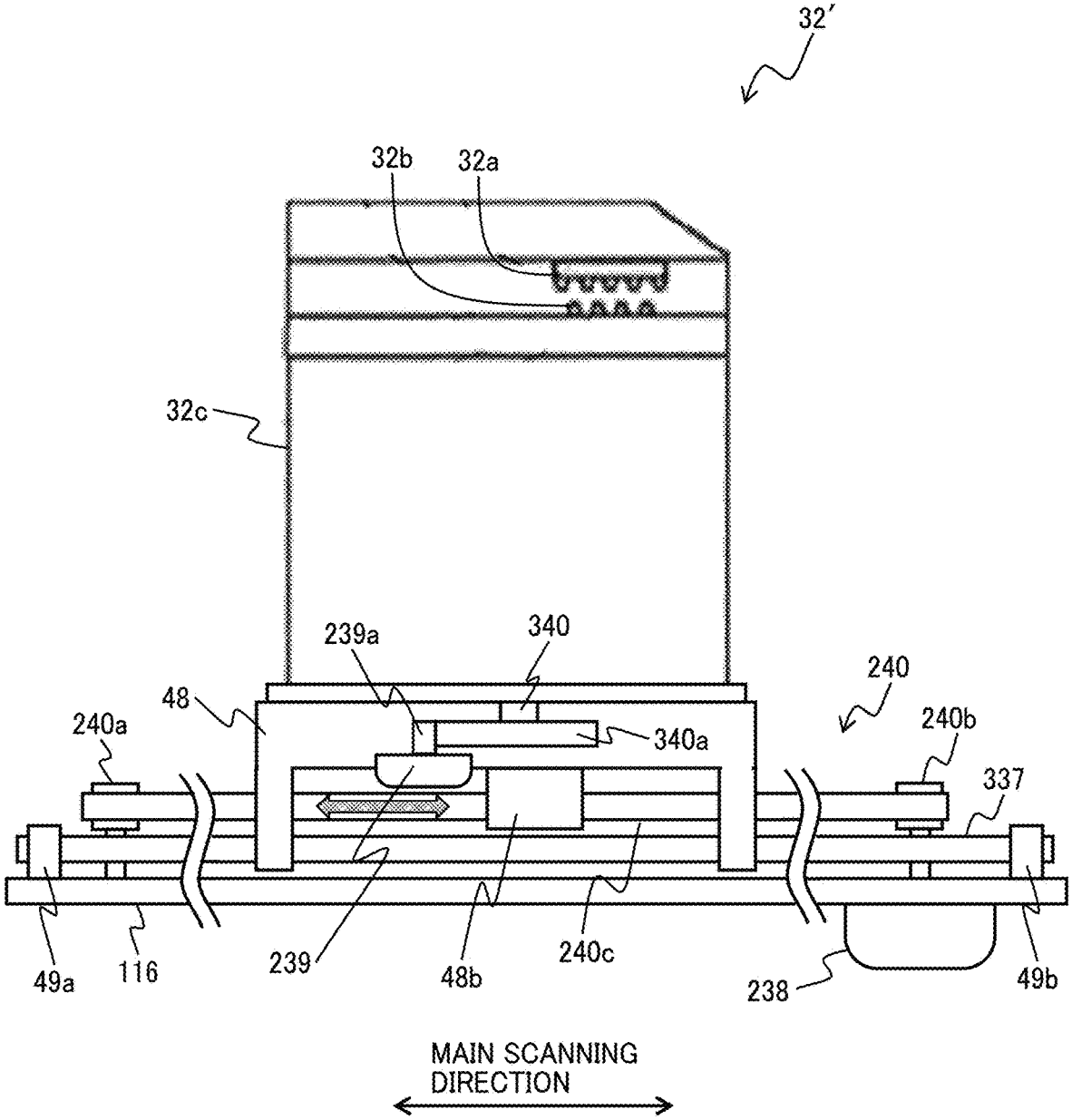
FIG. 28 is a schematic diagram illustrating the upstream side of a crimper of the post-processing apparatus of FIG. 26 viewed in a conveyance direction.

FIG. 28 is a schematic diagram illustrating the downstream side of the crimper 32' in the conveyance direction.

As illustrated in FIGS. 27A to 27C, the crimper 32' and the staple binder 156 are disposed downstream from the internal tray 22 in the conveyance direction. The crimper 32' is movable in the main scanning direction along the surface of the sheet bundle Pb placed on the internal tray 22. Further, the crimper 32' is rotatable in the forward and reverse directions about the crimper shaft 340 extending in the thickness direction of the sheet bundle Pb placed on the internal tray 22.

Similarly, the staple binder 156 is movable in the main scanning direction along the sheet bundle Pb. Further, the staple binder 156 is rotatable in the forward and reverse directions about a stapler shaft 84 extending in the thickness direction of the sheet bundle Pb. The other components of the staple binder 156 are similar to, even if not the same as, those of the staple binder 55 (see FIG. 9) of the post-processing apparatus 3 according to the first embodiment. For this reason, a detailed description thereof is omitted.

As illustrated in FIG. 28, the crimper 32' includes a guide rail 337 extending in the main scanning direction at a position downstream from the internal tray 22 in the conveyance direction. The crimper 32' includes a crimper movement motor 238 as a driving source. The base 48 supporting the crimping frame 32*c* has a fastening portion 48*b* for fastening the timing belt 240*c* at the bottom of the base 48. The driving force of the crimper movement motor 238 is transmitted to the base 48 by the drive transmission assembly 240 that includes the pullies 240*a* and 240*b*, the timing belt 240*c*, and the fastening portion 48*b*. By so doing, the crimper 32' is moved in the main scanning direction along the surface of the sheet bundle Pb placed on the internal tray 22, in other words, along the guide rail 337. Further, the crimper shaft 340 including a drive transmission gear 340*a* is fixed to the bottom face of the crimping frame 32*c* that holds the components of the crimper 32'.

The crimper shaft 340 and the drive transmission gear 340*a* are held by a base 48 on which the crimping frame 32*c* is disposed, so as to be rotatable in the forward and reverse directions. The drive transmission gear 340*a* meshes with an output gear 239*a* of a crimper pivot motor 239. The crimper 32' is rotated in the forward and reverse directions on the base 48 about the crimper shaft 340 extending in the thickness direction of the sheet P placed on the internal tray 22, by a driving force transmitted from the crimper pivot motor 239 to the crimper shaft 340 via the output gear 239*a* and the drive transmission gear 340*a*. The guide rail 337, the crimper movement motor 238, the crimper pivot motor 239, the crimper shaft 340, and the drive transmission assembly 240 constitute at least part of a driving assembly of the crimper 32' according to the present embodiment.

The crimper 32' is movable between a standby position HP3 illustrated in FIG. 27A and a position where the crimper 32' faces the first binding position B1 illustrated in FIGS. 27B and 27C. The standby position HP3 is away in the main scanning direction from the sheet bundle Pb placed on the internal tray 22. For example, in FIGS. 27A, 27B, and 27C, the standby position HP is distanced to the right of the sheet bundle Pb along the main scanning direction. The first binding position B1 is a position on the sheet bundle Pb placed on the internal tray 22. However, the specific position of the first binding position B1 is not limited to the position illustrated in FIGS. 27B and 27C. The first binding position B1 may be one or more positions along the main scanning direction at the downstream end, in the conveyance direction, of the sheet P.

The posture of the crimper 32' changes between the parallel binding posture illustrated in FIG. 27B and the oblique binding posture illustrated in FIG. 27C. In other words, the crimper 32' is rotatable in the forward and reverse directions about the crimper shaft 340. The parallel binding posture is a posture of the crimper 32' in which the longitudinal direction of the upper crimping teeth 32*a* and the lower crimping teeth 32*b* (in other words, a rectangular crimp binding trace) is along the main scanning direction. The oblique binding posture is a posture of the crimper 32' in which the longitudinal direction of the upper crimping teeth 32*a* and the lower crimping teeth 32*b* (in other words, the rectangular crimp binding trace) is inclined with respect to the main scanning direction.

The pivot angle, which is an angle of the upper crimping teeth 32*a* and the lower crimping teeth 32*b* with respect to the main scanning direction, in the oblique binding posture is not limited to the angle illustrated in FIG. 27C. The pivot angle in the oblique binding posture may be any angle provided that the upper crimping teeth 32*a* and the lower crimping teeth 32*b* face the sheet bundle Pb placed on the internal tray 22.

The post-processing apparatus 3A includes the liquid applier 131 and a hole punch 132 serving as a processing device. The liquid applier 131 and the hole punch 132 are disposed upstream from the internal tray 22 in the opposite conveyance direction. In addition, the liquid applier 131 and the hole punch 132 are disposed at different positions in the opposite conveyance direction to simultaneously face one sheet P that is conveyed by the conveyance roller pairs 10 to 19.

Figure 34:
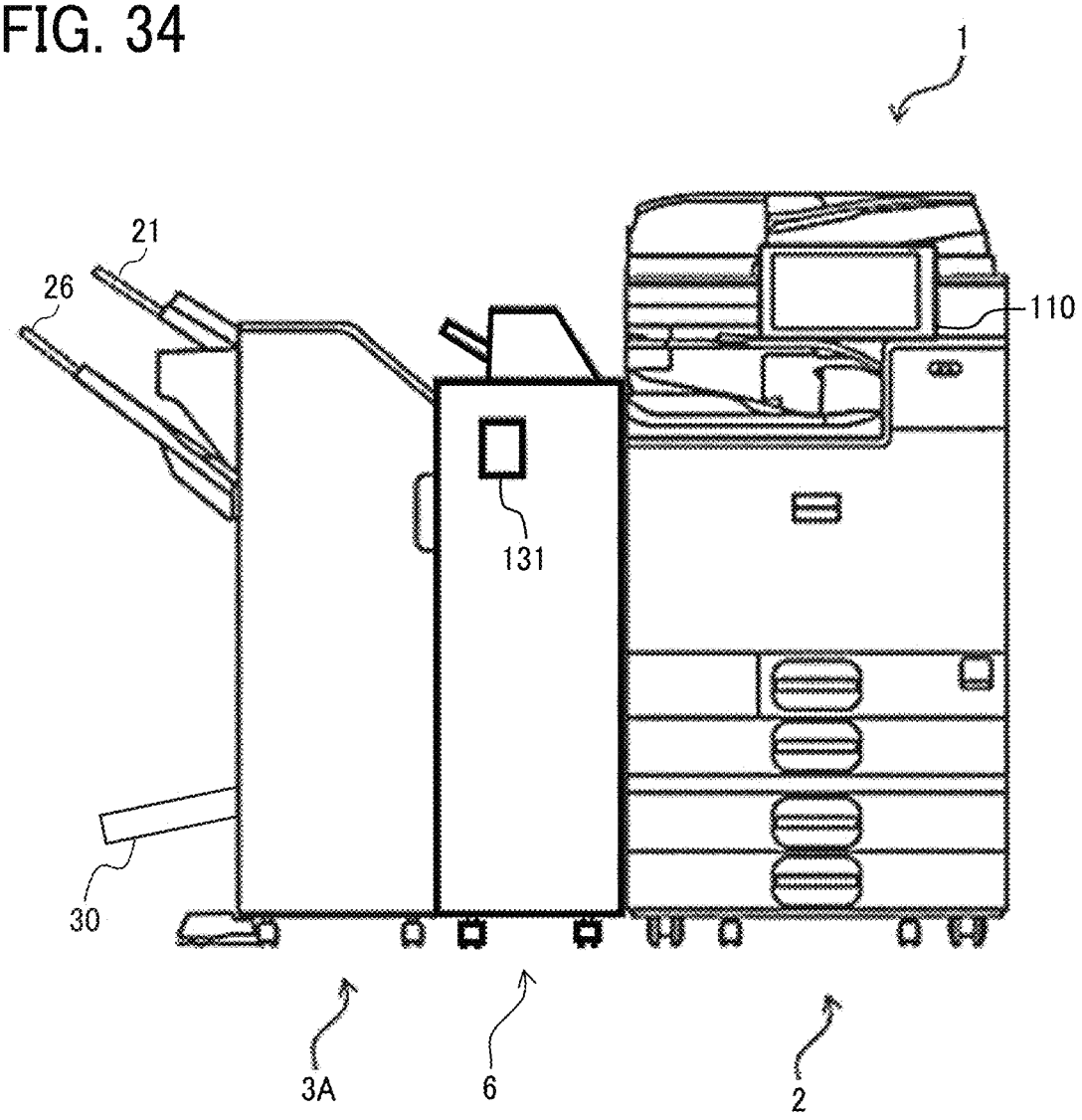
FIG. 34 is a diagram illustrating the overall configuration of an image forming system according to a modification of the embodiment illustrated in FIG. 1.

The liquid applier 131 and the hole punch 132 according to the present embodiment are disposed between the conveyance roller pairs 10 and 11. However, the arrangement of the liquid applier 131 is not limited to the example of FIG. 26. For example, in a case where an inserter 6 is disposed between the image forming apparatus 2 and the post-processing apparatus 3A as illustrated in FIG. 34, the liquid applier 131 may be disposed inside the inserter 6 located upstream from the post-processing apparatus 3A in a direction in which the sheet P is conveyed from the image forming apparatus 2 to the post-processing apparatus 3A. Examples of the inserter 6 include, but are not limited to, an apparatus that allows a pre-printed medium, which is to be conveyed to the post-processing apparatus 3A together with the sheet P conveyed from the image forming apparatus 2, to be fed as a cover sheet, an insertion sheet, or a partition sheet without passing through the image forming apparatus 2.

Figure 29A:
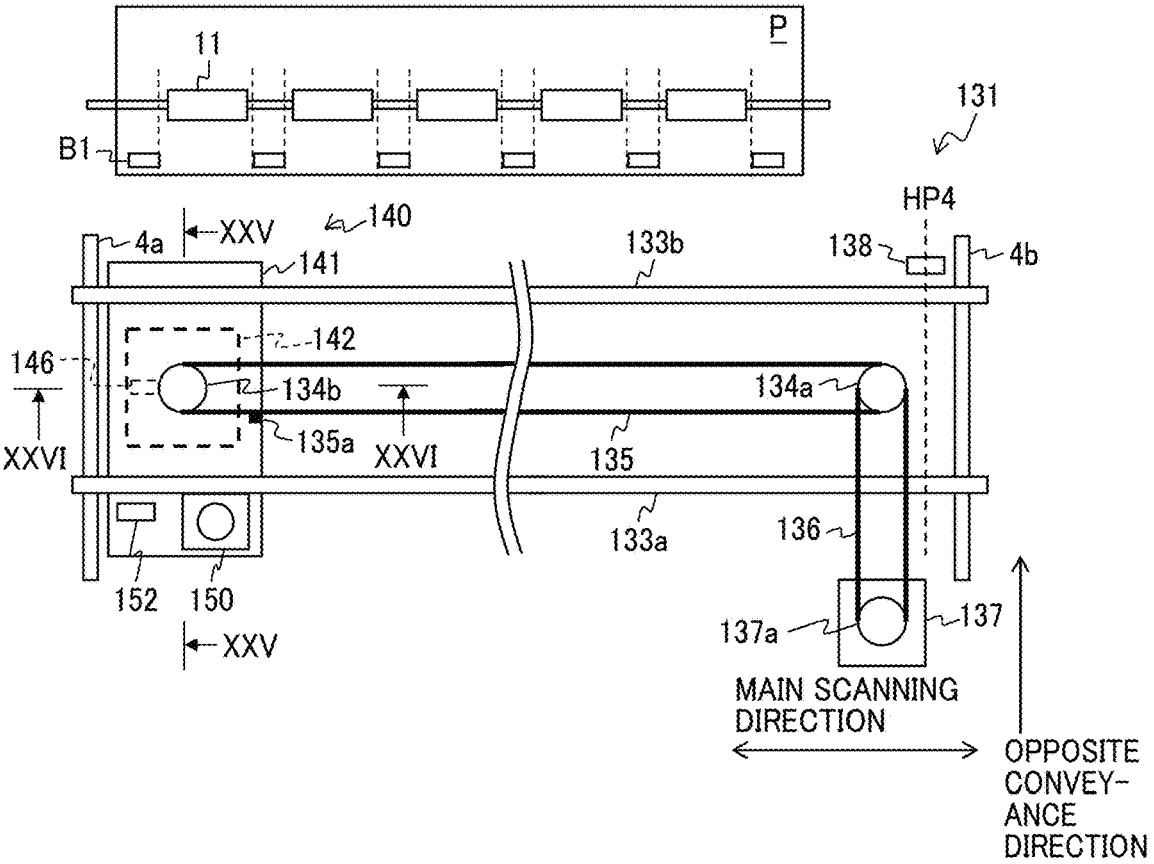
FIGS. 29A and 29B are views of a liquid applier according to the second embodiment, in the thickness direction of the sheet.

As illustrated in FIG. 29A, the conveyance roller pair 11 is located so as not to overlap, in the main scanning direction, the first liquid application position B1 on the sheet P to which the liquid is applied by a liquid application head 146 of the liquid applier 131. This arrangement is to prevent the amount of liquid at the first liquid application position B1 from decreasing due to the multiple roller pairs pressing the sheet P at the first liquid application position B1 when the conveyance roller pair 11 conveys the sheet P. As a result, when the sheet P reaches the crimper 32' disposed downstream from the liquid applier 131 in the opposite conveyance direction, the amount of liquid at the first liquid application position B1 is sufficient to maintain the binding strength. Accordingly, the binding strength of the sheet bundle Pb is prevented from decreasing due to a decrease in the amount of liquid at the first liquid application position B1 (corresponding to the first binding position B1) while the sheet P is conveyed.

In addition, the multiple roller pairs of the conveyance roller pair 11 that is located so as not to overlap the first liquid application position B1 on the sheet P in the main scanning direction prevents the conveying performance of the sheet P from being worse due to the adhesion of liquid to the multiple roller pairs and further prevents a conveyance jam caused by the worsened conveying performance of the sheet P.

Although only the conveyance roller pair 11 has been described above, the multiple roller pairs of the conveyance roller pairs 14 and 15 are preferably located so as not to overlap the first liquid application position B1 on the sheet P in the main scanning direction, like the multiple roller pairs of the conveyance roller pair 11.

The liquid applier 131 applies liquid to the sheet P that is conveyed by the conveyance roller pairs 10 and 11. In the following description, the application of liquid may be referred to as "liquid application." The hole punch 132 punches a hole in the sheet P that is conveyed by the conveyance roller pairs 10 and 11 such that the hole penetrates the sheet P in the thickness direction of the sheet P. The processing device disposed near the liquid applier 131 is not limited to the hole punch 132. Alternatively, the processing device may be an inclination corrector that corrects an inclination or skew of the sheet P that is conveyed by the conveyance roller pairs 10 and 11.

Figure 29B:
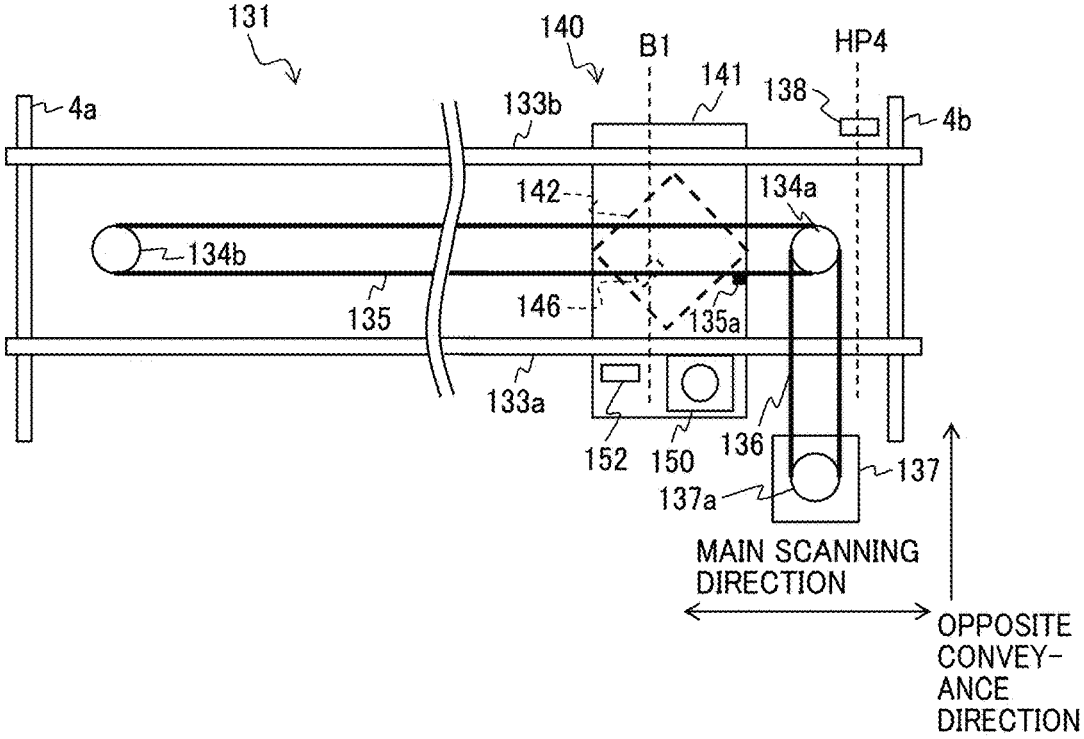

FIGS. 29A and 29B are views of the liquid applier 131 in the thickness direction of the sheet P, according to the second embodiment of the present disclosure.

FIGS. 30A to 30C are cross-sectional views of a liquid application unit 140 of the liquid applier 131 taken along line XXV-XXV of FIG. 29A.

Figure 31A:
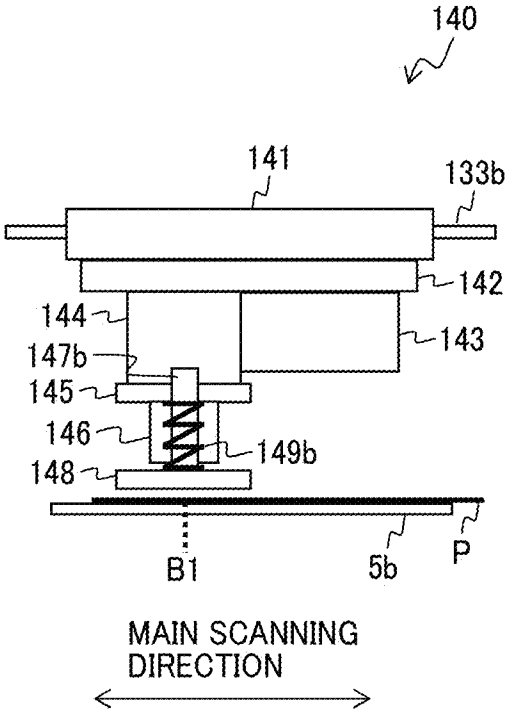
FIGS. 31A, 31B, and 31C are cross-sectional views of the liquid application unit of the liquid applier according to the second embodiment, taken along a line XXVI-XXVI of FIG. 29A.
Figure 31B:
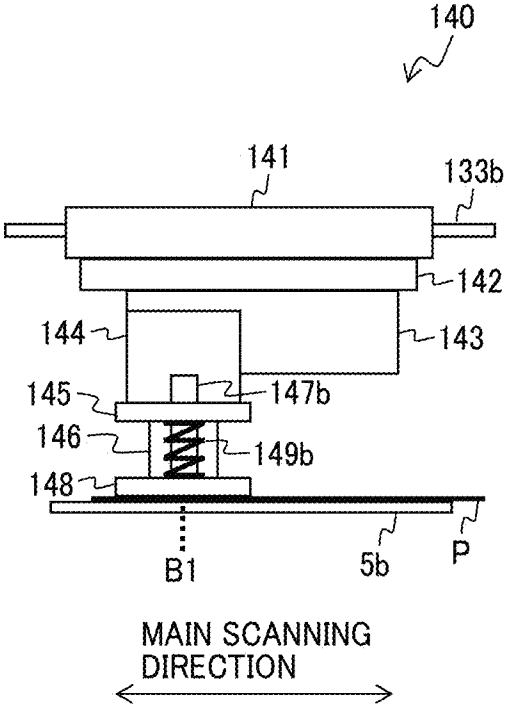
Figure 31C:
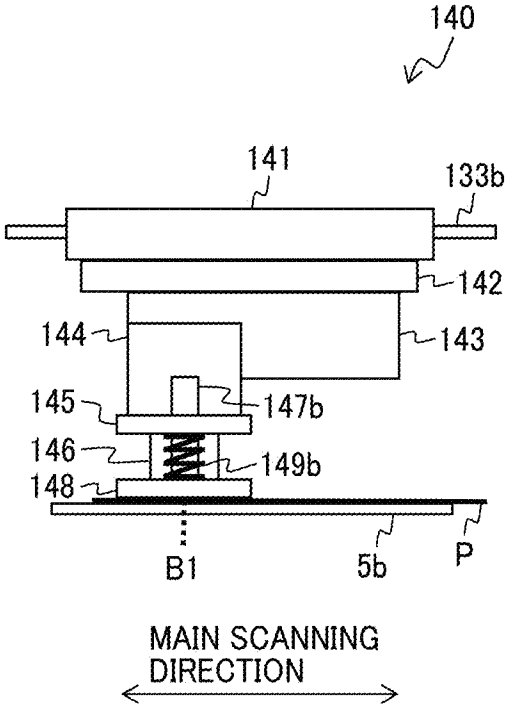

FIGS. 31A to 31C are cross-sectional views of the liquid application unit 140 of the liquid applier 131 taken along line XXVI-XXVI of FIG. 29A.

As illustrated in FIGS. 29A to 31C, the liquid applier 131 includes a pair of guide shafts 133*a* and 133*b*, a pair of pulleys 134*a* and 134*b*, endless annular belts 135 and 136, a liquid applier movement motor 137, a standby position sensor 138, and the liquid application unit 140.

The guide shafts 133*a* and 133*b*, each extending in the main scanning direction, are spaced apart from each other in the opposite conveyance direction. The pair of guide shafts 133*a* and 133*b* are supported by a pair of side plates 4*a* and 4*b* of the post-processing apparatus 3A. The pair of guide shafts 133*a* and 133*b* support the liquid application unit 140 such that the liquid application unit 140 can move in the main scanning direction.

The pair of pulleys 134*a* and 134*b* is disposed between the pair of guide shafts 133*a* and 133*b* in the opposite conveyance direction. The pair of pulleys 134*a* and 134*b* are spaced apart from each other in the main scanning direction. The pair of pulleys 134*a* and 134*b* are supported by a frame of the post-processing apparatus 3A so as to be rotatable in the forward and reverse directions about the respective shafts extending in the thickness direction of the sheet P.

The endless annular belt 135 is looped around the pair of pulleys 134*a* and 134*b*. The endless annular belt 135 is coupled to the liquid application unit 140 by a connection 135*a*. The endless annular belt 136 is entrained around the pulley 134*a* and a driving pulley 137*a* that is fixed to an output shaft of the liquid applier movement motor 137. The liquid applier movement motor 137 generates a driving force to move the liquid application unit 140 in the main scanning direction.

As the liquid applier movement motor 137 rotates, the endless annular belt 136 circulates around the pulley 134*a* and the driving pulley 137*a* to rotate the pulley 134*a*. As the pulley 134*a* rotates, the endless annular belt 135 circulates around the pair of pulleys 134*a* and 134*b*. As a result, the liquid application unit 140 moves in the main scanning direction along the pair of guide shafts 133*a* and 133*b*. The liquid application unit 140 reciprocates in the main scanning direction in response to the rotation direction of the liquid applier movement motor 137 being switched.

The standby position sensor 138 detects that the liquid application unit 140 has reached a standby position HP4 (see FIGS. 29A and 29B) in the main scanning direction. The standby position sensor 138 then outputs a standby position signal indicating the detection result to the controller 100*b*, which will be described below with reference to FIG. 32. The standby position sensor 138 is, for example, an optical sensor including a light emitter and a light receiver. The liquid application unit 140 at the standby position HP4 blocks an optical path between the light emitter and the light receiver. The standby position sensor 138 outputs the standby position signal in response to the light output from the light emitter not being received by the light receiver. The specific configuration of the standby position sensor 138 is not limited to the configuration described above.

As illustrated in FIGS. 30A to 30C, the conveyance passage inside the post-processing apparatus 3A is defined by an upper guide plate 5*a* and a lower guide plate 5*b*, which are apart from each other in the thickness direction of the sheet P. The liquid application unit 140 is located to face an opening of the upper guide plate 5*a*. In other words, the liquid application unit 140 is disposed to face the conveyance passage (a position at which the liquid application unit 140 is to face the sheet P conveyed along the conveyance passage) through the opening of the upper guide plate 5*a*.

Figure 32:
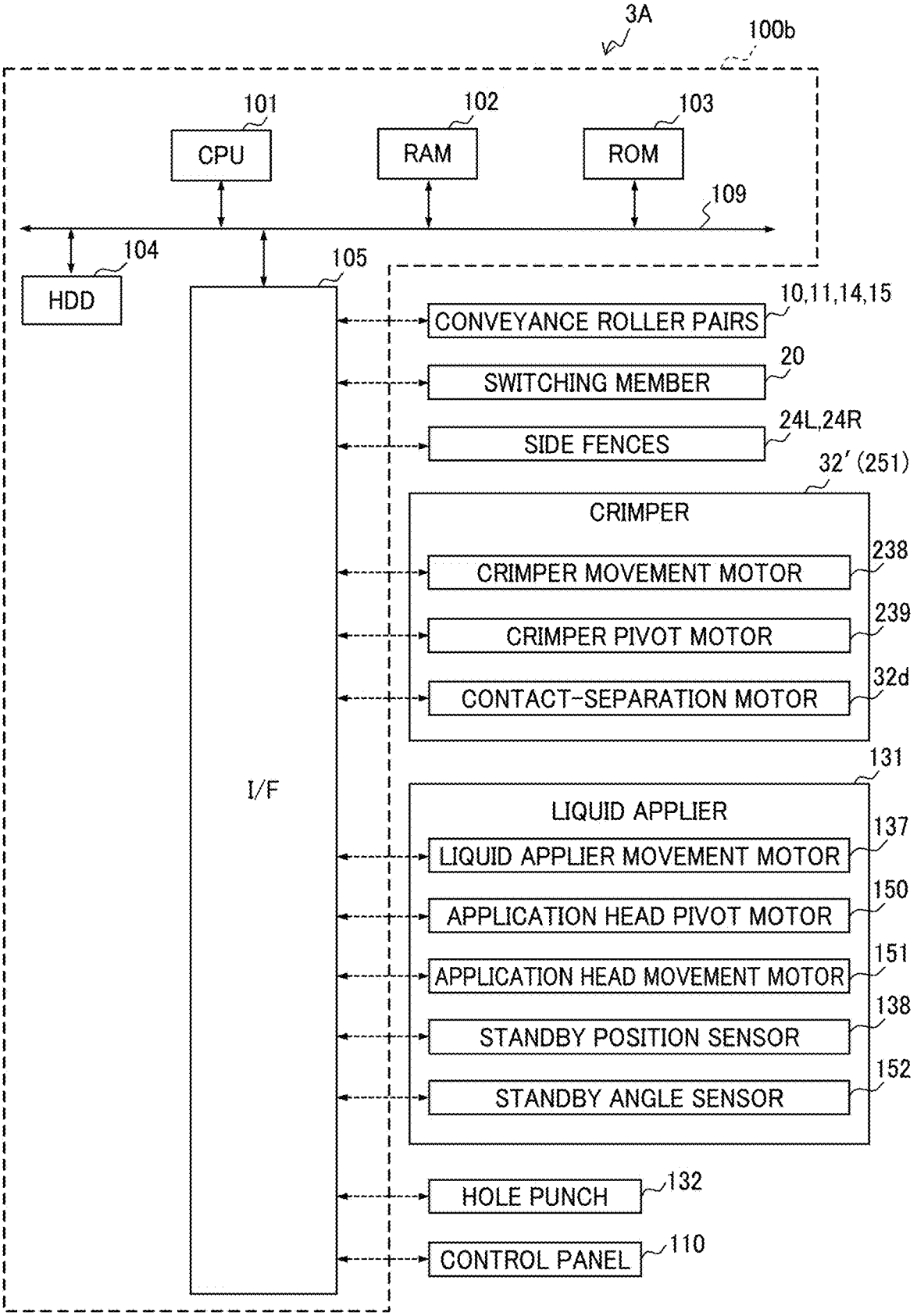
FIG. 32 is a block diagram illustrating a hardware configuration of the post-processing apparatus of FIG. 26 to control the operation of the post-processing apparatus.

As illustrated in FIGS. 29A to 31C, the liquid application unit 140 includes a base 141, a rotary bracket 142, a liquid storage tank 143, an application head mover 144, a holder 145, the liquid application head 146, columns 147*a* and 147*b*, a pressure plate 148, coil springs 149*a* and 149*b*, the application head pivot motor 150, the application head movement motor 151 (see FIG. 32), and a standby angle sensor 152 (see FIG. 32).

The base 141 is supported by the pair of guide shafts 133*a* and 133*b* so as to be slidable in the main scanning direction. The base 141 is coupled to the endless annular belt 135 by the connection 135*a*. The base 141 supports the components of the liquid application unit 140 such as the rotary bracket 142, the liquid storage tank 143, the application head mover 144, the holder 145, the liquid application head 146, the columns 147*a* and 147*b*, the pressure plate 148, the coil springs 149*a* and 149*b*, the application head pivot motor 150, the application head movement motor 151, and the standby angle sensor 152.

The rotary bracket 142 is attached to the lower face of the base 141 so as to be rotatable in the forward and reverse directions about an axis extending in the thickness direction of the sheet P. The rotary bracket 142 is rotated with respect to the base 141 by a driving force transmitted from the application head pivot motor 150. The rotary bracket 142 retains the liquid storage tank 143, the application head mover 144, the holder 145, the liquid application head 146, the columns 147*a* and 147*b*, the pressure plate 148, and the coil springs 149*a* and 149*b*.

The standby angle sensor 152, which is also illustrated in FIG. 32, detects that the rotary bracket 142 has reached a standby angle. The standby angle sensor 152 then outputs a standby angle signal indicating the detection result to the controller 100*b*. The standby angle is, for example, an angle for the parallel binding. The standby angle sensor 152 is, for example, an optical sensor including a light emitter and a light receiver. The rotary bracket 142 at the standby angle blocks an optical path between the light emitter and the light receiver. The standby angle sensor 152 outputs the standby angle signal in response to the light output from the light emitter not being received by the light receiver. The specific configuration of the standby angle sensor 152 is not limited to the configuration described above.

FIG. 29A illustrates the rotary bracket 142 in a position for the parallel binding that is performed by the crimper 32' disposed downstream from the liquid applier 131 in a direction in which the sheet P is conveyed.

FIG. 29B illustrates the rotary bracket 142 in a position for the oblique binding (i.e., corner binding) that is performed by the crimper 32' disposed downstream from the liquid applier 131 in the direction in which the sheet P is conveyed.

The liquid storage tank 143 stores liquid to be applied to the sheet P. The application head mover 144 is attached to the liquid storage tank 143 so as to be movable (e.g., up and down) in the thickness direction of the sheet P. The application head mover 144 is moved with respect to the liquid storage tank 143 by a driving force transmitted from the application head movement motor 151. The holder 145 is attached to a lower end of the application head mover 144. The liquid application head 146 projects from the holder 145 toward the conveyance passage (downward in the present embodiment). The liquid that is stored in the liquid storage tank 143 is supplied to the liquid application head 146. The liquid application head 146 is made of a material having a relatively high liquid absorption (e.g., sponge or fiber).

The columns 147*a* and 147*b* project downward from the holder 145 around the liquid application head 146. The columns 147*a* and 147*b* are movable relative to the holder 145 in the thickness direction. The columns 147*a* and 147*b* have respective lower ends holding the pressure plate 148. The pressure plate 148 has a through hole 148*a* at a position where the through hole 148*a* faces the liquid application head 146. The coil springs 149*a* and 149*b* are fitted around the columns 147*a* and 147*b*, respectively, between the holder 145 and the pressure plate 148. The coil springs 149*a* and 149*b* bias the columns 147*a* and 147*b* and the pressure plate 148 downward with respect to the holder 145.

As illustrated in FIGS. 30A and 31A, before the sheet P is conveyed to the position where the sheet P faces the opening of the upper guide plate 5*a*, the pressure plate 148 is positioned at or above the opening. Subsequently, when the sheet P that is conveyed by the conveyance roller pairs 10 and 11 stops at a position where the first liquid application position B1 on the sheet P faces the opening, the application head movement motor 151 is rotated in a first direction. As a result, the application head mover 144, the holder 145, the liquid application head 146, the columns 147*a* and 147*b*, the pressure plate 148, and the coil springs 149*a* and 149*b* are moved down together to allow the pressure plate 148 to contact the sheet P. The first liquid application position B1 corresponds to the first binding position B1 to be crimped and bound by the edge binder 251, specifically, the crimper 32'.

As the application head movement motor 151 keeps rotating in the first direction after the pressure plate 148 contacts the sheet P, the coil springs 149*a* and 149*b* are compressed to further move down the application head mover 144, the holder 145, the liquid application head 146, and the columns 147*a* and 147*b*. As a result, as illustrated in FIGS. 30B and 31B, a lower face of the liquid application head 146 contacts the sheet P through the through hole 148*a*. As a result, the liquid contained in the liquid application head 146 is applied to the sheet P.

Further rotation of the application head movement motor 151 in the first direction further strongly presses the liquid application head 146 against the sheet P as illustrated in FIGS. 30C and 31C. Accordingly, the amount of liquid that is applied to the sheet P increases. In other words, the liquid applier 131 changes the pressing force of the liquid application head 146 against the sheet P to adjust the amount of liquid to be applied to the sheet P.

On the other hand, the rotation of the application head movement motor 151 in the second direction opposite to the first direction moves up the application head mover 144, the holder 145, the liquid application head 146, the columns 147*a* and 147*b*, the pressure plate 148, and the coil springs 149*a* and 149*b* together. As a result, as illustrated in FIGS. 30A and 31A, the liquid application head 146 and the pressure plate 148 are separated from the sheet P. In other words, the liquid applier 131 includes the liquid application head 146 that can be separated from the sheet P.

FIG. 32 is a block diagram illustrating a hardware configuration of the control block of the post-processing apparatus 3A to control the operation of the post-processing apparatus 3A according to the second embodiment of the present disclosure.

As illustrated in FIG. 32, the post-processing apparatus 3A includes a central processing unit (CPU) 101, a random-access memory (RAM) 102, a read-only memory (ROM) 103, a hard disk drive (HDD) 104, and an interface (I/F) 105. The CPU 101, the RAM 102, the ROM 103, the HDD 104, and the I/F 105 are connected to each other via a common bus 109.

The CPU 101 is an arithmetic unit and controls the operation of the overall operation of the post-processing apparatus 3A.

The RAM 102 is a volatile storage medium that allows data to be read and written at high speed. The CPU 101 uses the RAM 102 as a work area for data processing.

The ROM 103 is a read-only non-volatile storage medium that stores programs such as firmware.

The HDD 104 is a non-volatile storage medium that allows data to be read and written and has a relatively large storage capacity. The HDD 104 stores, for example, an operating system (OS), various control programs, and application programs.

In the post-processing apparatus 3A, an arithmetic function of the CPU 101 processes a control program stored in the ROM 103 and an information processing program (or application program) loaded into the RAM 102 from a storage medium such as the HDD 104. Such processing configures a software controller including various functional modules of the post-processing apparatus 3A. The software controller that is thus configured cooperates with hardware resources of the post-processing apparatus 3A to construct functional blocks that implement functions of the post-processing apparatus 3A. In other words, the CPU 101, the RAM 102, the ROM 103, the HDD 104, and the I/F 105 constitute at least part of the controller 100*b* serving as a control device that controls the operation of the post-processing apparatus 3A.

The I/F 105 is an interface that connects the conveyance roller pairs 10, 11, 14, and 15, the switching member 20, the side fences 24L and 24R, the crimper movement motor 238, the crimper pivot motor 239, the contact-separation motor 32*d*, the liquid applier movement motor 137, the application head pivot motor 150, the application head movement motor 151, the standby position sensor 138, the standby angle sensor 152, the hole punch 132, and the control panel 110 to the common bus 109.

The controller 100*b* controls, via the I/F 105, the operations of the conveyance roller pairs 10, 11, 14, and 15, the switching member 20, the side fences 24L and 24R, the crimper movement motor 238, the crimper pivot motor 239, the contact-separation motor 32*d*, the liquid applier movement motor 137, the application head pivot motor 150, the application head movement motor 151, and the hole punch 132. The controller 100*b* acquires detection results from the standby position sensor 138 and the standby angle sensor 152 through the I/F 105.

Although FIG. 32 illustrates the components of the liquid applier 131 and the edge binder 251 (the crimper 32') that executes the edge binding, the components of the saddle binder 28 that executes the saddle binding are controlled by the controller 100*b* like the components of the liquid applier 131 and the edge binder 251 (the crimper 32') that executes the edge binding.

As illustrated in FIG. 34, the image forming apparatus 2 includes the control panel 110. The control panel 110 includes an operating device that receives instructions input by a user and a display serving as a notifier that notifies the user of information. The operation unit includes, for example, hard keys and a touch panel superimposed on the display. The control panel 110 acquires information from the user through the operation unit and provides the information to the user through the display. The post-processing apparatus 3A may include a control panel 110 similar to the above-described control panel 110 of the image forming apparatus 2.

Figure 33:
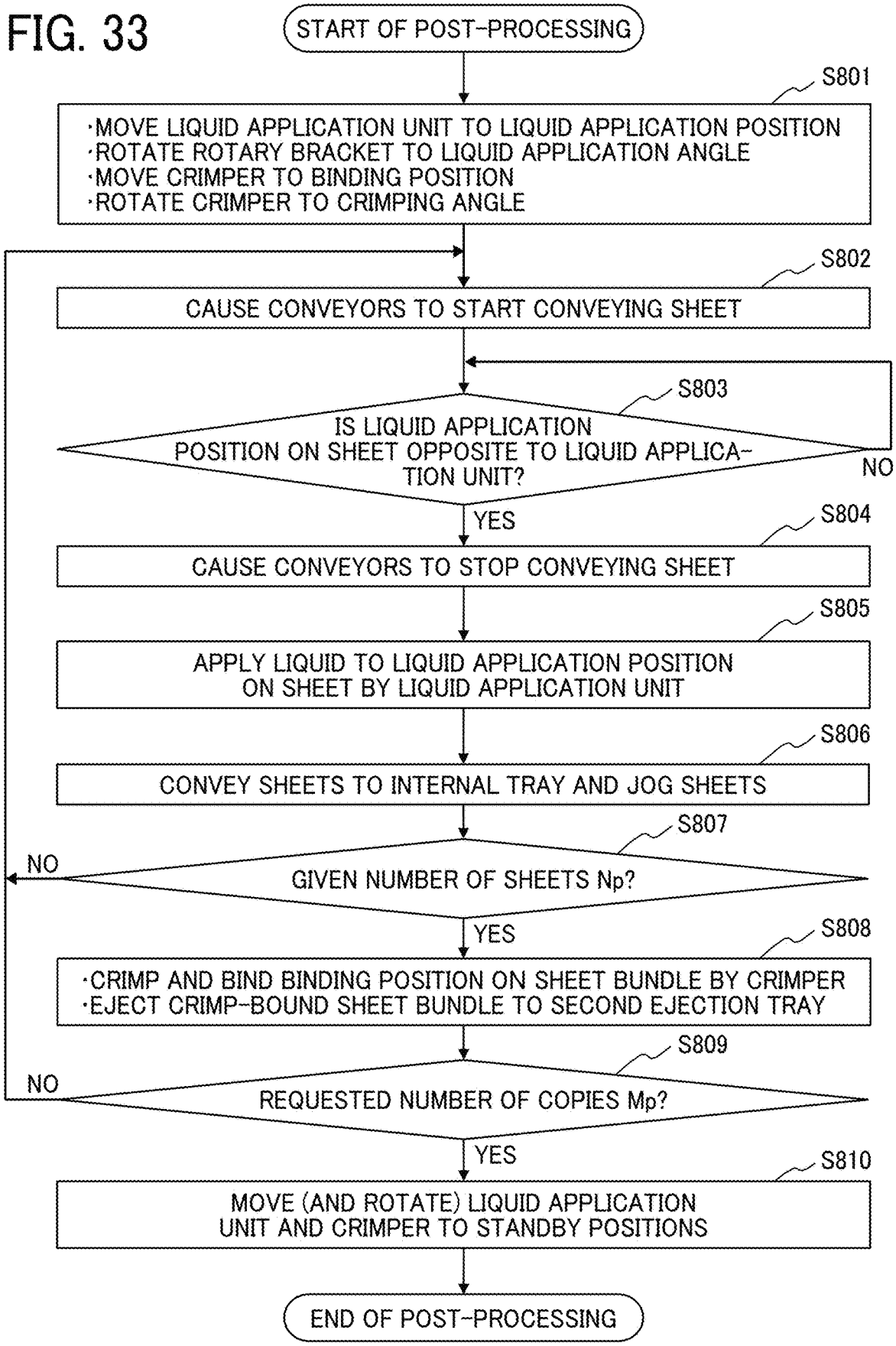
FIG. 33 is a flowchart of post-processing performed by the post-processing apparatus according to the second embodiment.

FIG. 33 is a flowchart of post-processing performed by the post-processing apparatus 3A according to the second embodiment.

Specifically, FIG. 33 is a flowchart of a process to execute the one-point binding illustrated in FIGS. 27A to 27C.

For example, the controller 100*b* executes the post-processing illustrated in FIG. 33 when the controller 100*b* acquires an instruction to execute the post-processing from the image forming apparatus 2. In the following description, the instruction to execute the post-processing may be referred to as a "post-processing command." The post-processing command includes, for example, the number of sheets P of the sheet bundle Pb (referred to as "given number Np"), the number of sheet bundles Pb to be subjected to binding processing, the first binding position B1 (corresponding to the first liquid application position B1), the angle of the first binding position B1 (corresponding to the angle of the first liquid application position B1), the type of binding process (parallel binding process or oblique binding process), and a process that is executed in parallel with the liquid application process (i.e., punching a hole in the present embodiment). In the following description, the number of sheets P of the sheet bundle Pb may be referred to as a "given number Np," and the number of sheet bundles Pb to be subjected to binding processing may be referred to as "requested number Mp of copies." At the start of the post-processing, the liquid application unit 140 is at the standby position HP4 illustrated in FIGS. 29A and 29B, and the rotary bracket 142 is held at the standby angle (corresponding to the parallel binding posture) at the standby position HP1.

First, in step S801, the controller 100*b* drives the liquid applier movement motor 137 to move the liquid application unit 140 (corresponding to a liquid applier) in the main scanning direction such that a liquid application head 146 moves from the standby position HP4 to a position where the liquid application head 146 can face the liquid application position B1 (see FIG. 29B, the position corresponding to the first binding position B1 illustrated in FIGS. 27B and 27C). If the type of the binding process instructed by the post-processing command is the "oblique binding process" in step S801, the controller 100*b* drives the application head pivot motor 150 to rotate the rotary bracket 142. Thus, the liquid application head 146 is rotated from the standby angle to the liquid application angle corresponding to the "oblique binding posture."

It is ascertained based on a pulse signal output from a rotary encoder of the liquid applier movement motor 137 that the liquid application head 146 has reached the position where the liquid application head 146 can face the first liquid application position B1. Similarly, it is ascertained based on a pulse signal output from a rotary encoder of the application head pivot motor 150 that the liquid application head 146 has reached the liquid application angle. If the type of the binding process instructed by the post-processing command is "parallel binding process", the controller 100*b* omits the above-described operation of rotating the rotary bracket 142. In other words, the liquid application unit 140 moves in the main scanning direction while holding the rotary bracket 142 at the standby angle.

Further, in step S801, the controller 100*b* drives the crimper movement motor 238 to move the crimper 32' from the standby position HP3 to the position where the crimper 32' can face the first binding position B1 as illustrated in FIGS. 27A and 27B. Alternatively, if the type of the binding process instructed by the post-processing command is "oblique binding process," in step S801, the controller 100*b* drives the crimper pivot motor 239 to rotate the crimper 32' from the standby angle to the crimping angle corresponding to the "oblique binding posture." It is ascertained, based on a pulse signal output from a rotary encoder of the crimper movement motor 238, that the crimper 32' has reached the position where the crimper 32' can face the first binding position B1. Similarly, it is ascertained, based on a pulse signal output from a rotary encoder of the crimper pivot motor 239, that the crimper 32' has reached the crimping angle. If the type of the binding process instructed by the post-processing command is "parallel binding process," the controller 100*b* omits the above-described operation of rotating the crimper 32'. In other words, the crimper 32' moves in the main scanning direction while maintaining the standby angle.

Subsequently, in step S802, the controller 100*b* drives the conveyance roller pairs 10 and 11 to start conveying the sheet P on which an image is formed by the image forming apparatus 2. The controller 100*b* determines whether the first liquid application position B1 on the sheet P faces the liquid application unit 140 (more specifically, the liquid application head 146) in step S803. In other words, the controller 100*b* determines whether the liquid application unit 140 has faced the first liquid application position B1 on the sheet P. When the first liquid application position B1 on the sheet P has not faced the liquid application unit 140 (NO in step S803), the controller 100*b* repeats the processing in step S803. In other words, the controller 100*b* continues driving the conveyance roller pairs 10 and 11 until the first liquid application position B1 on the sheet P faces the liquid application head 146 (YES in step S803). When the controller 100*b* determines that the first liquid application position B1 on the sheet P has faced the liquid application head 146 (YES in step S803), the controller 100*b* causes the conveyance roller pairs 10 and 11 to stop conveying the sheet P instep S804. It is ascertained, based on a pulse signal output from a rotary encoder of a motor that drives the conveyance roller pairs 10 and 11, that the first liquid application position B1 on the sheet P has faced the liquid application head 146.

The controller 100*b* causes the liquid application unit 140 to execute the process of applying liquid to the sheet P at the first liquid application position B1 in step S805. Specifically, the controller 100*b* rotates the application head movement motor 151 in the first direction to bring the liquid application head 146 into contact with the sheet P at the first liquid application position B1. The controller 100*b* changes the pressing force of the liquid application head 146 (i.e., the amount of rotation of the application head movement motor 151) depending on the amount of liquid to be applied to the sheet P.

The amount of liquid that is applied to the sheet P may be the same for all the sheets P of the sheet bundle Pb or may be different for each sheet P. For example, the controller 100*b* may decrease the amount of liquid applied to a sheet P conveyed later. The amount of rotation of the application head movement motor 151 may be ascertained based on a pulse signal outputted from a rotary encoder of the application head movement motor 151.

In step S806, the controller 100*b* drives the conveyance roller pairs 10, 11, 14, and 15 to place a sheet P on the internal tray 22. The controller 100*b* moves the side fences 24L and 24R to align the position of the sheet P or the sheet bundle Pb placed on the internal tray 22 in the main scanning direction in step S806. In short, the controller 100*b* performs so-called jogging.

The controller 100*b* determines whether the number of sheets P placed on the internal tray 22 has reached the given number of sheets Np indicated by the post-processing command in step S807. When the controller 100*b* determines that the number of sheets P placed on the internal tray 22 has not reached the given number of sheets Np (NO in step S807), the controller 100*b* executes the operations of steps S802 to S807 again until the number of sheets P placed on the internal tray 22 reaches the given number of sheets Np (YES in step S807).

By contrast, when the controller 100*b* determines that the number of sheets P placed on the internal tray 22 has reached the given number of sheets Np (YES in step S807), the controller 100*b* causes the crimper 32' to crimp the sheets P at the first binding position B1 (corresponding to the first liquid application position B1) on the sheet bundle Pb to which the liquid has been applied by the liquid application unit 140 in step S808. In addition, in step S808, the controller 100*b* rotates the conveyance roller pair 15 to eject the crimped sheet bundle Pb to the second ejection tray 26.

The controller 100*b* determines whether the number of sheet bundles Pb thus ejected to the second ejection tray 26 has reached the requested number of copies Mp indicated by the post-processing command in step S809. When the controller 100*b* determines that the number of the sheet bundles Pb ejected to the second ejection tray 26 has not reached the requested number of copies Mp (No in step S809), the controller 100*b* repeats the processing of steps S802 to S809 until the number of the sheet bundles Pb ejected to the second ejection tray 26 reaches the requested number of copies Mp (Yes in step S809).

When the controller 100*b* determines that the number of sheet bundles Pb ejected to the second ejection tray 26 reaches the requested number of copies Mp (YES in step S809), the controller 100*b* drives the liquid applier movement motor 137 to move the liquid application unit 140 to the standby position HP4 (see FIG. 29) and drives the crimper movement motor 238 to move the crimper 32' to the standby position HP3 (see FIG. 27) in step S810. When the posture that is instructed by the post-processing command is the "oblique binding posture," the controller 100*b* drives the application head pivot motor 150 and the crimper pivot motor 239 to rotate the liquid application unit 140 and crimper 32' into the parallel binding posture (the standby angle) in step S810. By contrast, when the posture that is instructed by the post-processing command is the "parallel binding posture," the controller 100*b* skips the aforementioned operation of rotating the liquid application unit 140 and the crimper 32' to the parallel binding posture (standby angle). In steps S801 and S810, the execution order of the movement in the main scanning direction and the rotation in the forward and reverse directions of the liquid application unit 140 and the crimper 32' is not limited to the aforementioned order and may be reversed.

The embodiments of the present disclosure are applied to the edge binder 251 that executes the edge binding as described above. However, the embodiments of the present disclosure may be applied to the saddle binder 28 that executes the saddle binding.

The controller 100*b* of the post-processing apparatus 3A according to the second embodiment illustrated in FIG. 26 is provided separately from the controller 100*a* of the image forming apparatus 2 as in the configuration of FIG. 1. However, embodiments of the present disclosure are not limited to the above-described configuration. For example, as illustrated in FIG. 35A, the controller 100*b* of the post-processing apparatus 3A may be disposed in the image forming apparatus 2. Further, as in the configuration of FIG. 35B, the controller 100*b* of the post-processing apparatus 3A may be integrated with the controller 100*a* of the image forming apparatus 2.

As in the configuration of FIG. 35A, the controller 100*b* of the post-processing apparatus 3A may be divided into a controller 100*b*1 (e.g., a driver system such as a motor) and a controller 100*b*2 (a detector such as a sensor) according to the function, and the controller 100*b*2 of the post-processing apparatus 3A may be disposed in the image forming apparatus 2. Further, as in the configuration of FIG. 35B, the controller 100*b*2 of the post-processing apparatus 3A disposed in the image forming apparatus 2 may be integrated with the controller 100*a* of the image forming apparatus 2.

As described above, the control method by the controller 100*b* described above is implemented by cooperation between hardware resources of a computer and a program as computer software. In other words, the control method may be executed by causing an arithmetic device, a storage device, an input device, an output device, and a control device to operate in cooperation with each other based on a program. In addition, the program may be written in, for example, a storage device or a storage medium and distributed, or may be distributed through, for example, an electric communication line.

Embodiments of the present disclosure are not limited to the above-described embodiments, and numerous additional modifications and variations are possible in light of the teachings within the technical scope of the appended claims. It is therefore to be understood that the above-described embodiments of the present disclosure may be practiced otherwise by those skilled in the art than as specifically described herein. Such modifications and alternatives are within the technical scope of the appended claims.

As described above, the medium processing apparatus according to the present embodiments of the present disclosure can change the number of repetitions of bindings for the sheet bundle Pb according to the type of post-processing and set an appropriate binding force (in other words, an appropriate binding strength) and an appropriate binding speed (in other words, appropriate productivity) according to the type of binding. The above-described configuration enhances the convenience of the users and the productivity of the binding process.

Aspects of the present disclosure are, for example, as follows.

First Aspect

In a first aspect, a medium processing apparatus includes a liquid applier, a post-processing device, and a controller that is circuitry. The liquid applier performs a liquid application on at least one medium. The post-processing device performs post-processing on a bundle of media including the at least one medium. The controller is configured to change a number of times of execution of the post-processing according to a type of the post-processing and a type of binding mode to bind the bundle of media.

Second Aspect

In a second aspect, the post-processing device in the medium processing apparatus according to the first aspect includes a crimper to perform a crimp binding that presses and deforms the bundle of media in a thickness direction of the bundle of media to bind the bundle of media, as the post-processing. The controller is configured to change a number of the crimp bindings as the number of times of execution of post-processing.

Third Aspect

In a third aspect, the controller is configured to change a number of the liquid applications in addition to the number of the crimp bindings.

Fourth Aspect

In a fourth aspect, the post-processing device in the medium processing apparatus according to the second aspect or the third aspect includes a stapler to perform a staple binding on the bundle of media.

Fifth Aspect

In a fifth aspect, the medium processing apparatus according to any one of the second to fourth aspects further includes a post-processing device pivot assembly to pivot the post-processing device, and the controller is configured to change the number of the crimp bindings according to a crimp binding posture changed by the post-processing device pivot assembly.

Sixth Aspect

In a sixth aspect, the controller in the medium processing apparatus according to the first to fifth aspects is configured to change the number of times of execution of post-processing according to a number of media included in the bundle of media.

Seventh Aspect

In a seventh aspect, the controller in the medium processing apparatus according to the first to sixth aspects is configured to determine whether a remaining amount of liquid held by the liquid applier satisfies a consumption amount of liquid consumed by the liquid application performed during the number of times of execution of post-processing and change the number of times of execution of post-processing in response to a determination that the remaining amount of liquid does not satisfy the consumption amount of liquid.

Eighth Aspect

In an eighth aspect, the controller in the medium processing apparatus according to any one of the fourth to sixth aspects is configured to perform any one of the crimp binding and the staple binding according to a number of media included in the bundle of media.

Ninth Aspect

In a ninth aspect, the controller in the medium processing apparatus according to any one of the first to seventh aspects is configured to determine whether the crimper performs the crimp binding based on a remaining amount of liquid held by the liquid applier and control the stapler to perform the staple binding based on a determination that the crimper does not perform the crimp binding.

Tenth Aspect

In a tenth aspect, an image forming system includes an image forming apparatus including an image former to form images on the media and the medium processing apparatus according to any one of the first to ninth aspects to perform the post-processing on the media on which the image forming apparatus forms the images.

Eleventh Aspect

In an eleventh aspect, a medium processing apparatus includes a liquid applier, a post-processing device, and circuitry. The liquid applier applies liquid on at least one medium. The post-processing device performs a combination of various types of post-processes including a liquid application crimp binding and a crimp binding and a various types of bindings including a dual binding, a parallel binding, and an oblique binding, on a bundle of media including the at least one medium for a number of times. The circuitry is to change the number of times of the post-process according to the combination of the various types of the post processes and the various types of bindings, to be performed.

Twelfth Aspect

In a twelfth aspect, the post-processing device in the medium processing apparatus according to the eleventh aspect includes a crimper to perform the crimp binding, that presses and deforms the bundle of media in a thickness direction of the bundle of media to bind the bundle of media, for a number of times, as the post-process. The circuitry is further to change the number of times of the crimp binding.

Thirteenth Aspect

In a thirteenth aspect, in the medium processing apparatus according to the twelfth aspect, the circuitry is further to change a number of a liquid applications by the liquid applier in addition to change the number of the crimp bindings.

Fourteenth Aspect

In a fourteenth aspect, the medium processing apparatus according to the twelfth aspect or the thirteenth aspect further includes a pivot assembly to pivot the post-processing device. The circuitry is further to change the number of times of the crimp bindings according to a posture of the crimper changed by the pivot assembly. The circuitry is further to change the number of times of the post-processes according to a number of media in the bundle of media.

Fifteenth Aspect

In a fifteenth aspect, the post-processing device in the medium processing apparatus according to the twelfth aspect or the thirteenth aspect further includes a stapler to perform a staple binding on the bundle of media.

Sixteenth Aspect

In a sixteenth aspect, the circuitry in the medium processing apparatus according to the fifteenth aspect is to perform the crimp binding or the staple binding, according to a number of media in the bundle of media.

Seventeenth Aspect

In a seventeenth aspect, the circuitry in the medium processing apparatus according to the fifteenth aspect or the sixteenth aspect is configured to determine whether the crimper performs the crimp binding based on a remaining amount of liquid held by the liquid applier, and control the stapler to perform the staple binding based on a determination that the crimper does not perform the crimp binding.

Eighteenth Aspect

In an eighteenth aspect, the circuitry in the medium processing apparatus according to the eleventh to seventeenth aspects is to determine whether a remaining amount of liquid held by the liquid applier satisfies a consumption amount of liquid consumed by the liquid applier during a liquid application to be performed by the liquid applier for the number of times, and change the number of times of the post-processes in response to a determination that the remaining amount does not satisfy the consumption amount.

Nineteenth Aspect

In a nineteenth aspect, the controller in the medium processing apparatus according to any one of the eleventh aspect to the eighteenth aspect is further to determine whether a remaining amount of liquid held by the liquid applier satisfies a consumption amount of liquid consumed by the liquid applier during a liquid application to be performed by the liquid applier for a number of times, and change the number of times of the post-processes in response to a determination that the remaining amount does not satisfy the consumption amount.

Twentieth Aspect

In a twentieth aspect, an image forming system includes an image forming apparatus including an image former to form images on the medium, and the medium processing apparatus according to any one of the eleventh to nineteenth aspects to perform the post-processing on the medium on which the image forming apparatus.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A medium processing apparatus comprising:

a liquid applier configured to apply liquid on at least one medium;

a post-processing device configured to perform a combination of:

various types of post-processes including:

a liquid application crimp binding; and a crimp binding; and various types of bindings including:

a dual binding;

a parallel binding; and an oblique binding, on a bundle of media including the at least one medium for a number of times; and circuitry configured to change the number of times of the post-process according to the combination of:

the various types of the post-processes; and the various types of the bindings, to be performed, wherein the post-processing device includes a crimper to perform the crimp binding, that presses and deforms the bundle of media in a thickness direction of the bundle of media to bind the bundle of media, for a number of times, as the post-processes, and the post-processing device includes a stapler to perform a staple binding on the bundle of media, the circuitry is further configured to:

determine whether the crimper performs the crimp binding based on a remaining amount of the liquid held by the liquid applier; and control the stapler to perform the staple binding based on a determination that the crimper does not perform the crimp binding.

2. The medium processing apparatus according to claim 1, wherein the circuitry is further configured to change the number of times of the crimp binding.

3. The medium processing apparatus according to claim 1, wherein the circuitry is further configured to change a number of a liquid applications by the liquid applier in addition to change the number of times of the crimp bindings.

4. The medium processing apparatus according to claim 1, further comprising a pivot assembly configured to pivot the post-processing device, wherein the circuitry is further configured to change the number of times of the crimp bindings according to a posture of the crimper changed by the pivot assembly.

5. The medium processing apparatus according to claim 1, wherein the circuitry is further configured to perform the crimp binding or the staple binding, according to a number of media in the bundle of media.

6. The medium processing apparatus according to claim 1, wherein the circuitry is further configured to change the number of times of the post-processes according to a number of media in the bundle of media.

7. An image forming system comprising:

an image forming apparatus including an image former configured to form images on the at least one medium; and the medium processing apparatus according to claim 1 configured to perform the post-processes on the at least one medium on which the image is formed by the image forming apparatus.

8. A medium processing apparatus comprising:

a liquid applier configured to apply liquid on at least one medium;

a post-processing device configured to perform a combination of:

various types of post-processes including:

a liquid application crimp binding; and a crimp binding; and various types of bindings including:

a dual binding;

a parallel binding; and an oblique binding, on a bundle of media including the at least one medium for a number of times; and circuitry configured to change the number of times of the post-process according to the combination of:

the various types of the post-processes, and the various types of the bindings, to be performed, wherein the circuitry is further configured to:

determine whether a remaining amount of the liquid held by the liquid applier satisfies a consumption amount of the liquid consumed by the liquid applier during a liquid application to be performed by the liquid applier for a number of times; and change the number of times of the post-processes in response to a determination that the remaining amount does not satisfy the consumption amount.

* * * * *